US012251062B2

(12) United States Patent
Shin et al.

(10) Patent No.: US 12,251,062 B2
(45) Date of Patent: Mar. 18, 2025

(54) NOZZLE FOR CLEANER

(71) Applicant: LG ELECTRONICS INC., Seoul (KR)

(72) Inventors: Jinhyouk Shin, Seoul (KR); Jinho Kim, Seoul (KR); Hyeri Kwon, Seoul (KR); Sungjun Kim, Seoul (KR); Kyoungho Ryou, Seoul (KR); Jungwan Ryu, Seoul (KR); Ingyu Yang, Seoul (KR); Youngsoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/624,952

(22) Filed: Apr. 2, 2024

(65) Prior Publication Data

US 2024/0245280 A1 Jul. 25, 2024

Related U.S. Application Data

(63) Continuation of application No. 17/980,286, filed on Nov. 3, 2022, now Pat. No. 12,029,364, which is a (Continued)

(30) Foreign Application Priority Data

Apr. 30, 2018 (KR) ..... 10-2018-0050059
Apr. 30, 2018 (KR) ..... 10-2018-0050085
Aug. 13, 2018 (KR) ..... 10-2018-0094342

(51) Int. Cl.
*A47L 7/00* (2006.01)
*A47L 9/02* (2006.01)
(Continued)

(52) U.S. Cl.
CPC ..... *A47L 13/22* (2013.01); *A47L 7/0009* (2013.01); *A47L 9/02* (2013.01); *A47L 9/0411* (2013.01);
(Continued)

(58) Field of Classification Search
None
See application file for complete search history.

(56) References Cited

U.S. PATENT DOCUMENTS 6,237,188 B1 5/2001 Takemoto et al.
6,792,648 B2 9/2004 Lee
(Continued)

FOREIGN PATENT DOCUMENTS

CN 2397880 Y 9/2000
CN 1315602 A 10/2001
(Continued)

OTHER PUBLICATIONS

Australian Notice of Allowance dated Aug. 17, 2022 for Application No. 2019263346.
(Continued)

*Primary Examiner* — Levon J Shahinian
(74) *Attorney, Agent, or Firm* — Birch, Stewart, Kolasch & Birch, LLP

(57) ABSTRACT

A cleaner can include a cleaner main body including a suction motor configured to generate a suction force to suction air containing dust on a cleaning surface, the cleaner main body being configured to separate the dust from the air suctioned; a nozzle placed on the cleaning surface and configured to suck the air containing dust on the cleaning surface; and an extension tube to which the nozzle is detachably connected, one end connected to the nozzle and
(Continued)

the other end connected to the cleaner main body to guide the air containing dust from the cleaning surface to the cleaner main body.

16 Claims, 37 Drawing Sheets

Related U.S. Application Data continuation of application No. 17/341,997, filed on Jun. 8, 2021, now Pat. No. 11,517,173, which is a continuation of application No. 16/397,206, filed on Apr. 29, 2019, now Pat. No. 11,058,278.

(51) Int. Cl.

| | |
|---|---|
| ***A47L 9/04*** | (2006.01) |
| ***A47L 9/06*** | (2006.01) |
| ***A47L 11/20*** | (2006.01) |
| ***A47L 11/202*** | (2006.01) |
| ***A47L 11/206*** | (2006.01) |
| ***A47L 11/282*** | (2006.01) |
| ***A47L 11/40*** | (2006.01) |
| ***A47L 13/22*** | (2006.01) |

(52) U.S. Cl.

CPC ..... *A47L 9/0433* (2013.01); *A47L 9/0472* (2013.01); *A47L 11/201* (2013.01); *A47L 11/2025* (2013.01); *A47L 11/206* (2013.01); *A47L 11/282* (2013.01); *A47L 11/4038* (2013.01); *A47L 11/4044* (2013.01); *A47L 11/4069* (2013.01); *A47L 11/4083* (2013.01); *A47L 11/4088* (2013.01); *A47L 11/4094* (2013.01)

(56) References Cited

U.S. PATENT DOCUMENTS

| | | | |
|---|---|---|---|
| 6,842,941 | B2 | 1/2005 | Lee |
| 7,159,276 | B2 | 1/2007 | Omoto et al. |
| 7,331,082 | B2 | 2/2008 | Hertrick et al. |
| 7,334,291 | B2 | 2/2008 | Song et al. |
| 7,412,750 | B2 | 8/2008 | Oh |
| 7,640,626 | B2 | 1/2010 | Oh |
| 7,743,462 | B2 | 6/2010 | Yoo |
| 8,032,985 | B2 | 10/2011 | Seo |
| 8,677,552 | B2 | 3/2014 | Krebs |
| 8,904,595 | B2 | 12/2014 | Davidshofer et al. |
| 9,265,396 | B1 | 2/2016 | Lu et al. |
| 9,554,680 | B2 | 1/2017 | Elsdon et al. |
| 10,123,673 | B2 | 11/2018 | Kim et al. |
| 10,575,692 | B2 | 3/2020 | Lim et al. |
| 10,582,826 | B2 | 3/2020 | Hwang et al. |
| 10,602,902 | B2 | 3/2020 | Ding et al. |
| 10,638,901 | B2 | 5/2020 | Yang et al. |
| 10,682,035 | B2 | 6/2020 | Ji et al. |
| 10,820,764 | B2 | 11/2020 | Krebs |
| 10,898,045 | B2 | 1/2021 | Woo et al. |
| 10,952,582 | B2 | 3/2021 | Kim et al. |
| 10,993,598 | B2 | 5/2021 | Park et al. |
| 11,006,802 | B2 | 5/2021 | Watanabe et al. |
| 11,058,278 | B2 | 7/2021 | Shin et al. |
| 11,096,536 | B2 | 8/2021 | Yang et al. |
| 11,154,172 | B2 | 10/2021 | Kim et al. |
| 11,191,415 | B2 | 12/2021 | Yang et al. |
| 11,730,335 | B1 | 8/2023 | Resch et al. |
| 11,786,093 | B2 | 10/2023 | Yang et al. |
| 2001/0027586 | A1 | 10/2001 | Lee |
| 2002/0112744 | A1 | 8/2002 | Besseling |
| 2003/0037409 | A1 | 2/2003 | Lee |
| 2003/0221281 | A1 | 12/2003 | Oh |
| 2004/0163199 | A1 | 8/2004 | Hsu |
| 2005/0223522 | A1 | 10/2005 | Song et al. |
| 2007/0067945 | A1 | 3/2007 | Kasper et al. |
| 2007/0074370 | A1 | 4/2007 | Oh |
| 2007/0157422 | A1 | 7/2007 | Oh et al. |
| 2008/0282490 | A1 | 11/2008 | Oh |
| 2009/0064447 | A1 | 3/2009 | Oh et al. |
| 2009/0229069 | A1 | 9/2009 | Lenkiewicz et al. |
| 2010/0287716 | A1 | 11/2010 | Kasper et al. |
| 2012/0110775 | A1 | 5/2012 | Krebs |
| 2013/0121880 | A1 | 5/2013 | Yamazaki |
| 2015/0113757 | A1 | 4/2015 | Franke et al. |
| 2015/0128996 | A1 | 5/2015 | Dooley et al. |
| 2015/0272412 | A1 | 10/2015 | Liscio |
| 2017/0251897 | A1 | 9/2017 | McDowell et al. |
| 2018/0055313 | A1 | 3/2018 | Yang et al. |
| 2018/0192846 | A1 | 7/2018 | Ji et al. |
| 2019/0038106 | A1 | 2/2019 | Jang et al. |
| 2019/0223681 | A1 | 7/2019 | Jang et al. |
| 2019/0328193 | A1 | 10/2019 | Yang et al. |
| 2019/0328194 | A1 | 10/2019 | Kim et al. |
| 2019/0328196 | A1 | 10/2019 | Kim et al. |
| 2019/0328201 | A1 | 10/2019 | Shin et al. |
| 2019/0328202 | A1 | 10/2019 | Yang et al. |
| 2020/0029762 | A1 | 1/2020 | Lee et al. |
| 2021/0045598 | A1 | 2/2021 | Krebs |
| 2021/0076894 | A1 | 3/2021 | Wiltshire |

FOREIGN PATENT DOCUMENTS

| | | | |
|---|---|---|---|
| CN | 1320409 | A | 11/2001 |
| CN | 2660984 | Y | 12/2004 |
| CN | 101108086 | A | 1/2008 |
| CN | 101120867 | A | 2/2008 |
| CN | 101305893 | A | 11/2008 |
| CN | 201162194 | Y | 12/2008 |
| CN | 102085081 | A | 6/2011 |
| CN | 101268923 | B | 12/2011 |
| CN | 102312413 | A | 1/2012 |
| CN | 102525338 | A | 7/2012 |
| CN | 102776853 | A | 11/2012 |
| CN | 103860105 | A | 6/2014 |
| CN | 203866748 | U | 10/2014 |
| CN | 104739344 | A | 7/2015 |
| CN | 104968247 | A | 10/2015 |
| CN | 105361802 | A | 3/2016 |
| CN | 205268043 | U | 6/2016 |
| CN | 205597859 | U | 9/2016 |
| CN | 106955064 | A | 7/2017 |
| CN | 107348894 | A | 11/2017 |
| CN | 107625493 | A | 1/2018 |
| CN | 211674011 | U | 10/2020 |
| EP | 1582131 | A1 | 10/2005 |
| EP | 2016882 | A2 | 1/2009 |
| EP | 2 033 559 | A2 | 3/2009 |
| EP | 2329755 | A2 | 6/2011 |
| EP | 24449937 | A2 | 5/2012 |
| EP | 3459412 | A1 | 3/2019 |
| JP | 10-57289 | A | 3/1998 |
| JP | 11-4790 | A | 1/1999 |
| KR | 97-53478 | U | 10/1997 |
| KR | 20-0148059 | Y1 | 6/1999 |
| KR | 20-0195057 | Y1 | 9/2000 |
| KR | 10-2001-0093648 | A | 10/2001 |
| KR | 10-2003-0016520 | A | 3/2003 |
| KR | 10-0400515 | B1 | 9/2003 |
| KR | 10-0405244 | B | 11/2003 |
| KR | 10-2003-0093625 | | 12/2003 |
| KR | 10-2005-0014652 | A | 2/2005 |
| KR | 20-0402551 | Y1 | 12/2005 |
| KR | 10-2006-0032063 | A | 4/2006 |
| KR | 10-0582285 | B1 | 5/2006 |
| KR | 10-2008-0020304 | A | 3/2008 |
| KR | 10-0814507 | B1 | 3/2008 |
| KR | 10-0822785 | B1 | 4/2008 |
| KR | 10-0848568 | B1 | 7/2008 |
| KR | 10-2009-0000937 | A | 1/2009 |
| KR | 10-2009-0026031 | | 3/2009 |
| KR | 10-2010-0016787 | A | 2/2010 |
| KR | 10-2010-0037469 | A | 4/2010 |

(56) References Cited

FOREIGN PATENT DOCUMENTS

| | | | |
|---|---|---|---|
| KR | 10-0956737 | B1 | 5/2010 |
| KR | 10-2011-0087251 | A | 8/2011 |
| KR | 10-2012-0110271 | A | 10/2012 |
| KR | 10-2013-0129059 | A | 11/2013 |
| KR | 20-2013-0007030 | U | 12/2013 |
| KR | 10-1408733 | B1 | 6/2014 |
| KR | 10-1578887 | B1 | 12/2015 |
| KR | 10-1595727 | B1 | 2/2016 |
| KR | 10-2016-0024735 | A | 3/2016 |
| KR | 10-1623871 | B1 | 5/2016 |
| KR | 10-2016-0065611 | A | 6/2016 |
| KR | 10-2016-0088549 | A | 7/2016 |
| KR | 10-2016-0090571 | A | 8/2016 |
| KR | 10-2016-0098932 | A | 8/2016 |
| KR | 10-1655684 | B1 | 9/2016 |
| KR | 10-1664686 | B1 | 10/2016 |
| KR | 2016-0150433 | A | 12/2016 |
| KR | 10-2017-0028758 | A | 3/2017 |
| KR | 10-2017-0085313 | A | 7/2017 |
| KR | 10-2017-0086401 | A | 7/2017 |
| KR | 10-2017-0136856 | A | 12/2017 |
| KR | 10-1805135 | B1 | 12/2017 |
| KR | 10-2018-0008248 | A | 1/2018 |
| KR | 10-2018-0023401 | A | 3/2018 |
| KR | 10-2018-0098530 | A | 9/2018 |
| TW | 123375 | | 11/1989 |
| TW | 201002262 | A1 | 1/2010 |
| TW | M469865 | U | 1/2014 |
| TW | I483856 | B | 5/2015 |
| TW | 2016/07490 | A | 3/2016 |
| TW | I568402 | B | 2/2017 |
| TW | 201707632 | A | 3/2017 |
| TW | 201707640 | A | 3/2017 |
| TW | 201720359 | A | 6/2017 |
| TW | 201731443 | A | 9/2017 |
| TW | 201707639 | A | 12/2017 |
| TW | 201740856 | A | 12/2017 |
| TW | 201740857 | A | 12/2017 |
| TW | 201740861 | A | 12/2017 |
| TW | 201740868 | A | 12/2017 |
| TW | I618519 | B | 3/2018 |
| TW | 201838576 | A | 11/2018 |
| WO | WO 01/07719 | A1 | 2/2001 |
| WO | WO 2005/011461 | A1 | 2/2005 |
| WO | WO 2010/016660 | A1 | 2/2010 |
| WO | WO 2011/005027 | A2 | 1/2011 |
| WO | WO 2012/014620 | A1 | 2/2012 |
| WO | WO 2013/090143 | A1 | 6/2013 |
| WO | WO 2014/080181 | A1 | 5/2014 |
| WO | WO 2016/021419 | A1 | 2/2016 |
| WO | WO 2016/031704 | A1 | 3/2016 |
| WO | WO 2016/107634 | A1 | 7/2016 |
| WO | WO 2016/190565 | A1 | 12/2016 |
| WO | WO 2017/007152 | A | 1/2017 |
| WO | WO 2018/012912 | A1 | 1/2018 |
| WO | WO 2019/129362 | A1 | 7/2019 |

OTHER PUBLICATIONS

Chinese Office Action in Chinese Application No. 20198002678.9 dated May 21, 2021 (8 pages).

Chinese Office Action in Chinese Application No. 201980026813.9 dated May 11, 2021 (7 pages).

European Search Report in European Application No. 19796167.5, dated Jan. 5, 2022 (7 pages).

International Search Report PCT/KR2019/004827 dated Apr. 30, 2018.

International Search Report PCT/KR2019/004829 dated Apr. 30, 2018.

International Search Report PCT/KR2019/004931 dated Apr. 30, 2018.

International Search Report PCT/KR2019/004932 dated Apr. 30, 2018.

International Search Report PCT/KR2019/004933 dated Apr. 30, 2018.

Korean Action received in corresponding Korean Patent Application No. 10-2021-0034566, dated Mar. 26, 2021 (118 pages).

Korean Action received in corresponding Korean Patent Application No. 10-2021-0037376, dated Apr. 22, 2021 (71 pages).

Korean Action received in corresponding Korean Patent Application No. 10-2021-0037380, dated Apr. 23, 2021 (62 pages).

Korean Notice of Allowance received in Korean Patent Application No. 10-2019-0044986, dated Jul. 21, 2020 (4pages).

Korean Office Action dated Jun. 21, 2022 for Application No. 10-2022-0012767.

Korean Office Action received in corresponding Korean Patent Application No. 10-2019-0044986 dated Apr. 17, 2019 (54 pages).

Notice of Allowance in Korean Application No. 10-2021-0047134, dated Dec. 6, 2021, (2 pages).

Notice of Allowance in Korean Application No. 10-2021-0047135, dated Jul. 27, 2021 (2 pages).

Office Action in Taiwanese Application No. 110129697, dated Jan. 22, 2022 (13 pages).

Office Action received in Australian Patent No. AU 2019100837, dated Sep. 27, 2019.

Taiwanese Notice of Allowance in Taiwanese Application No. 108114573 dated May 13, 2021 (8 pages).

Taiwanese Notice of Allowance in Taiwanese Application No. 108114579 dated May 13, 2021 (10 pages).

Taiwanese Office Action received in corresponding Taiwanese Patent Application No. 10921091080, dated Nov. 11, 2020 (6 pages).

Taiwanese Search Report dated Apr. 30, 2018, issued in Taiwanese Application No. 109109680 (1 page).

NOZZLE FOR CLEANER

CROSS-REFERENCE TO RELATED APPLICATIONS

This application is a Continuation of U.S. patent application Ser. No. 17/980,286 filed on Nov. 3, 2022, which is a Continuation of U.S. patent application Ser. No. 17/341,997 filed on Jun. 8, 2021 (now U.S. Pat. No. 11,517,173 issued on Dec. 6, 2022), which is a Continuation of U.S. patent application Ser. No. 16/397,206, filed on Apr. 29, 2019 (now U.S. Pat. No. 11,058,278 issued on Jul. 13, 2021), which claims priority under 35 U.S.C. § 119 to Korean Patent Application No. 10-2018-0050059, filed in the Republic of Korea on Apr. 30, 2018, Korean Patent Application No. 10-2018-0050085, filed in the Republic of Korea on Apr. 30, 2018, and Korean Patent Application No. 10-2018-0094342, filed in the Republic of Korea on Aug. 13, 2018, the disclosures of all of these applications are hereby incorporated by reference in their entireties.

BACKGROUND

The present specification relates to a nozzle for a cleaner.

The cleaner is a device which suctions or wipes dust or foreign matter in a region to be cleaned to perform a cleaning.

Such a cleaner can be classified into a manual cleaner for performing cleaning while a user directly moves the cleaner and an automatic cleaner for performing cleaning while traveling itself.

The manual cleaner can be classified into a canister-type cleaner, an upright-type cleaner, a handy-type cleaner, and a stick-type cleaner, according to the type of the cleaner.

These cleaners can clean a floor using nozzles. In general, nozzles can be used so as to suction air and dust. According to the type of the nozzle, the nozzle may be attached with a mop to clean the floor with the mop.

Korean Patent Registration No. 10-1408733, which is related art, is provided with a suction brush of a steam vacuum cleaner.

The suction brush of the vacuum cleaner of the related art includes a brush main body for suctioning dirt on the surface to be cleaned together with air, a steam generating unit for heating water supplied from a water reservoir coupled to the brush main body, a turbine fan for generating a rotational force by the suction air flowing into the brush main body, a power transmission unit driven by the rotational force of the turbine fan, and a pair of mop rotation plates disposed at a lower portion of the brush main body and rotated by power transmitted through the power transmitting unit.

In a case of the related art, the water reservoir is installed at a position offset to one side of the brush main body by the steam generating unit installed inside the brush main body. Therefore, there is a disadvantage in that the size of the water reservoir is limited, and thus the storage capacity of the water reservoir is small.

In addition, since the water reservoir is installed at a position offset to one side of the brush main body, the steam generating unit is installed at a position offset to the other side of the brush main body, and the weight of the water reservoir and the steam generating unit is different from each other, there is a disadvantage that the weight is not uniformly distributed to both sides of the brush main body.

In addition, in a case of the related art, a discharge port is formed on the floor of the water reservoir, and a docking protrusion protrudes in the receiving groove in which the water reservoir is received. At this time, since the floor of the water reservoir is seated on the docking protrusion, the floor of the water reservoir is spaced apart from the floor of the receiving groove. Therefore, there is a disadvantage that the storage capacity of the water reservoir cannot be increased.

In addition, in a case of the related art, since the floor of the water reservoir is formed as a single surface having a constant height, in a case where the brush main body is inclined rearward, water cannot be discharged through the discharge port. In other words, since there is no water level difference between the bottoms of the water reservoir, water is not discharged when the brush main body is inclined in a specific direction.

SUMMARY

The present embodiment provides a nozzle for a cleaner which can suction foreign matters on the floor while making the overall size of the nozzle small and slim, clean the floor by rotating a mop, and supply water to the mop.

The present embodiment provides a nozzle for a cleaner in which the storage capacity of a water tank can be increased while reducing the thickness of the water tank itself so that the water tank is not interfered with the driving device.

This embodiment provides a nozzle for a cleaner in which the center of gravity can be uniformly distributed to the left and right of the nozzle in a state where the water tank is mounted.

In the present embodiment, a bottom wall of a water tank is constituted by a plurality of bottom walls having a height difference, thereby providing a nozzle for a cleaner in which water in the water tank can be smoothly discharged through the discharge port despite the inclination of the nozzle.

This embodiment provides a nozzle for a cleaner in which inlets are formed in both side walls of a water tank, and a user can easily inject water into a water tank.

The present embodiment provides a nozzle for a cleaner in which a user can easily grasp a water tank by allowing a water tank to rise in a process of separating a water tank from the nozzle.

A nozzle for a cleaner according to an aspect can be detachably connected to a cleaner or an extension tube of a cleaner.

The nozzle for a cleaner may include a nozzle housing including a suction flow path through which air containing dust flows; a driving device provided in the nozzle housing and including a driving motor; a rotation cleaning unit including a rotation plate which is connected to the driving device at a lower side of the nozzle housing and rotated, and a mop which is attached to a lower side of the rotation plate; and a water tank which stores water to be supplied to the mop, and mounted on an upper side of the nozzle housing so as to be separable.

An upper side wall of the water tank may form an outer appearance of an upper surface of the nozzle in a state of being mounted on the nozzle housing, and a portion of a bottom wall of the water tank may be disposed so as to surround the driving device.

The nozzle housing may include a driving unit cover which surrounds the driving device and protrudes upward.

In a state where another portion of the bottom wall of the water tank is seated on the nozzle housing, the portion of the bottom wall may surround the driving unit cover.

The bottom wall of the water tank may form a receiving space which receives the driving unit cover.

The bottom wall of the water tank may include a first bottom wall which is seated on the nozzle housing, and a second bottom wall which is positioned higher than the first bottom wall and is positioned above the driving device.

The first bottom wall may be positioned at a front end portion of the water tank and the second bottom wall may be positioned behind the first bottom wall, and a discharge port configured to discharge water may be formed in the first bottom wall.

The first bottom wall may further include a first wall portion extending in the lateral direction, and a pair of second wall portions extending in the front and rear direction at both ends of the first wall portion, and in which the discharge port may be formed in any one of the pair of the second wall portions.

The water tank may include a first sidewall extending upward at a front end of the first wall portion extending in the lateral direction, and a pair of second side walls connected to both ends of the first side wall and extending upward at each of the pair of second wall portions, in which an inlet configured to introduce water may be formed in at least one of the pair of second sidewalls.

Each of the second sidewalls may be formed so as to increase in height in a direction away from the first sidewall.

The present embodiment may further include an inlet cover which is coupled to the second side wall to cover the inlet.

A coupling rib may protrude from the first side wall of the water tank, and the nozzle housing may be provided with a rib insertion hole to which the coupling rib is coupled.

A plurality of coupling ribs may be disposed so as to be horizontally spaced from the first side wall.

The bottom wall of the water tank may further include a third bottom wall which is higher than the first bottom wall and lower than the second bottom wall, and the second bottom wall may be positioned between the first bottom wall and the third bottom wall.

The bottom wall of the water tank may include a front and rear extending wall connected to the third bottom wall and extending in the front and rear direction, an air hole may be formed in the front and rear extending wall, and a gasket for guiding outside air into the water tank and blocking water leaking out of the water tank may be coupled to the air hole.

The present embodiment may further include a connection tube which is connected to the nozzle housing and configured to guide air passing through the suction flow path to the cleaner or the extension tube of the cleaner.

In the water tank, a pair of front and rear extending walls may be disposed to face each other in a state of being spaced apart from each other, and the connecting tube may be positioned between the pair of the front and rear extending walls.

The nozzle housing may include a nozzle base, and a nozzle cover coupled to an upper side of the nozzle base. The driving device may be positioned between the nozzle base and the nozzle cover.

The nozzle cover may include a bottom wall, and a circumferential wall extending upwardly from an edge of the bottom wall.

The driving unit cover may protrude upward from the bottom wall of the nozzle cover and is spaced apart from the circumferential wall. A portion of the water tank may be positioned between the driving unit cover and the circumferential wall.

The water tank may include an inlet formed on one side wall and configured to introduce water, and an inlet cover configured to cover the inlet. When the water tank is seated on the nozzle housing, the inlet cover may be covered by the circumferential wall.

The rotation cleaning unit may include a first rotation cleaning unit and a second rotation cleaning unit which are disposed below the nozzle housing and are spaced apart from each other in the lateral direction.

The driving device may include a first driving device having a first driving motor configured to rotate the first rotation cleaning unit and a second driving device having a second driving motor configured to rotate the second rotation cleaning unit.

The water tank may be disposed so as to surround the first driving device and the second driving device.

The water tank may include a first chamber positioned to surround the first driving device, a second chamber positioned to surround the second driving device, and a connection chamber connecting the first chamber and the second chamber.

A portion of the bottom wall of the water tank positioned on the lowermost side may define the connection chamber.

The water tank may have a length in the lateral direction longer than a length in the front and rear direction, and the length of the water tank at the center portion side in the front and rear direction may be shorter than the length of the water tank at both sides in the front and rear direction.

The present embodiment may include an operating unit which is provided in the nozzle housing and operates to release the coupling between the water tank and the nozzle housing; a first coupling unit which is provided in the nozzle housing and receives the operating force of the operating unit and moves; and a second coupling unit which is provided in the water tank and coupled to the first coupling unit.

The operating unit may be vertically moved in the nozzle housing, and the first transmitting unit may be horizontally moved in the nozzle housing.

The present embodiment may further include a supporting body provided in the nozzle housing; and an elastic member which elastically supports the supporting body. The supporting body may be positioned below the second coupling unit in a state where the first coupling unit is coupled to the second coupling unit and when the coupling of the first coupling unit and the second coupling unit is released, the first coupling unit may be raised.

A nozzle for a cleaner may include a nozzle housing including a suction flow path through which air containing dust flows; a driving device provided in the nozzle housing and including a driving motor; a rotation cleaning unit including a rotation plate which is connected to the driving device at a lower side of the nozzle housing and rotated, and a mop which is attached to a lower side of the rotation plate; and a water tank which stores water to be supplied to the mop and is mounted on an upper side of the nozzle housing so as to be separable. The nozzle housing may include a nozzle cover having a bottom wall and a driving unit cover protruding from the bottom wall and covering the driving device. A bottom wall of the water tank may include a first bottom wall which is seated on the bottom wall of the nozzle cover and a second bottom wall which is positioned higher than the first bottom wall and is positioned above the driving unit cover.

DETAILED DESCRIPTION OF THE EMBODIMENTS

Figure 1:
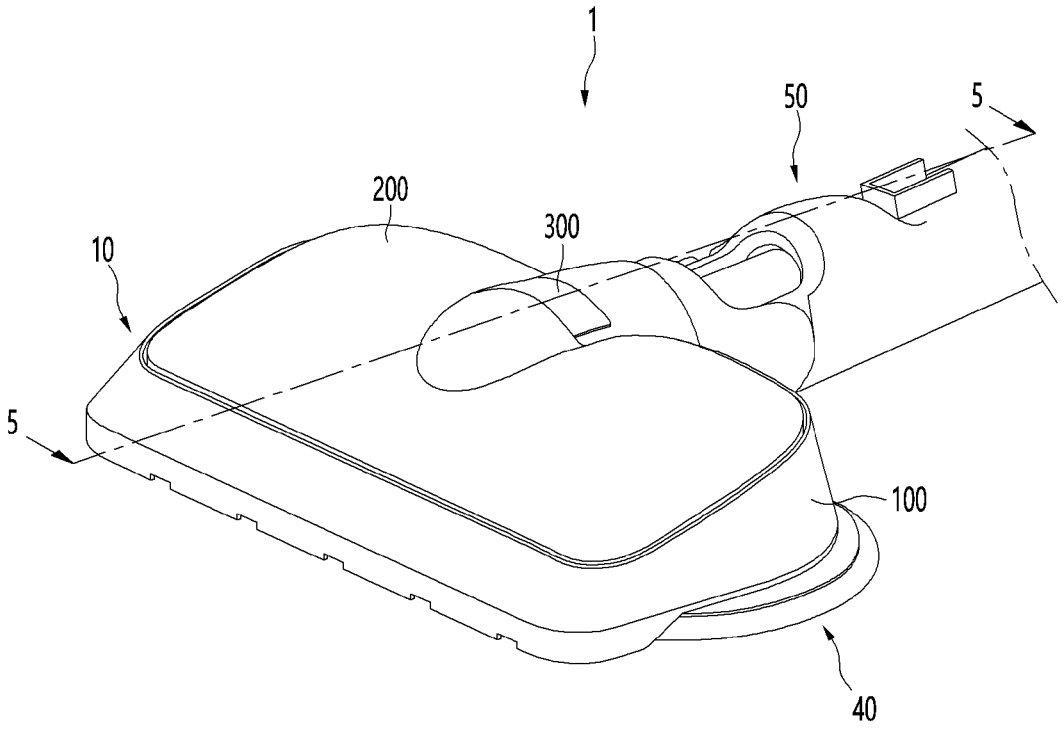
FIG. 1 is a perspective view illustrating a nozzle for a cleaner according to an embodiment of the present invention.
Figure 2:
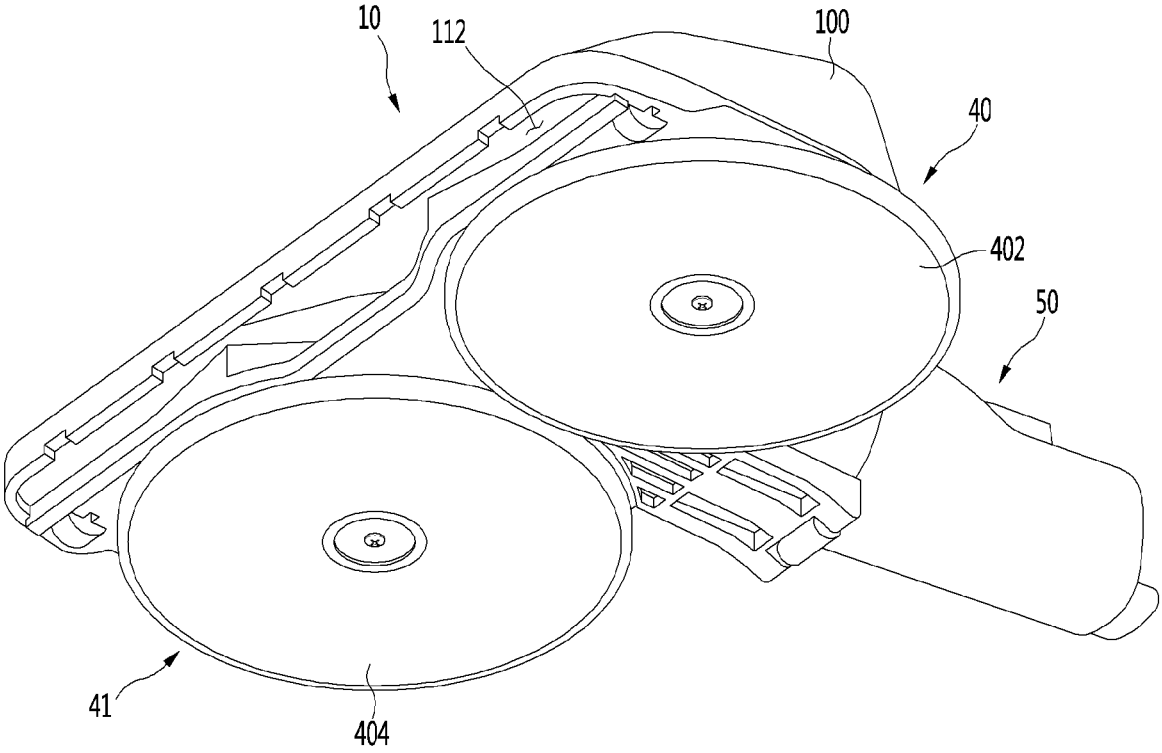
FIG. 2 is a perspective view illustrating a nozzle for a cleaner according to an embodiment of the present invention.
Figure 3:
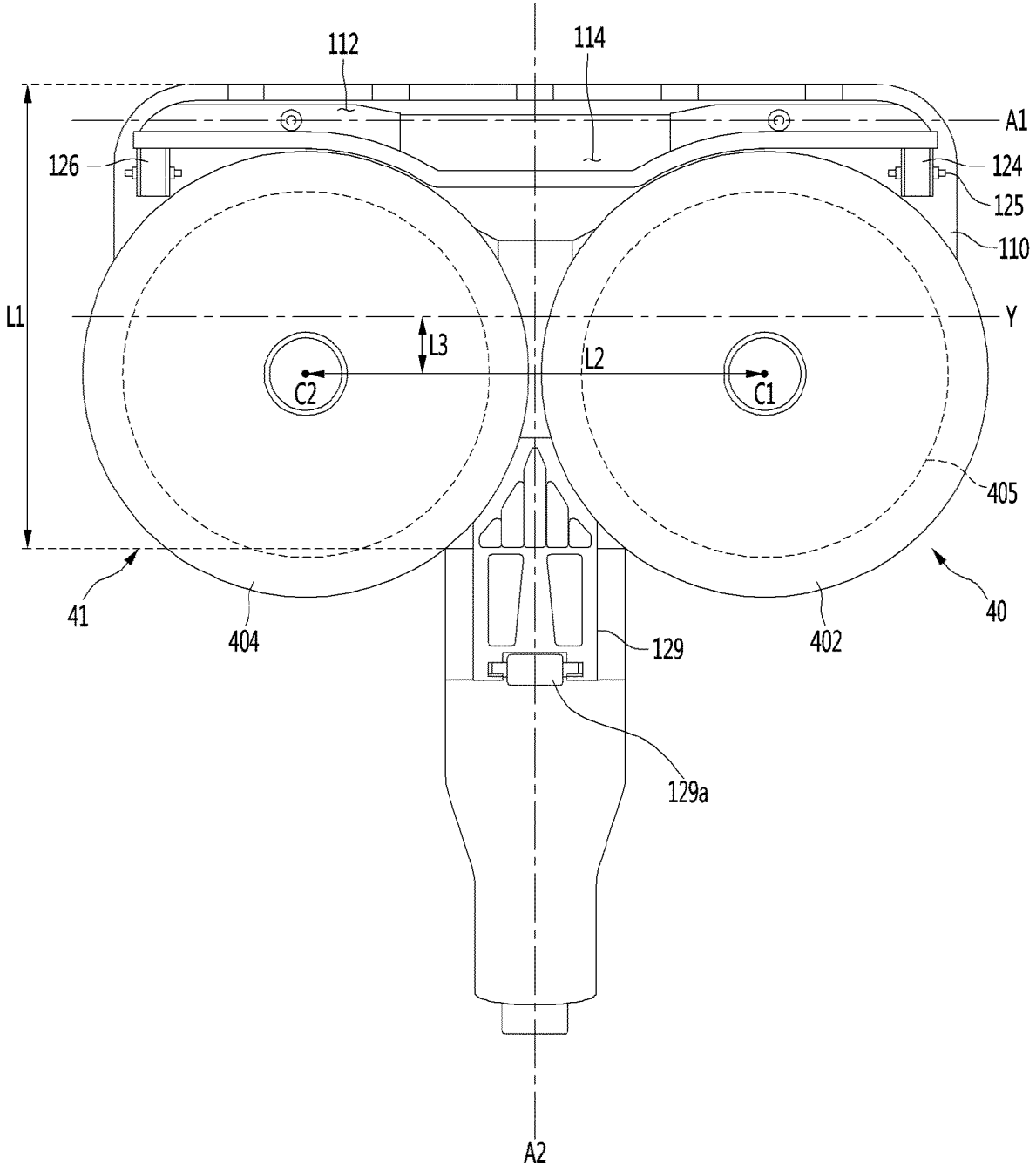
FIG. 3 is a bottom view illustrating a nozzle for a cleaner according to an embodiment of the present invention.
Figure 4:
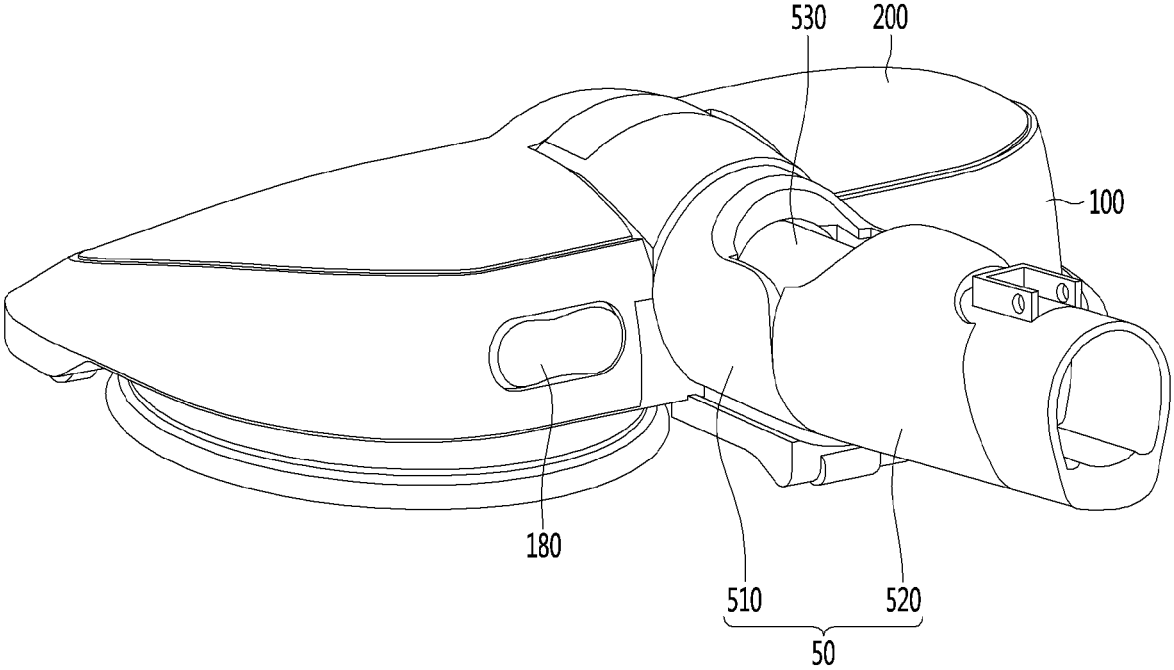
FIG. 4 is a perspective view illustrating the nozzle for the cleaner of FIG. 1 viewed from the rear side.
Figure 5:
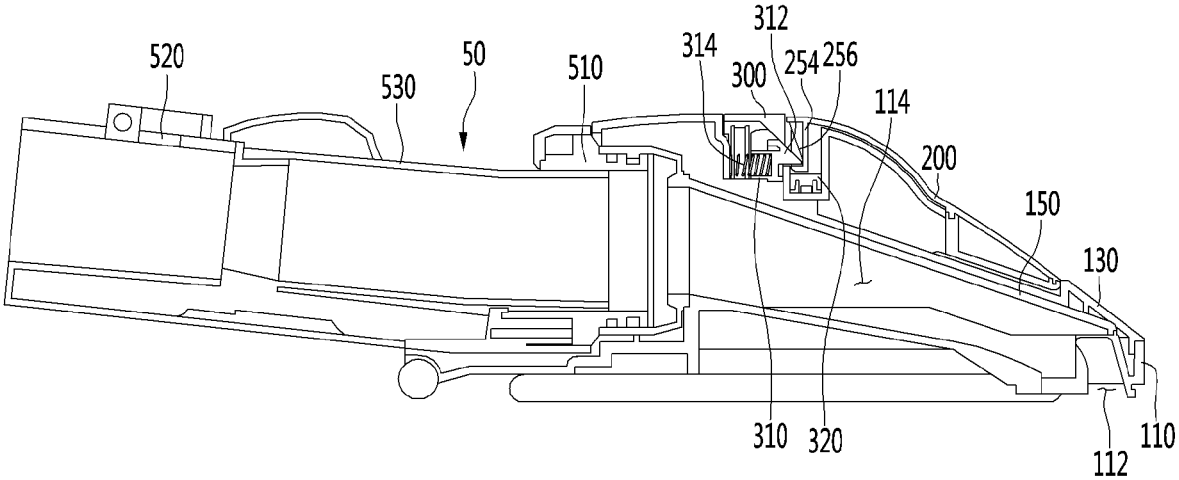
FIG. 5 is a sectional view taken along line 5-5 of FIG. 1.

FIG. 1 and FIG. 2 are perspective views illustrating a nozzle for a cleaner according to an embodiment of the present invention, FIG. 3 is a bottom view illustrating a nozzle for a cleaner according to an embodiment of the present invention, FIG. 4 is a perspective view illustrating the nozzle for the cleaner of FIG. 1 viewed from the rear side, and FIG. 5 is a sectional view taken along line 5-5 of FIG. 1.

Referring to FIG. 1 to FIG. 5, a nozzle 1 of a cleaner (hereinafter referred to as "nozzle") according to an embodiment of the present invention includes a nozzle main body 10, and a connection tube 50 which is connected to the nozzle main body 10 so as to be capable of moving.

The nozzle 1 of the present embodiment can be used, for example, in a state of being connected to a handy type cleaner or connected to a canister type cleaner.

In other words, the nozzle 1 may be detachably connected to a cleaner or an extension tube of a cleaner. Accordingly, the user can clean the floor using the nozzle 1 as the nozzle is connected to the cleaner or the extension tube of the cleaner. At this time, the cleaner to which the nozzle 1 is connected can separate the dust in the air by a multi-cyclone method.

The nozzle 1 itself has a battery to supply power to the power consumption unit therein, or can be operated by receiving power from the cleaner.

Since the cleaner to which the nozzle 1 is connected includes a suction motor, a suction force generated by the suction motor applies to the nozzle 1 to be capable of suctioning foreign matter and air on the floor at the nozzle 1. Accordingly, in the present embodiment, the nozzle 1 can perform a function of suctioning foreign matter and air on the bottom surface and guiding the foreign matter and air to the cleaner.

Although not limited thereto, the connection tube 50 is connected to the rear central portion of the nozzle main body 10 to guide the suctioned air to the cleaner.

In the present embodiment, a portion of the nozzle 1 to which the connection tube 50 is connected is the rear side of the nozzle 1 and a portion of the opposite side of the connection tube 50 is the front side of the nozzle 1.

Alternatively, with respect to FIG. 3, an upper portion is a front side of the nozzle 1 and a lower portion thereof is a rear portion of the nozzle 1.

The nozzle 1 may further include rotation cleaning units 40 and 41 rotatably disposed below the nozzle main body 10.

For example, a pair of rotation cleaning units 40 and 41 may be arranged in the lateral direction. The pair of rotation cleaning units 40 and 41 can be independently rotated. For example, the nozzle 1 may include a first rotation cleaning unit 40 and a second rotation cleaning unit 41.

Each of the rotation cleaning units 40 and 41 may include mops 402 and 404. The mops 402 and 404 may be formed in a disc shape, for example. The mops 402 and 404 may include a first mop 402 and a second mop 404.

The nozzle main body 10 may include a nozzle housing 100 forming an outer shape. The nozzle housing 100 may include suction flow paths 112 and 114 for suctioning air.

The suction flow paths 112 and 114 include a first flow path 112 extending in the lateral direction in the nozzle housing 100 and a second flow path 114 communicating with the first flow path 112 and extending in the front and rear direction.

The first flow path 112 may be formed at a front end portion of the lower surface of the nozzle housing 100, as an example.

The second flow path 114 may extend rearward from the first flow path 112. For example, the second flow path 114 may extend rearward from the central portion of the first flow path 112 toward the connection tube 50.

Accordingly, a centerline A1 of the first flow path 112 can extend in the lateral horizontal direction. A centerline A2 of the second flow path 114 can extend in the front and rear direction and can intersect the centerline A1 of the first flow path 112. However, the centerline A2 of the second flow path 114 is not horizontal but may be inclined in the front and rear direction.

In this embodiment, the centerline A2 of the second flow path 114 may be referred to as centerline of the suction flow path in the front-rear direction.

The centerline A2 of the second flow path 114 may be positioned at a position where the nozzle main body 10 is bisected right and left, as an example.

A portion of the mops 402 and 404 is protruded to the outside of the nozzle 1 in a state where the rotation cleaning units 40 and 41 are connected to the lower side of the nozzle main body 10 and thus the rotation cleaning units 40 and 41 can clean not only a floor positioned directly below the nozzle but also the floor positioned outside the nozzle 1.

For example, the mops 402 and 404 may protrude not only to both sides of the nozzle 1 but also to the rear of the nozzle 1.

The rotation cleaning units 40 and 41 may be positioned on the rear side of the first flow path 112 from below the nozzle main body 10, for example.

Therefore, when the nozzle 1 is advanced and cleaned, the floor can be cleaned by the mops 402, 404 after foreign substances and air on the floor are suctioned by the first flow path 112.

In the present embodiment, the first rotation center C1 of the first rotation cleaning unit 40 (for example, rotation center of rotation plate 420) and the second rotation center C2 of the second rotation cleaning unit 41 (for example, rotation center of rotation plate 440) are disposed in a state of being spaced apart from each other in the lateral direction.

The centerline A2 of the second flow path 114 may be positioned in a region between the first rotation center C1 and the second rotation center C2.

The central axis Y bisecting the front and rear length L1 of the nozzle main body 10 (except for extension portion) can be positioned forward of the rotation centers C1 and C2 of the respective rotation cleaning units 40 and 41.

The rotation centers C1 and C2 of the respective rotation cleaning units 40 and 41 may be positioned farther from the front end portion of the nozzle main body 10 than the central axis Y bisecting the front and rear length L1 of the nozzle main body 10. This is to prevent the rotation cleaning units 40, 41 from blocking the first flow path 112.

Accordingly, the front and rear horizontal distance L3 between the central axis Y and the rotation centers C1 and C2 of the respective rotation cleaners 40 and 41 may be set to a value greater than zero.

In addition, the distance L2 between the rotation centers C1 and C2 of the rotation cleaning units 40 and 41 may be formed to be larger than the diameter of each of the mops 402 and 404. This is to prevent the mops 402 and 404 from interfering with each other during the rotation and to prevent the area which can be cleaned by the interfered portion from being reduced.

The diameters of the mops 402 and 404 are preferably 0.6 times or more than half the width of the nozzle main body 10, although not limited thereto. In this case, the cleaning area of the floor facing the nozzle main body 10 by the mops 402 and 404 is increased, and the area for cleaning the floor not facing the nozzle main body 10 is also increased. In addition, the cleaning area by the mops 402 and 404 can be secured even with a small amount of movement when the nozzle 1 is used for cleaning.

In addition, the mops 402, 404 may be provided with sewing lines 405. The sewing lines 405 may be positioned in a state of being spaced apart inwardly in the center direction at the edge portions of the mops 402 and 404. The mops 402 and 404 may be formed by combining a plurality of fiber materials, and the fiber materials may be joined by the sewing lines 405.

At this time, the diameters of the rotation plates 420 and 440, which will be described later, may be larger than the distance to a portion of the sewing lines 405 from the centers of the mops 402 and 404. The diameters of the rotation plates 420 and 440 may be smaller than the outer diameters of the mops 402 and 404.

In this case, the rotation plates 420 and 440 can support a portion of the mops 402 and 404 positioned outside the sewing lines 405, thereby reducing the distance between the mops 402 and 404, and it is possible to prevent mutual friction between the mops 402 and 404 or vertical overlapping between the mops 402 and 404 due to the deformation of the mops 402 and 404 by pressing the edge portions.

The nozzle housing 100 may include a nozzle base 110 and a nozzle cover 130 coupled to the upper side of the nozzle base 110.

The nozzle base 110 may form the first flow path 112. The nozzle housing 100 may further include a flow path forming portion 150 forming the second flow path 114 together with the nozzle base 110.

The flow path forming portion 150 may be coupled to the upper central portion of the nozzle base 110 and the end portion of the flow path forming portion 150 may be connected to the connection tube 50.

Accordingly, since the second flow path 114 can extend substantially in a straight line shape in the front and rear direction by the disposition of the flow path forming portion 150, the length of the second flow path 114 can be minimized, and thus the flow path loss in the nozzle 1 can be minimized.

The front portion of the flow path forming portion 150 may cover the upper side of the first flow path 112. The flow path forming portion 150 may be disposed to be inclined upward from the front end portion toward the rear side.

Therefore, the height of the front portion of the flow path forming portion 150 may be lower than that of the rear portion of the flow path forming portion 150.

According to the present embodiment, since the height of the front portion of the flow path forming portion 150 is low, there is an advantage that the height of the front portion of the entire height of the nozzle 1 can be reduced. The lower the height of the nozzle 1, the more likely it is that the nozzle 1 can be drawn into a narrow space on the lower side of furniture or a chair to be cleaned.

The nozzle base 110 may include an extension portion 129 for supporting the connection tube 50. The extension portion 129 may extend rearward from the rear end of the nozzle base 110.

The connection tube 50 may include a first connection tube 510 connected to an end of the flow path forming portion 150, a second connection tube 520 rotatably connected to the first connection tube 510, and a guide tube 530 for communicating the first connection tube 510 with the second connection tube 520.

The first connection tube 510 may be seated on the extension portion 129 and the second connection tube 520 may be connected to an extension tube or hose of the cleaner.

A plurality of rollers for smooth movement of the nozzle 1 may be provided on the lower side of the nozzle base 110.

For example, the first roller 124 and the second roller 126 may be positioned behind the first flow path 112 on the nozzle base 110. The first roller 124 and the second roller 126 may be spaced apart from each other in the lateral direction.

According to the present embodiment, the first roller 124 and the second roller 126 are disposed behind the first flow path 112 so that the first flow path 112 can be positioned as close as possible to the front end portion of the nozzle base 110 and thus the area which can be cleaned by using the nozzle 1 can be increased.

As the distance from the front end portion of the nozzle base 110 to the first flow path 112 increases, the area in which the suction force does not apply in front of the first flow path 112 during the cleaning process increases, and thus the area where the cleaning is not performed is increased.

On the other hand, according to the present embodiment, the distance from the front end portion of the nozzle base 110 to the first flow path 112 can be minimized, and thus the cleanable area can be increased.

In addition, by disposing the first roller 124 and the second roller 126 behind the first flow path 112, the length of the first flow path 112 in the lateral direction can be maximized.

In other words, the distance between both end portions of the first flow path 112 and both end portions of the nozzle base 110 can be minimized.

In the present embodiment, the first roller 124 may be positioned in a space between the first flow path 112 and the first mop 402. The second roller 126 may be positioned in a space between the first flow path 112 and the second mop 404.

The first roller 124 and the second roller 126 may be rotatably connected to a shaft 125, respectively. The shaft 125 may be fixed to the lower side of the nozzle base 110 in a state of being disposed so as to extend in the lateral direction.

The distance between the shaft 125 and the front end portion of the nozzle base 110 is longer than the distance between the front end portion of the nozzle base 110 and each of the mops 402 and 404 (or a rotation plate described later).

At least a portion of each of the rotation cleaning units 40 and 41 (mop and/or rotation plate) can be positioned between the shaft 125 of the first roller 124 and the shaft 125 of the second roller 126.

According to this disposition, the rotation cleaning units 40 and 41 can be positioned as close as possible to the first flow path 112, and the area to be cleaned by the rotation cleaning units 40 and 41 of the floor on which the nozzle 1 is positioned can be increased, and thus the floor cleaning performance can be improved.

The plurality of rollers are not limited, but the nozzle 1 can be supported at three points. In other words, the plurality of rollers may further include a third roller **129*a* provided on the extension portion 129 of the nozzle base 110**.

The third roller **129*a* may be positioned behind the mops 402, 404 to prevent interference with the mops 402, 404**.

In a state where the mops 402 and 404 are placed on the floor, the mops 402 and 404 are pressed against the floor and are in close contact with the floor, so that the friction force between the mops 402 and 404 and the bottom surface 404 is increased. In the present embodiment, since the plurality of rollers are coupled to the lower side of the nozzle base 110, the mobility of the nozzle 1 can be improved by the plurality of rollers.

Meanwhile, the nozzle main body 10 may further include a water tank 200 to supply water to the mops 402 and 404.

The water tank 200 may be detachably connected to the nozzle housing 100. The water in the water tank 200 can be supplied to each of the mops 402 and 404 in a state where the water tank 200 is mounted on the nozzle housing 100.

The water tank 200 can form an outer appearance of the nozzle 1 in a state of being mounted on the nozzle housing 100.

The entire upper side wall of the water tank 200 substantially forms an outer appearance of an upper surface of the nozzle 1. Therefore, the user can easily recognize that the water tank 200 is mounted or the water tank 200 is separated from the nozzle housing 100.

The nozzle main body 10 may further include an operating unit 300 that operates to separate the water tank 200 in a state where the water tank 200 is mounted on the nozzle housing 100.

The operating unit 300 may be provided in the nozzle housing 100 as an example. The nozzle housing 100 may be provided with a first coupling unit 310 for coupling with the water tank 200 and the water tank 200*a* may be provided with a second coupling unit 254 for coupling with the first coupling unit 310.

The operating unit 300 may be disposed so as to be capable of vertically moving in the nozzle housing 100. The first coupling unit 310 can be moved under the operation force of the operating unit 300 at the lower side of the operating unit 300.

For example, the first coupling unit 310 may move in the front and rear direction. For this purpose, the operating unit 300 and the first coupling unit 310 may include inclined surfaces contacting each other.

When the operating unit 300 is lowered by the inclined surfaces, the first coupling unit 310 can move horizontally (for example, movement in the front and rear direction).

The first coupling unit 310 includes a hook 312 for engaging with the second coupling unit 254 and the second coupling unit 254 includes a groove 256 for inserting the hook 312.

The first coupling unit 310 may be resiliently supported by the second elastic member 314 so as to maintain a state where the first coupling unit 310 is coupled to the second coupling unit 254.

Therefore, when the hook 312 is in a state of being inserted into the groove 256 by the second elastic member 314 and the operating unit 300 is pressed downward, the hook 312 is separated from the groove 256. The water tank 200 can be separated from the nozzle housing 100 in a state where the hook 312 is removed from the groove 256.

The nozzle 1 may further include a support body 320 for lifting the second coupling unit 254 of the water tank 200 in a state where the hook 312 is withdrawn from the groove 256. The operation of the support body 320 to raise the second coupling unit 254 will be described later with reference to the drawings.

In the present embodiment, the operating unit 300 may be positioned directly above the second flow path 114, for example. For example, the operating unit 300 may be disposed to overlap the centerline A2 of the second flow path 114 in the vertical direction.

Accordingly, since the operating unit 300 is positioned at the central portion of the nozzle 1, there is an advantage that the user can easily recognize the operating unit 300 and operate the operating unit 300.

Meanwhile, the nozzle main body 10 may further include an adjusting unit 180 for adjusting the amount of water discharged from the water tank 200. For example, the adjusting unit 180 may be positioned on the rear side of the nozzle housing 100.

The adjusting unit 180 can be operated by a user and the adjusting unit 180 can prevent the water from being discharged from the water tank 200 or the water from being discharged.

Alternatively, the amount of water discharged from the water tank 200 can be adjusted by the adjusting unit 180. For example, when the adjusting unit 180 is operated, water is discharged from the water tank 200 by a first amount per unit time, or water is discharged by a second amount greater than the first amount per unit time.

The adjusting unit 180 may be pivotally mounted to the nozzle housing 100 in a lateral direction or may be pivoted in a vertical direction.

For example, in a state where the adjusting unit 180 is in the neutral position as shown in FIG. 4, the amount of water discharged is 0, and when the left side of the adjusting unit 180 is pushed to pivot the adjusting unit 180 to the left, water may be discharged from the water tank 200 by a first amount per unit time.

When the adjustment unit 180 is pushed to the right by pushing the right side of the adjustment unit 180, the second amount of water may be discharged from the water tank 200 per unit time. The configuration for detecting the operation of the adjusting unit 180 will be described later with reference to the drawings.

Figure 6:
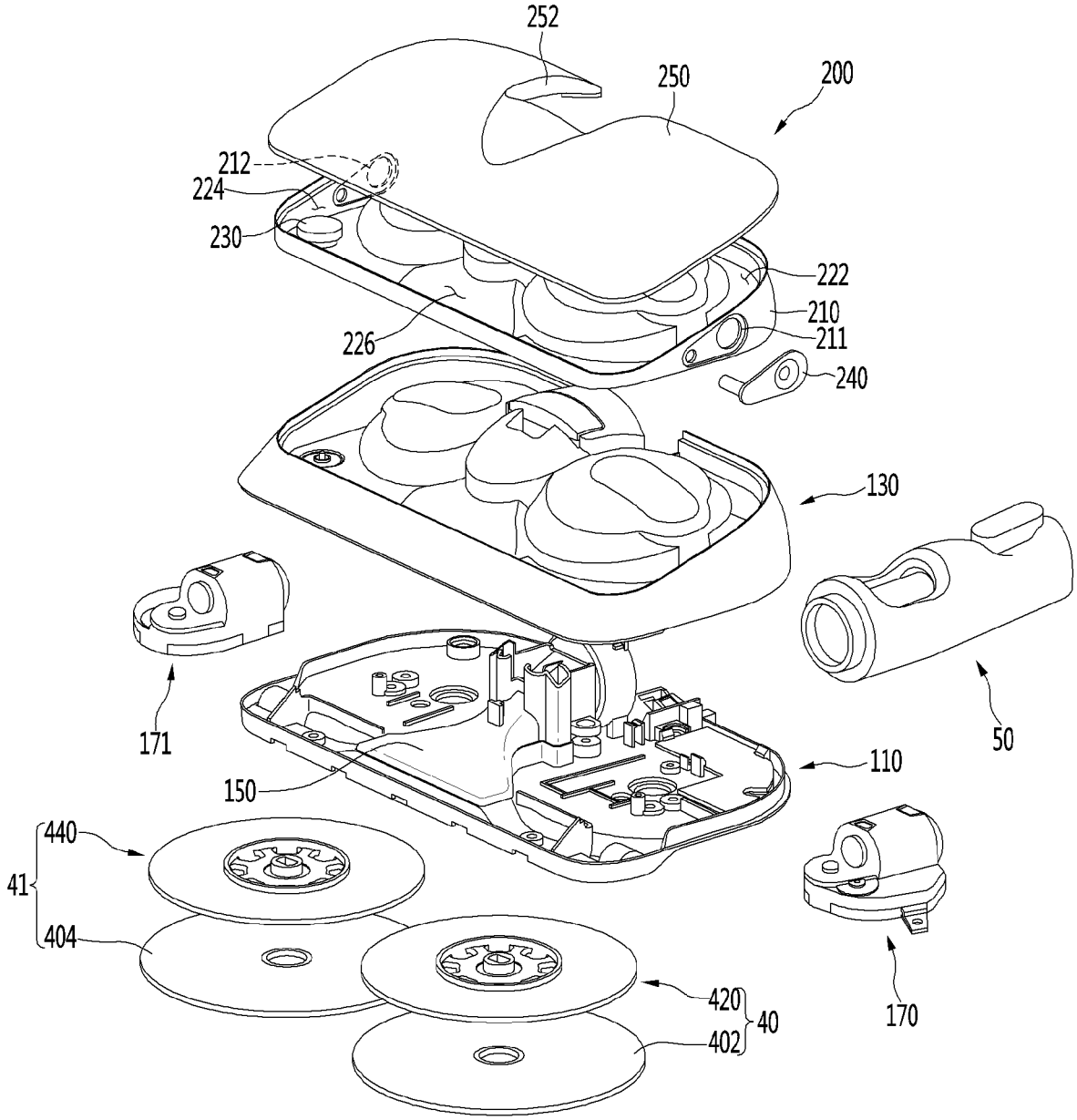
FIG. 6 is an exploded perspective view illustrating a nozzle according to an embodiment of the present invention.
Figure 7:
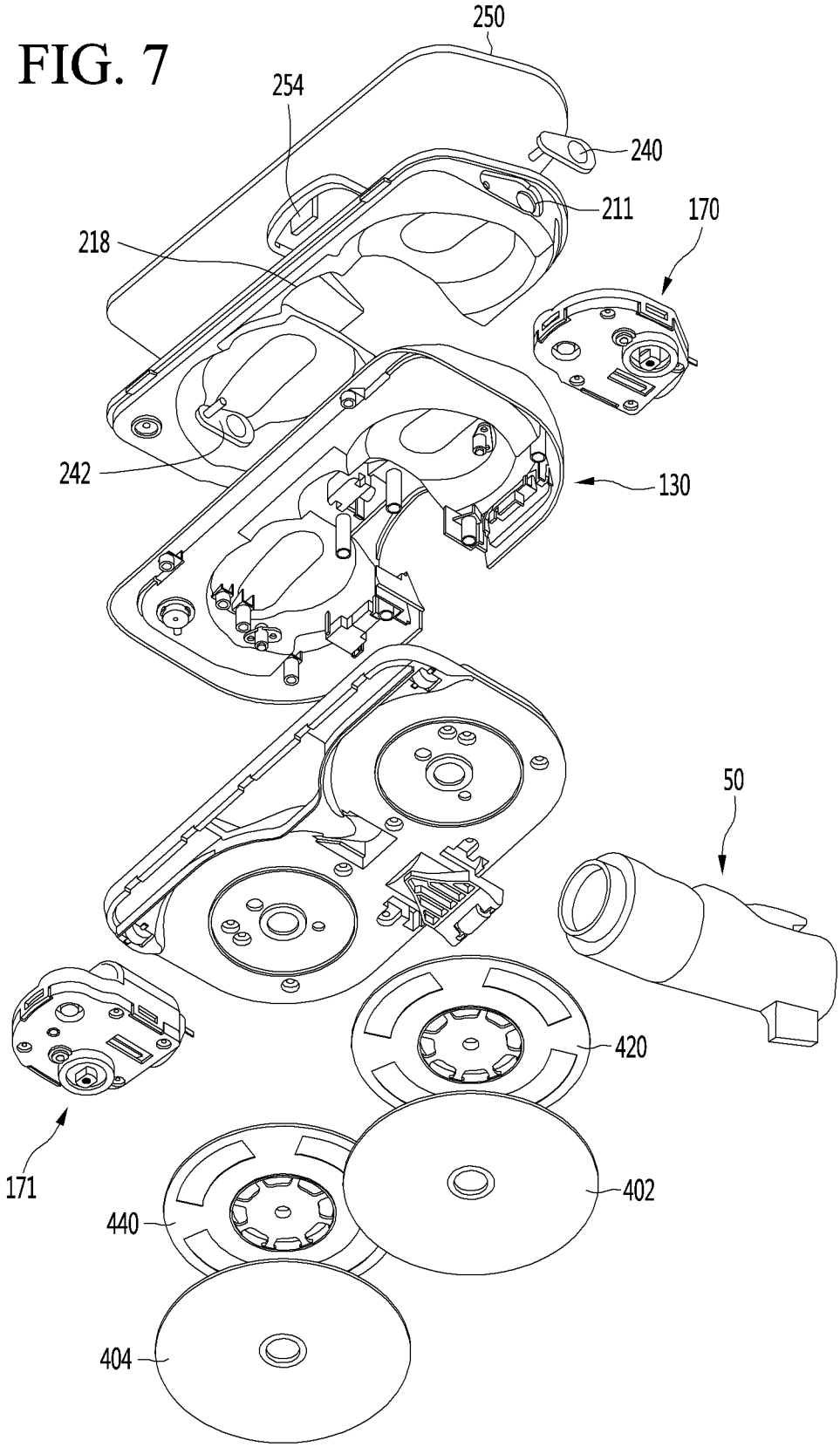
FIG. 7 is another exploded perspective view illustrating a nozzle according to an embodiment of the present invention.
Figure 8:
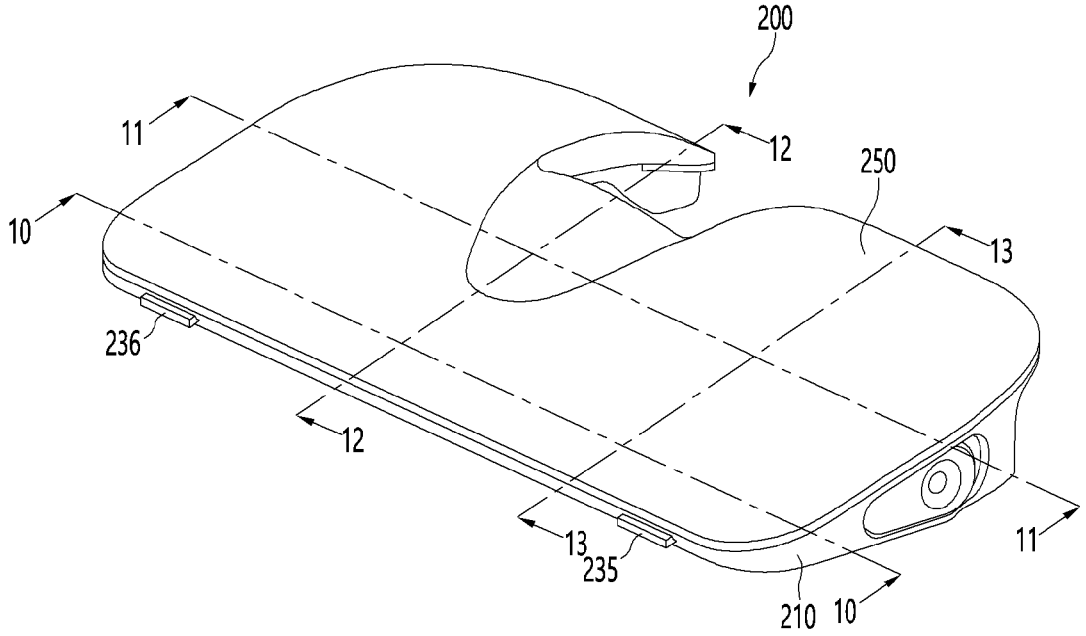
FIG. 8 is a perspective view illustrating a water tank according to an embodiment of the present invention.
Figure 9:
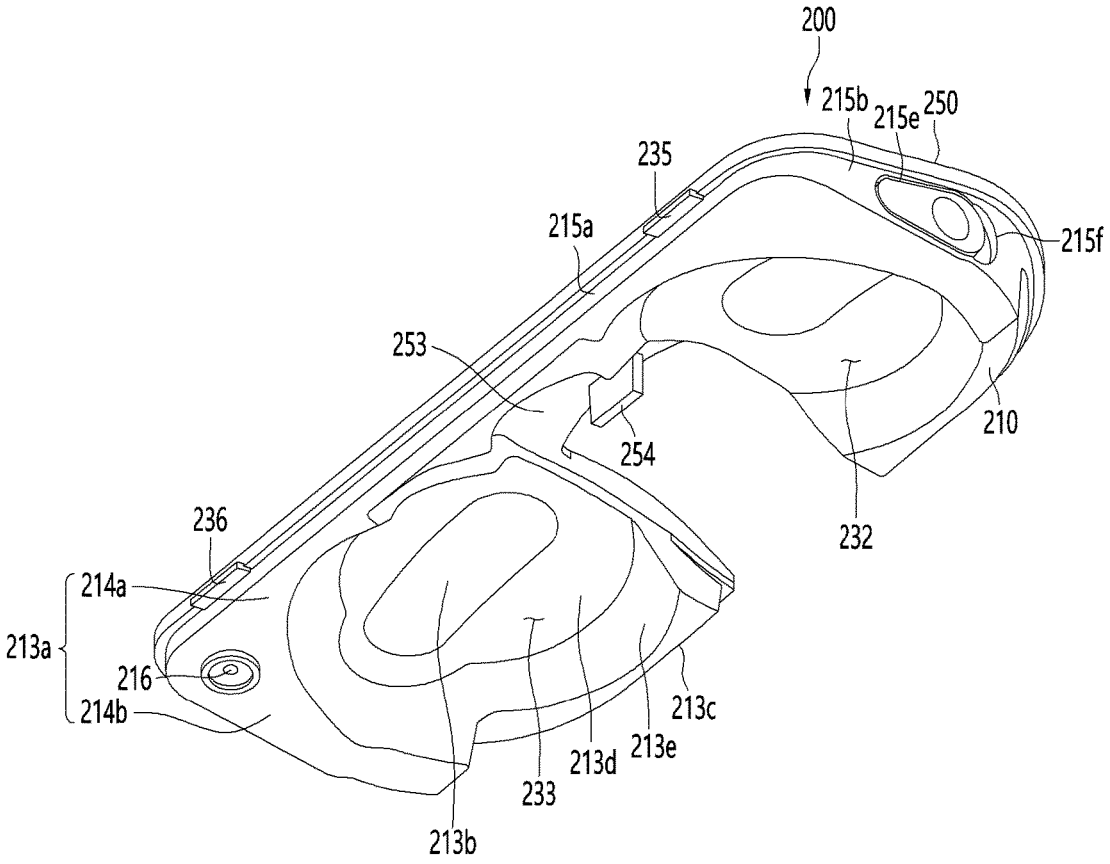
FIG. 9 is another perspective view illustrating a water tank according to an embodiment of the present invention.

FIG. 6 and FIG. 7 are exploded perspective views of a nozzle according to an embodiment of the present invention, and FIG. 8 and FIG. 9 are perspective views of a water tank according to an embodiment of the present invention.

Referring to FIG. 3 and FIG. 6 to FIG. 9, the nozzle main body 10 may further include a plurality of driving devices 170 and 171 for individually driving the respective rotation cleaning units 40 and 41.

The plurality of driving devices 170 and 171 may include a first driving device 170 for driving the first rotation cleaning unit 40 and a second driving device 171 for driving the second rotation cleaning unit 41.

Since each of the driving devices 170 and 171 operates individually, even if some of the driving devices 170 and 171 fail, there is an advantage that some of the rotation cleaning devices can be rotated by another driving device.

The first driving device 170 and the second driving device 171 may be spaced apart from each other in the lateral direction in the nozzle main body 10.

The driving devices 170 and 171 may be positioned behind the first flow path 112.

For example, at least a portion of the second flow path 114 may be positioned between the first driving device 170 and the second driving device 171. At this time, the first driving device 170 and the second driving device 171 may be disposed symmetrically with respect to the centerline A2 of the second flow path 114.

Therefore, even if the plurality of driving devices 170 and 171 are provided, the second flow path 114 is not affected, and thus the length of the second flow path 114 can be minimized.

According to the present embodiment, since the first driving device 170 and the second driving device 171 are disposed on both sides of the second flow pathway 114, the weight of the nozzle 1 can be uniformly distributed to the left and right so that it is possible to prevent the center of gravity of the nozzle 1 from being biased toward any one side of the nozzle 1.

The plurality of driving devices 170 and 171 may be disposed in the nozzle main body 10. For example, the plurality of driving devices 170 and 171 may be seated on the upper side of the nozzle base 110 and covered with the nozzle cover 130. In other words, the plurality of driving devices 170 and 171 may be positioned between the nozzle base 110 and the nozzle cover 130.

Each of the rotation cleaning units 40 and 41 may further include rotation plates 420 and 440 which are rotated by receiving power from each of the driving devices 170 and 171.

The rotation plates 420 and 440 may include a first rotation plate 420 which is connected to the first driving device 170 and to which the first mop 402 is attached and a second rotation plate 420 which is connected to the second driving device 171 and a second rotation plate 440 to which the second mop 404 is attached.

The rotation plates 420 and 440 may be formed in a disc shape, and the mops 402 and 404 may be attached to the bottom surface of the rotation plates 420 and 440.

The rotation plates 420 and 440 may be connected to each of the driving devices 170 and 171 on the lower side of the nozzle base 110. In other words, the rotation plates 420 and 440 may be connected to the driving devices 170 and 171 at the outside of the nozzle housing 100.

<Water Tank>

Figure 10:
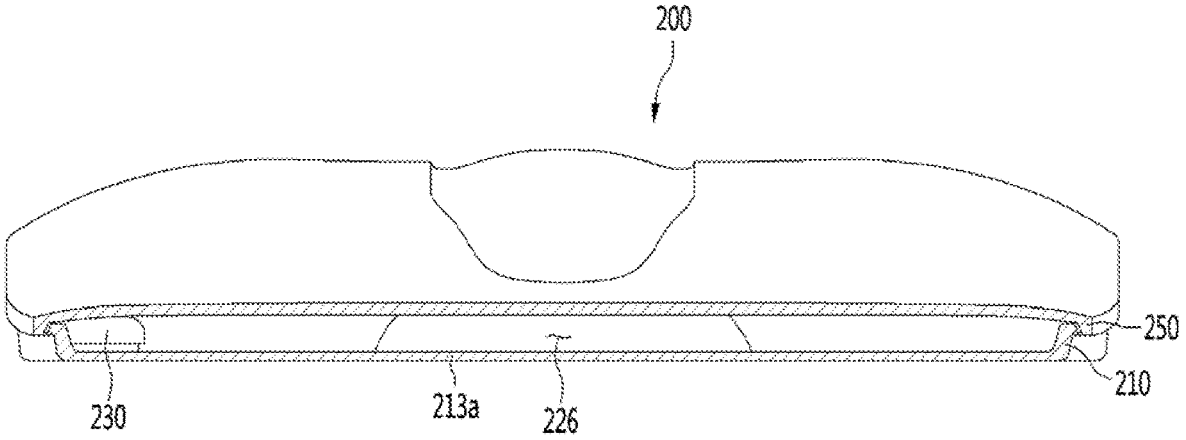
FIG. 10 is a sectional view taken along line 10-10 in FIG. 8.
Figure 11:
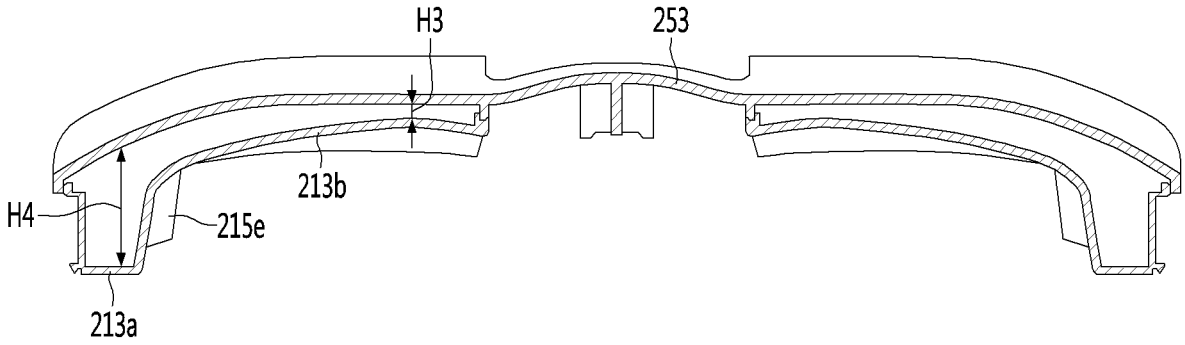
FIG. 11 is a sectional view taken along the line 11-11 of FIG. 8.
Figure 12:
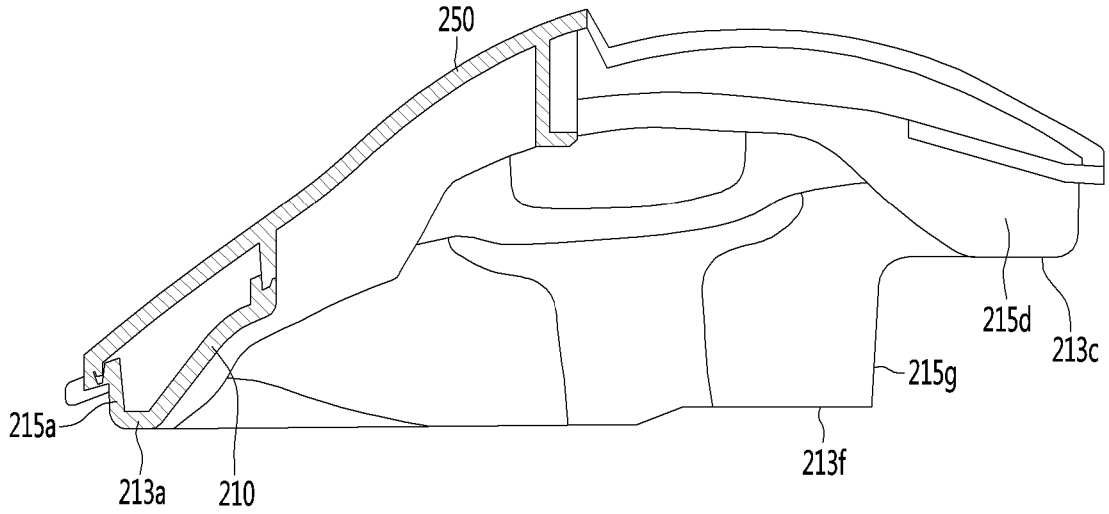
FIG. 12 is a sectional view taken along line 12-12 in FIG. 8.
Figure 13:
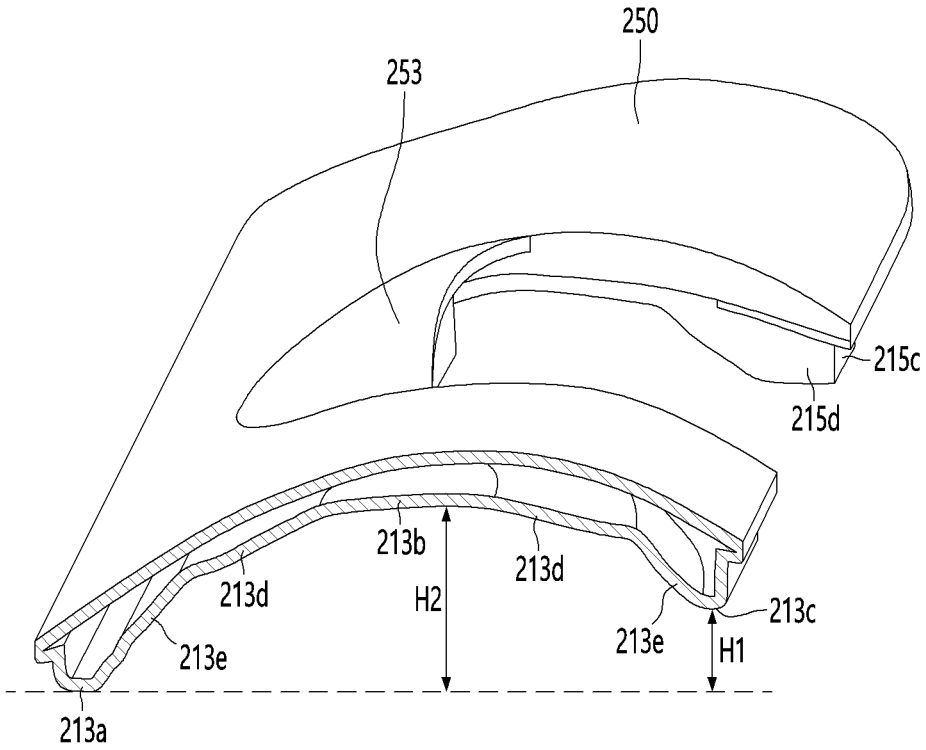
FIG. 13 is a sectional view taken along line 13-13 of FIG. 8.

FIG. 10 is a sectional view taken along line 10-10 in FIG. 8, FIG. 11 is a sectional view taken along the line 11-11 of FIG. 8, FIG. 12 is a sectional view taken along line 12-12 in FIG. 8, and FIG. 13 is a sectional view taken along line 13-13 of FIG. 8.

Referring to FIG. 8 to FIG. 13, the water tank 200 may be mounted on the upper side of the nozzle housing 100. For example, the water tank 200 may be seated on the nozzle cover 130. The upper side wall of the water tank 200 can form a portion of an outer appearance of the upper surface of the nozzle main body 10 in a state where the water tank 200 is seated on the upper side of the nozzle cover 130. For example, the water tank 200 may protrude upward from the nozzle cover 130.

The water tank 200 may include a first body 210, and a second body 250 coupled to the first body 210 and defining a chamber in which water is stored together with the first body 210. The second body 250 may be coupled to the upper side of the first body 210.

The second body 250 may substantially protrude upward from the nozzle cover 130 to form an outer appearance of an upper surface of the nozzle 1. Though not limited thereto, the entire upper surface wall of the second body 250 may form an outer appearance of the upper surface of the nozzle 1.

The chamber may include a first chamber 222 positioned above the first driving device 170, a second chamber 224 positioned above the second driving device 171, and a connection chamber 226 communicating the first chamber 222 with the second chamber 224.

The first body 210 may define a bottom wall and a side wall of the chamber, and the second body 250 may define an upper wall of the chamber. Of course, a portion of the second body 250 may also define an upper wall of the chamber.

In the present embodiment, the volume of the connection chamber 226 may be formed to be smaller than the volumes of the first chamber 222 and the second chamber 224 so that the amount of water to be stored is increased while minimizing the height of the nozzle 1 by the water tank 200.

The water tank 200 may be formed so that the front height is low and the rear height is high. The upper surface of the water tank 200 may be inclined upward or rounded from the front side to the back side.

For example, the connection chamber 226 may connect the first chamber 222 and the second chamber 224 disposed on both sides in the front portion of the water tank 200. In other words, the connection chamber 226 may be positioned in the front portion of the water tank 200.

The water tank 200 may include a first bottom wall 213*a*. For example, the first body 210 may include the first bottom wall 213*a*.

The first bottom wall 213*a* is a wall which is positioned at the lowest position in the water tank 200.

The first bottom wall 213*a* is a horizontal wall and can be seated on the bottom wall 131*a* of the nozzle cover 130 described later.

The first bottom wall 213*a* may be a bottom wall positioned at the foremost end portion of the water tank 200.

The first bottom wall 213*a* may include a first wall portion 214*a* extending to be long in the left and right direction and a pair of second wall portions 214*b* extending in the front and rear direction at both ends of the first wall portion 214*a*. The left and right lengths of the first wall portion 214*a* may be substantially the same as the left and right lengths of the first body 210.

The width of each of the second wall portions 214*b* in the lateral direction is formed to be larger than the width of the first wall portion 214*a* in the front and rear direction.

At this time, the lateral width of the second wall portion 214*b* is the largest in the portion adjacent to the first wall portion 214*a* and may be reduced in the portion far away from the first wall portion 214*a*.

A discharge port 216 for discharging water from the water tank 200 may be formed in any one of the pair of the second wall portions 214*b*.

Alternatively, the discharge port 216 may be formed at a boundary between one of the pair of second wall portions 214*b* and the first wall portion 214*a*.

The discharge port 216 may be opened or closed by a valve 230. The valve 230 may be disposed in the water tank 200. The valve 230 can be operated by an external force, and the valve 230 keeps the discharge port 216 closed unless an external force is applied thereto.

Therefore, water can be prevented from being discharged from the water tank 200 through the discharge port 216 in a state where the water tank 200 is separated from the nozzle main body 10.

In this embodiment, the water tank 200 may include a single discharge port 216. The reason why the water tank 200 is provided with the single discharge port 216 is to reduce the number of components that can cause water leakage.

In other words, in the nozzle 1, there is a component (control board, driving motor, or the like) that operates upon receiving power, and such a component must be completely cut off from contact with water. So as to block the contact between the component and the water, leakage in the portion through which water is discharged from the water tank 200 is basically minimized.

As the number of the discharge ports 216 in the water tank 200 is increased since a structure for preventing water leakage is additionally required, the structure is complicated, and even if there is a structure for preventing water leakage, there is a possibility that water leakage cannot be completely prevented.

Also, as the number of the discharge ports 216 in the water tank 200 is increased, the number of the valves 230 for opening and closing the discharge port 216 is also increased. This means that not only the number of components is increased but also the volume of the chamber for water storage in the water tank 200 is reduced by the valve 230.

Since the height of the rear side of the water tank 200 is higher than that of the front side of the water tank 200, so as to smoothly discharge water in the water tank 200, the discharge port 216 is formed on the first bottom wall 213*a* which is positioned at the lowest position of the first body 210.

The first body 210 may further include a second bottom wall 213*b* positioned at a different height from the first bottom wall 213*a*.

The second bottom wall 213*b* is a wall positioned behind the first bottom wall 213*a* and positioned higher than the first bottom wall 213*a*. In other words, the first bottom wall 213*a* and the second bottom wall 213*b* have a height difference of H2.

The second bottom wall 213*b* may be a horizontal wall or a curved wall that is rounded upward.

The second bottom wall 213*b* may be positioned directly above the driving devices 170 and 171. The second bottom wall 213*b* is positioned higher than the first bottom wall 213*a* so that the second bottom wall 213*b* does not interfere with the driving devices 170 and 171.

In addition, since the second bottom wall 213*b* is positioned higher than the first bottom wall 213*a* and there is a water level difference between the second bottom wall 213*b* and the first bottom wall 213*a*, the water on a side of the second bottom wall 213*b* can smoothly flow toward a side of the first bottom wall 213*a*.

In this embodiment, a portion or all of the second bottom wall 213*b* has the highest height among the bottom walls.

The second bottom wall 213*b* may be formed to have a larger left and right width than a front and rear width.

The first body 210 may further include a third bottom wall 213*c* positioned at a different height from the first bottom wall 213*a* and the second bottom wall 213*b*.

The third bottom wall 213*c* is positioned higher than the first bottom wall 213*a* and is positioned lower than the second bottom wall 213*b*.

Therefore, the heights of the third bottom wall 213*c* and the first bottom wall 213*a* are different by H1 smaller than H2.

The third bottom wall 213*c* may be positioned behind the second bottom wall 213*b*.

A portion of the third bottom wall 213*c* is positioned at the rearmost end of the first body 210.

In this embodiment, as the third bottom wall 213*c* is positioned lower than the second bottom wall 213*b*, the water storage capacity in the water tank 200 can be increased without interference with the surrounding structure.

The first body 210 may further include a fourth bottom wall 213*d* extending downward from an edge of the second bottom wall 213*b* so as to be inclined. The fourth bottom wall 213*d* may surround the second bottom wall 213*b*.

The fourth bottom wall 213*d* may, for example, extend downwardly while being rounded.

The first body 210 may further include a fifth bottom wall 213*e* which extends so as to be inclined downwardly from the periphery of the fourth bottom wall 213*d*.

In other words, the height decreases from the second bottom wall 213*b* toward the fourth bottom wall 213*d* and the fifth bottom wall 213*e*.

The fifth bottom wall 213*e* may connect the fourth bottom wall 213*d* and the third bottom wall 213*c*.

In addition, the fifth bottom wall 213*e* may connect the fourth bottom wall 213*d* and the first bottom wall 213*a*.

A portion of the bottom walls of the first body 210 can form receiving spaces 232 and 233 having a recessed shape by the second bottom wall 213*b*, the fourth bottom wall 213*d*, and the fifth bottom wall 213*e*. The driving devices 170 and 171 may be positioned in the receiving spaces 232 and 233.

Accordingly, a portion of the bottom wall of the first body 210 may surround the periphery of each of the driving devices 170 and 171.

The first body 210 may further include a sixth bottom wall 213*f* which is positioned on the rear side of each of the second wall portions 214*b* and positioned higher than each of the second wall portions 214*b*. The sixth bottom wall 213*f* may be positioned lower than the third bottom wall 213*c*.

The third bottom wall 213*c* may be connected to the sixth bottom wall 213*f* by a connection wall 215*g*.

Therefore, even if the third bottom wall 213*c* is positioned on the rear side of the second bottom wall 213*b* while being lower than the second bottom wall 213*b*, the water on the second bottom wall 213*b* can flow to the sixth bottom wall 213*f* by the connection wall 215*g*. The water of the sixth bottom wall 213*f* can flow to the first bottom wall 213*a*.

The first wall portion 214*a* of the first bottom wall 213*a* and the second body 250 may define a connection flow path 226.

Since the first bottom wall 213*a* positioned at the lowest position forms the connection flow path 226 as described above, water in the first chamber 222 and the second chamber 224 can uniformly flow to the discharge port 216.

The first body 210 may further include a first sidewall 215*a* extending upward from the first wall portion 214*a* of the first bottom wall 213*a*. The first side wall 215*a* may be the front wall of the first body 210.

The first side wall 215*a* may extend vertically upward from the front end of the first wall portion 214*a*.

The first body 210 may further include a second side wall 215*b* extending upward from the second wall portions 214*b* of the first bottom wall 213*a*.

In other words, the pair of second sidewalls 215*b* extends rearward from both sides of the first sidewall 215*a*, and the height of the second sidewall 215*b* increases as the distance from the first sidewall 215*a* increases.

The pair of second side walls 215*b* may include a left side wall and a right side wall. At this time, the left side wall may form the first chamber 222, and the right side wall may form the second chamber 224.

An inlet for introducing water into one or more of the pair of second sidewalls 215*b* may be formed.

FIG. 6 illustrates a state where an inlet is formed in each of the pair of second sidewalls 215*b*.

For example, the left side wall may have a first inlet 211 for introducing water into the first chamber 222 and the right side wall may have a second inlet 212 for introducing water into the second chamber 224.

At this time, each of the second sidewalls 215*b* may include a recessed portion 215*e* recessed inward, and the recessed portions 215*e* may be provided with each of the inlets 211 and 212.

The first inlet 211 may be covered by a first inlet cover 240 and the second inlet 212 may be covered by a second inlet cover 242.

For example, each of the inlet covers 240 and 242 may be formed of a rubber material.

The inlet covers 240 and 242 can cover the inlets 211 and 212 in a state of being received in the recessed portions 215*e*. At this time, the sizes of the inlet covers 240, 242 are formed to be smaller than the size of the recessed portions 215*e*.

Therefore, a portion of the recessed portions 215*e* is covered by the inlet covers 240, 242, the other portion thereof is not covered by the inlet covers 240, 242, and thus a space 215*f* in which a user's finger can be inserted can be formed.

Accordingly, after inserting the finger into the space 215*f*, the inlet covers 240, 242 may be pulled so that the inlet covers 240, 242 open the inlets 211, 212.

According to the present embodiment, the water tank 200 is provided with each of the inlets 211 and 212 on both sides of the water tank 200, so that it is possible to easily introduce water into the water tank 200 by opening any one of the two inlets.

The inlet covers 240, 242 may be positioned between the space 215*f* and the first sidewall 215*a* such that the size of the space 215*f* is secured.

The first body 210 may further include a third side wall 215*c* extending upward from a rear end of the third bottom wall 213*c*.

In addition, the first body 210 may further include a front and rear extending wall 215*d* which extends forward from an end portion of the third side wall 215*c* and is connected to a third bottom wall 213*c*, a fourth bottom wall 213*d*, and a fifth bottom wall 213*e*.

In the first body 210, the pair of front and rear extending walls 215*d* is disposed and spaced apart from each other in the lateral direction.

The pair of front and rear extending walls 215*d* is disposed to face each other. When the water tank 200 is seated on the nozzle housing 100, the connection tube 50 can be positioned between the pair of front and rear extending walls 215*d*.

The pair of front and rear extending walls 215*d* is positioned higher than the first bottom wall 213*a*.

In this embodiment, the chamber is formed by the first body 210 and the second body 250, and the second bottom wall 213*b* and the second body 250 are separated from each other to receive water, and the second bottom wall 213*b* and the second body 250 have the difference in height of H3.

The first bottom wall 213*a* and the second body 250 have the difference in height of H4. At this time, H4 is larger than H3. According to this structure, there is an advantage that the water storage capacity can be increased while reducing the height (or total thickness) of the water tank 200.

The first body 210 may include a first slot 218 for preventing interference with the operating unit 300 and the coupling units 310 and 254. The first slot 218 may be formed such that the center rear end portion of the first body 210 is recessed forward. At this time, the pair of front and rear extending walls 215*d* may form a portion of the first slot 218.

In addition, the second body 250 may include a second slot 252 for preventing interference with the operating unit 300. The second slot 252 may be formed such that the center rear end portion of the second body 230 is depressed forward.

The second body 250 may further include a slot cover 253 covering a portion of the first slot 218 of the first body 210 in a state of being coupled to the first body 210. In other words, the front and rear length of the second slot 252 is shorter than the front and rear length of the first slot 218.

The second coupling unit 254 may extend downward from the slot cover 253. Accordingly, the second coupling unit 254 may be positioned within the space formed by the first slot 218.

Accordingly, when the overall shape of the water tank 200 is viewed, the length of the water tank 200 in the lateral direction is longer than that of the water tank 200 in the front and rear direction. The front and rear lengths of the central portion of the water tank 200 where the slots 218 and 252 are positioned are shorter than the front and rear lengths of both sides.

The water tank 200 has a symmetrical shape with respect to the slots 218 and 252.

The water tank 200 may further include coupling ribs 235 and 236 for coupling with the nozzle cover 130 before the second coupling unit 254 of the water tank 200 is coupled with the first coupling unit 310.

The coupling ribs 235 and 236 also perform a role which guides the coupling position of the water tank 200 in the nozzle cover 130 before the second coupling unit 254 of the water tank 200 is coupled with the first coupling unit 310. For example, a plurality of coupling ribs 235 and 236 protrude from the first body 110 and may be disposed so as to be spaced apart in the left and right horizontal direction.

Though not limited, the plurality of coupling ribs 235 and 236 may protrude forward from the first sidewall 215*a* of the first body 210 and may be spaced apart from each other in the lateral direction.

Each of the driving devices 170 and 171 is provided in the nozzle main body 10 so that a portion of the nozzle main body 10 protrudes upward at both sides of the second flow path 114 by each of the driving devices 170 and 171.

According to the present embodiment, the portion protruding from the nozzle body 10 is positioned in the pair of receiving spaces 232 and 233 of the water tank 200. The pair of receiving spaces 232 and 233 may be divided into right and left by the first slot 218.

<Nozzle Cover>

Figure 14:
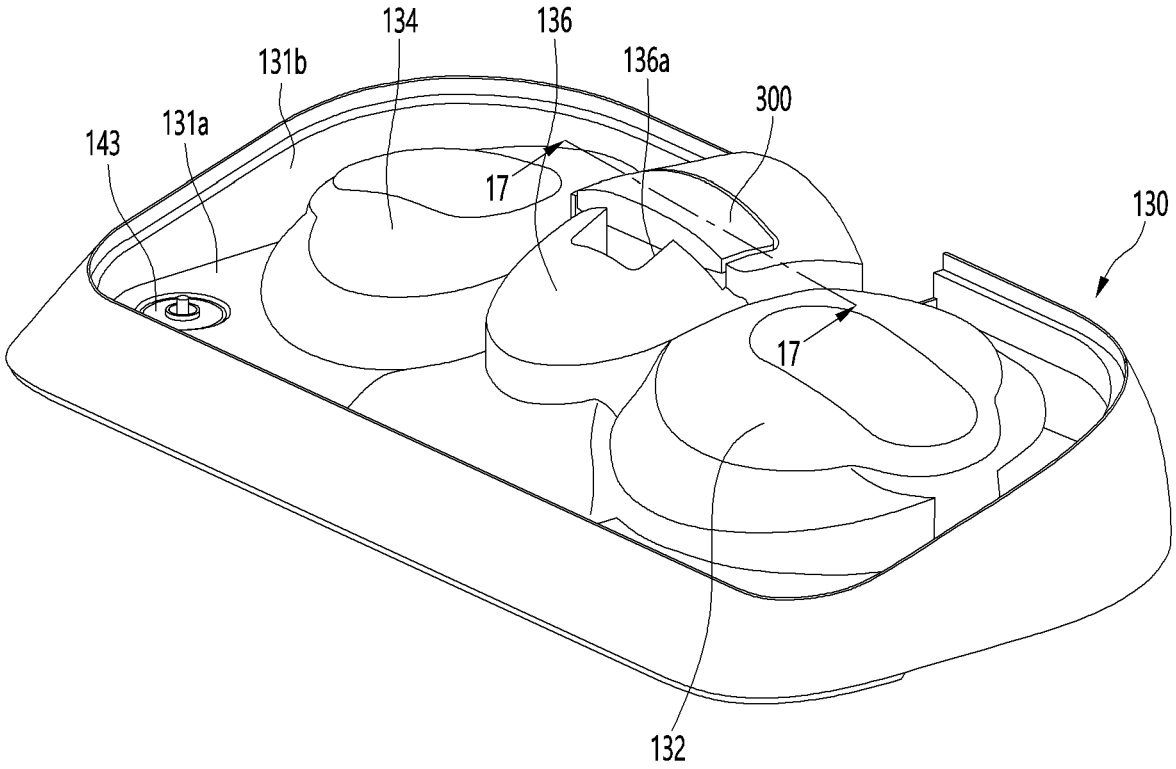
FIG. 14 is a perspective view illustrating a nozzle cover according to an embodiment of the present invention as viewed from above.
Figure 15:
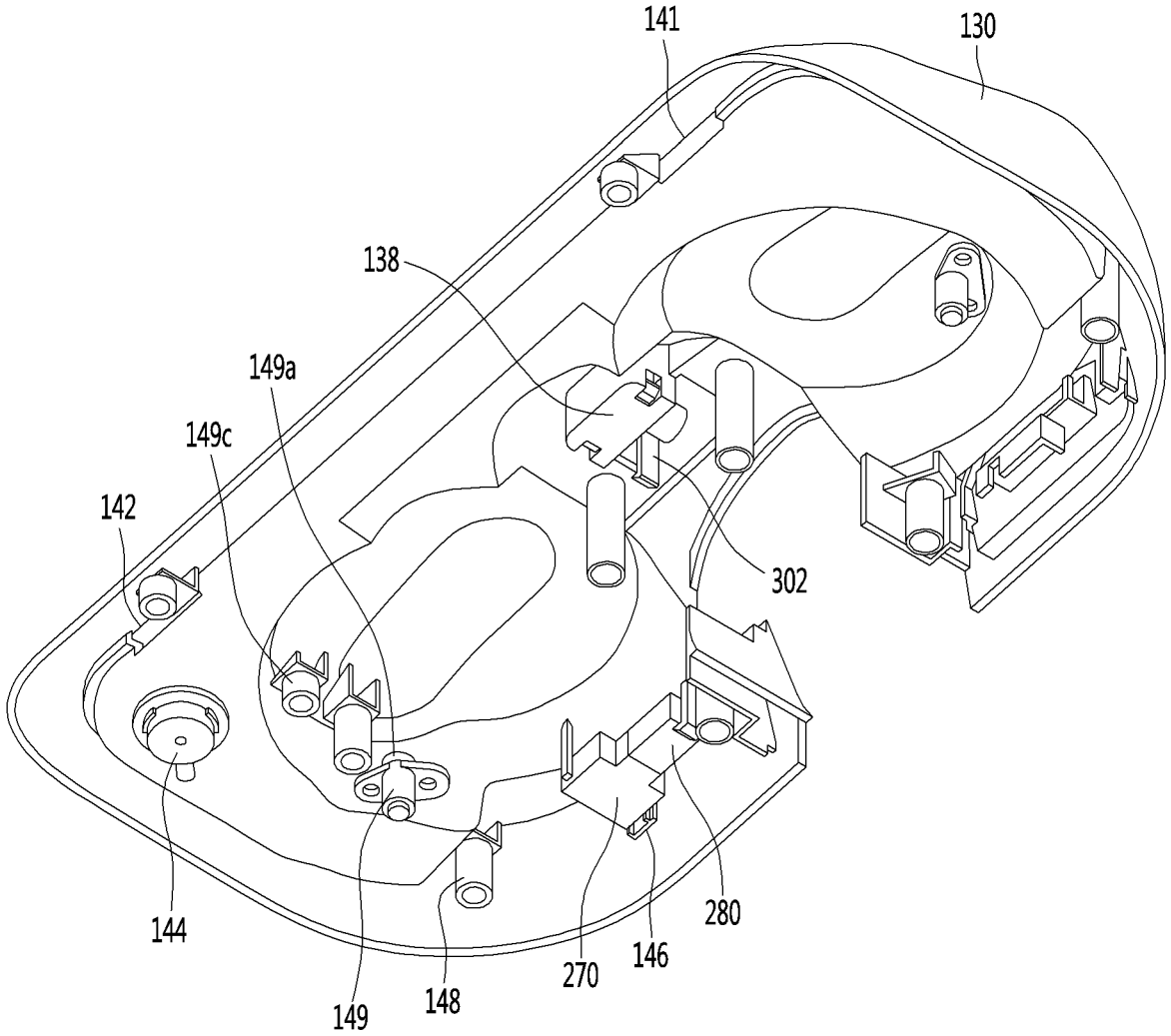
FIG. 15 is a perspective view illustrating a nozzle cover according to an embodiment of the present invention as viewed from below.

FIG. 14 is a perspective view illustrating a nozzle cover according to an embodiment of the present invention as viewed from above, and FIG. 15 is a perspective view illustrating a nozzle cover according to an embodiment of the present invention as viewed from below.

Referring to FIG. 6, FIG. 14, and FIG. 15, the nozzle cover 130 may include a bottom wall 131*a* and a peripheral wall 131*b* extending upward at the edge of the bottom wall 131*a*.

The nozzle cover 130 may include driving unit covers 132 and 134 that cover the upper side of each of the driving units 170 and 171.

Each of the driving unit covers 132 and 134 is a portion which protrudes upward from the bottom wall 131*a* of the nozzle cover 130. The driving unit covers 132 and 134 may be separated from the peripheral wall 131*b*. Therefore, a space may be formed between the driving unit covers 132 and 134 and the peripheral wall 131*b*, and the water tank 200 may be positioned in the space.

Accordingly, the increase in the height of the nozzle 1 by the water tank 200 can be prevented in a state where the water tank 200 is seated on the nozzle cover 130 while the storage capacity of the water tank 200 can be increased.

Each of the driving unit covers 132 and 134 is a portion which protrudes upward from the nozzle cover 130. Each of the driving unit covers 132 and 134 can surround the upper side of the driving devices 170 and 171 without interfering with each of the driving devices 170 and 171 installed in the nozzle base 110. In other words, the driving unit covers 132 and 134 are spaced apart from each other in the lateral direction in the nozzle cover 130.

When the water tank 200 is seated on the nozzle cover 130, each of the driving unit cover 132 and 134 is received in each of the receiving spaces 232 and 233 of the water tank 200, and thus interference between the components is prevented.

In addition, in the water tank 200, the first chamber 222 and the second chamber 224 may be disposed so as to surround the periphery of each of the respective driving unit covers 132 and 134.

Thus, according to the present embodiment, the volumes of the first chamber 222 and the second chamber 224 can be increased.

The first body 210 of the water tank 200 may be seated at a lower portion of the nozzle cover 130 than the driving unit covers 132 and 134.

At least a portion of the bottom wall of the water tank 200 may be positioned lower than the axis of the driving motor (see A3 and A4 in FIG. 21) so that the height increase by the water tank 200 is minimized, as will be described later.

For example, the first bottom wall 213*a* of the water tank 200 may be positioned lower than the axis of the driving motor (A3 and A4), which will be described later.

The nozzle cover 130 may further include a flow path cover 136 covering the flow path forming portion 150. The flow path cover 136 may be positioned between the driving unit covers 132 and 134 and may be disposed at a position corresponding to the first slot 218 of the water tank 200.

The nozzle cover 136 may also protrude upward from the bottom wall 131*a* of the nozzle cover 130.

In the present embodiment, so as to increase the water storage capacity of the water tank 200, a portion of the water tank 200 may be positioned on both sides of the flow path cover 136. Therefore, the water storage capacity of the water tank 200 can be increased while preventing the water tank 200 from interfering with the second flow path 114.

In addition, so as to prevent the water tank 200 from colliding with structures around the nozzle 1 during the movement of the nozzle 1, the entire water tank 200 can be disposed to overlap with the nozzle housing 100 in the vertical direction. In other words, the water tank 200 may not protrude in the lateral and the front and rear directions of the nozzle housing 100.

The first bottom wall 213*a* of the water tank 200 may be seated on the bottom wall 131*a* of the nozzle cover 130. In this state, the slot cover 253 of the water tank 200 may be positioned directly above the flow path cover 136. The slot cover 253 may be in contact with the flow path cover 136 or may be spaced apart from the flow path cover 136.

When the water tank 200 is mounted on the nozzle cover 130, the slot cover 253 is positioned in front of the operating unit 300.

When the water tank 200 is seated on the nozzle cover 130, the first body 210 may be surrounded by the peripheral wall 132*b* of the nozzle cover 130. Accordingly, when the water tank 200 is seated on the nozzle cover 130, the inlet cover on both sides of the water tank 200 is covered by the peripheral wall 132*b* of the nozzle cover 130 and is not exposed to the outside.

The nozzle cover 130 may further include rib insertion holes 141 and 142 into which the coupling ribs 235 and 236 provided in the water tank 200 are inserted. The rib insertion holes 141 and 142 may be spaced apart from the nozzle cover 130 in the lateral horizontal direction.

Accordingly, the center or rear portion of the water tank 200 is moved downward in a state where the coupling ribs 235 and 236 are inserted into the rib insertion holes 141 and 142, and thus the second coupling unit 254 may be coupled to the first coupling unit 310.

The nozzle cover 130 may be provided with a valve operating unit 144 for operating the valve 230 in the water tank 200. The valve operating unit 144 may be coupled to the nozzle cover 130.

The water discharged from the water tank 200 can flow through the valve operating unit 144.

The valve operating unit 144 may be coupled to the lower side of the nozzle cover 130, and a portion of the valve operating unit 144 may protrude upward through the nozzle cover 130.

The valve operating unit 144 protruding upward is introduced in the water tank 200 through the discharge port 216 of the water tank 200 when the water tank 200 is seated on the nozzle cover 130. In other words, the valve operating unit 144 may be disposed at a position facing the discharge port 216 of the water tank 200.

The valve operating unit 144 will be described later with reference to the drawings.

The nozzle cover 130 may be provided with a sealer 143 for preventing water discharged from the water tank 200 from leaking from the vicinity of the valve operating unit 144. The sealer 143 may be formed of rubber material, for example, and may be coupled to the nozzle cover 130 from above the nozzle cover 130.

The nozzle cover 130 may be provided with a water pump 270 for controlling water discharge from the water tank 200. The water pump 270 may be connected to a pump motor 280.

A pump installation rib 146 for installing the water pump 270 may be provided on the lower side of the nozzle cover 130. The water pump 270 and the pump motor 280 are installed in the nozzle cover 130 so that the pump motor 280 is prevented from contacting the water even if the water drops into the nozzle base 110.

The water pump 270 is a pump that operates so as to communicate the inlet and the outlet by expanding or contracting the valve body therein while being operated, and the pump can be realized by a well-known structure, and thus a detailed description thereof will be omitted.

The valve body in the water pump 270 can be driven by the pump motor 280. Therefore, according to the present embodiment, water in the water tank 200 can be continuously and stably supplied to the rotation cleaning units 40 and 41 while the pump motor 280 is operating.

The operation of the pump motor 280 can be adjusted by operating the above-described adjusting unit 180. For example, the adjusting unit 180 may select the on/off state of the pump motor 280.

Alternatively, the output (or rotational speed) of the pump motor 280 may be adjusted by the adjusting unit 180.

The nozzle cover 130 may further include at least one fastening boss 148 to be coupled with the nozzle base 110.

In addition, the nozzle cover 130 may be provided with a spray nozzle 149 for spraying water to the rotation cleaning units 40 and 41 to be described later. For example, a pair of spray nozzles 149 may be installed on the nozzle cover 130 in a state where the spray nozzles 149 are spaced apart from each other in the lateral direction.

The nozzle cover 130 may be provided with a nozzle installation boss 149*c* for mounting the spray nozzle 149. For example, the spray nozzle 149 may be fastened to the nozzle installation boss 149*c* by a screw.

The spray nozzle 149 may include a connection unit 149*a* for connecting a branch tube, as will be described later.

<Description of Structure and Operation of Operating Unit, First Coupling Unit, and Supporting Body>

Figure 16:
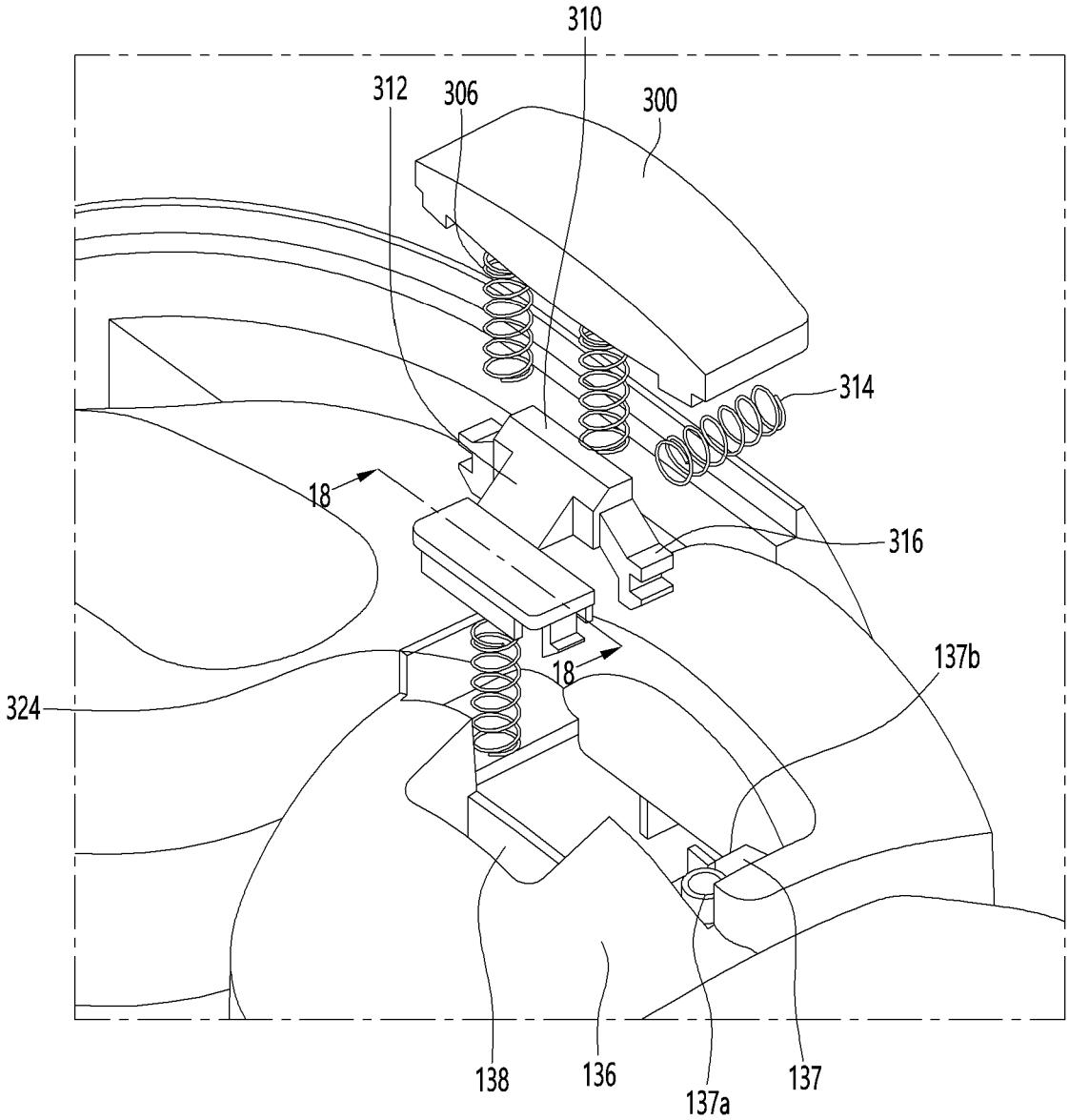
FIG. 16 is a perspective view illustrating a state where the operating unit, the first coupling unit, and the supporting body are separated from each other in the nozzle cover.
Figure 17:
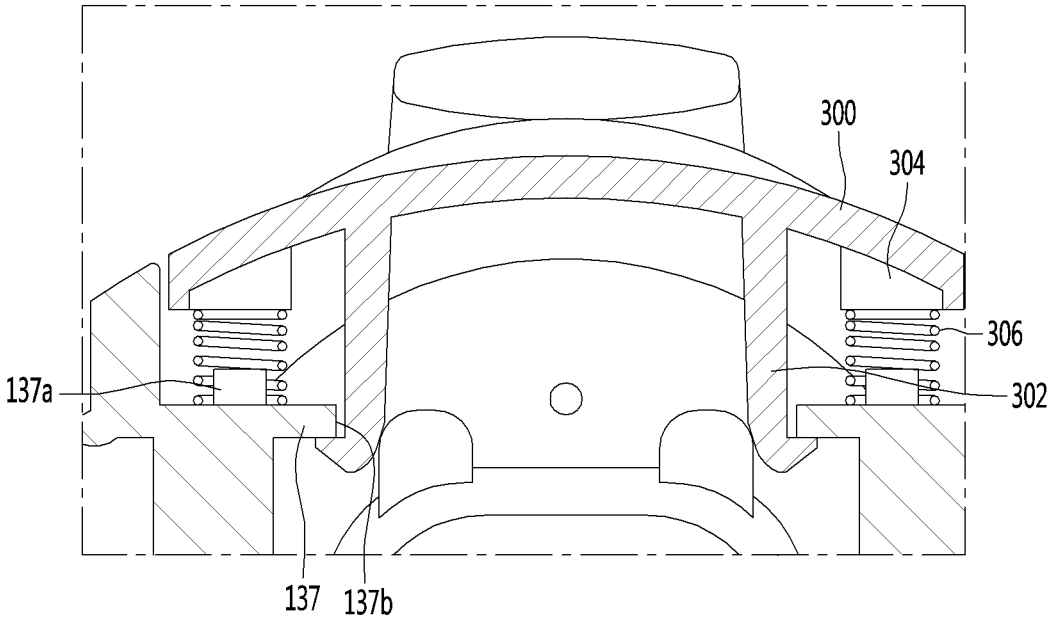
FIG. 17 is a sectional view taken along line 17-17 of FIG. 14.

FIG. 16 is a perspective view illustrating a state where the operating unit, the first coupling unit, and the supporting body are separated from each other in the nozzle cover, and FIG. 17 is a sectional view taken along line 17-17 of FIG. 14.

Figure 18:
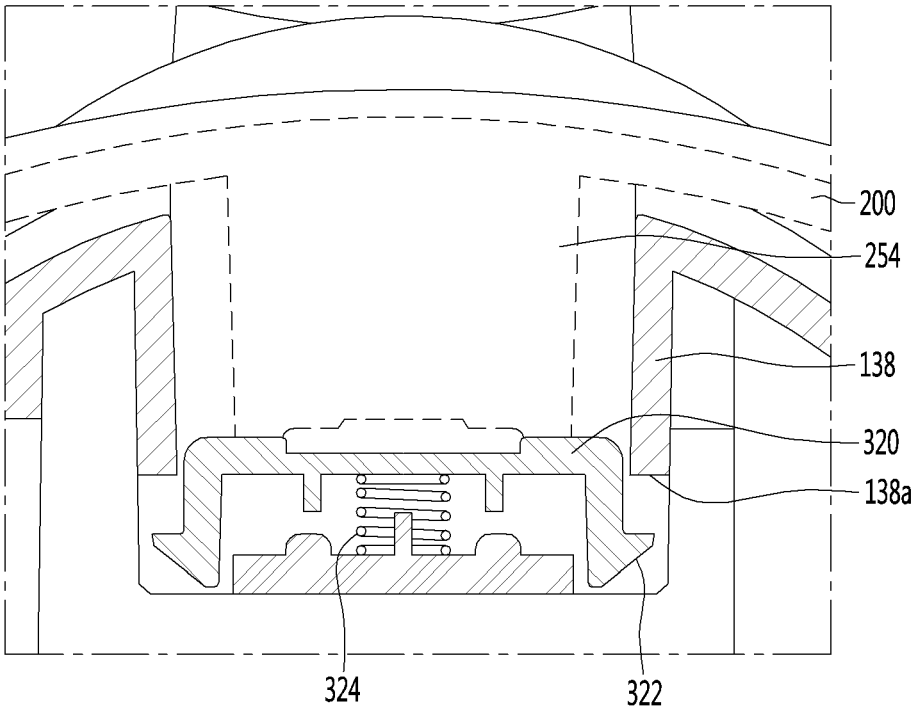
FIG. 18 is a sectional view taken along the line 18-18 in FIG. 16 in a state where the first coupling unit is coupled with the nozzle cover.
Figure 19:
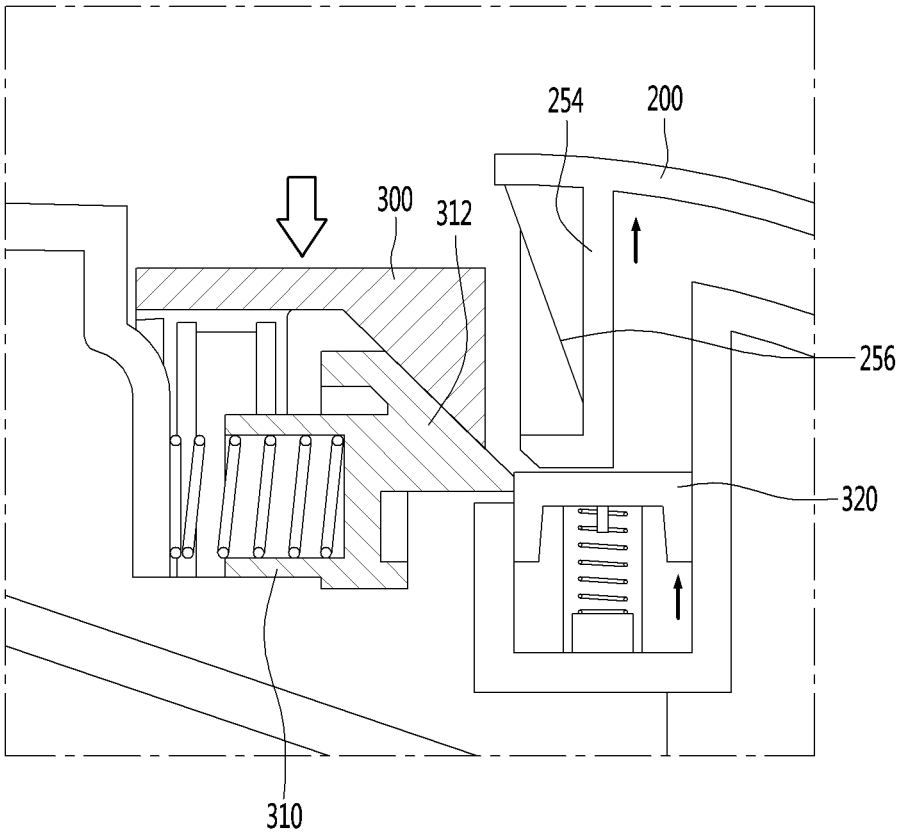
FIG. 19 is a sectional view illustrating a state where the first coupling unit and the second coupling unit are released by pressing the operating unit.

FIG. 18 is a sectional view taken along the line 18-18 in FIG. 17 in a state where the first coupling unit is coupled with the nozzle cover, and FIG. 19 is a sectional view illustrating a state where the first coupling unit and the second coupling unit are released by pressing the operating unit.

Referring to FIG. 16 to FIG. 19, the operating unit 300 may be supported by the flow path cover 136. The flow path cover 136 may include an operating unit receiving portion 137 having a recessed shape for supporting and receiving the operating unit 300.

On both sides of the operating unit 300, a coupling hook 302 for coupling the operating unit 300 to the flow path cover 136 may be provided.

The operating unit 300 can be received in the operating unit receiving portion 137 from above the operating unit receiving portion 137.

The bottom wall of the operating unit receiving portion 137 is provided with a slot 137*b* penetrating in the vertical direction and the coupling hook 302 penetrates the slot 137*b* to be hooked on the lower surface of the bottom wall of the operating unit receiving portion 137.

When the coupling hook 302 is hooked on the bottom wall of the operating unit receiving portion 137, the operating unit 300 can be prevented from being displaced upward of the flow path cover 136.

The operating unit 300 may be elastically supported by the first elastic member 306. A plurality of first elastic members 306 can support the operating unit 300 so that the operating unit 300 is not moved to one side when the operating unit 300 is operated.

The plurality of first elastic members 306 may be disposed to be spaced apart from each other in the lateral direction, although not limited thereto.

The operating unit 300 may include a first coupling protruding portion 304 for coupling each of the first elastic members 306. The first coupling protruding portion 304 may protrude downward from a lower surface of the operating unit 300. The protruding length of the first coupling protruding portion 304 may be shorter than the protruding length of the coupling hook 302.

The first elastic member 306 may be, for example, a coil spring, and the upper side of the first elastic member 306 may be received in the first coupling protruding portion 304. For this, the first coupling protruding portion 304 may be a cylindrical rib that forms a space therein.

The bottom wall of the operating unit receiving portion 137 may include a second coupling protruding portion 137*a* to which the first elastic member 306 is coupled.

The second coupling protruding portion 137*a* may protrude upward from the bottom wall of the operating unit receiving portion 137. In a state where the first elastic member 306 is wrapped around the second coupling protruding portion 137*a*, the first elastic member 306 can be seated on the bottom wall of the operating unit receiving portion 137. In other words, the second coupling protruding portion 137*a* may be received in the space formed by the first elastic member 306.

The outer diameter of the second coupling protruding portion 137*a* may be smaller than the inner diameter of the first coupling protruding portion 304. Therefore, the second coupling protruding portion 137*a* and the first coupling protruding portion 324 can be prevented from colliding with each other during the descent of the operating unit 300.

The first coupling unit 310 is positioned on the slot 137*b* of the operating unit receiving portion 137 and both side end portions thereof can be coupled with the bottom wall of the operating unit receiving portion 137.

The first coupling unit 310 may include a hook 312 and may include coupling rails 316 on both sides of which the bottom wall of the operating unit receiving portion 137 is coupled.

A portion of the coupling rail 316 can be seated on the upper surface of the bottom wall of the operating unit receiving portion 137 and another portion of the coupling rail 316 can contact the lower surface of the bottom portion of the receiving portion 137.

Therefore, the first coupling unit 310 can be stably moved in the horizontal direction in a state of being coupled to the bottom wall of the operating unit receiving portion 137 by the coupling rail 316.

As described above, the first coupling unit 310 may be elastically supported by the second elastic member 314 and the second elastic member 314 may elastically support the first coupling unit 310 on the opposite side of the hook 312.

The flow path cover 136 may further include a coupling unit receiving portion 136*a* in which the second coupling unit 254 is received. The coupling unit receiving portion 136*a* may be positioned in front of the operating unit receiving portion 137.

The flow path cover 136 may further include a body receiving portion 138 positioned below the coupling unit receiving portion 136*a* and receiving the supporting body 320.

Accordingly, the second coupling unit 254 may be positioned directly above the supporting body 320 in a state where the second coupling unit 254 is received in the coupling unit receiving portion 136*a*.

The supporting body 320 may include a pair of coupling hooks 322 for coupling to the body receiving portion 138. The body receiving portion 138 may be provided with a hook coupling slot 138*a* to which the coupling hooks 322 are coupled.

The supporting body 320 can be moved vertically in a state where the coupling hook 322 of the supporting body 320 is coupled to the hook coupling slot 138*a*. Therefore, the hook coupling slot 138*a* may extend in the vertical direction.

The supporting body 320 may be resiliently supported by the third elastic member 324.

In a state in which the coupling of the first coupling unit 310 and the second coupling unit 254 is released, the third elastic member 324 supporting the supporting body 320 may provide an elastic force for moving the second coupling unit 254 upward to the second coupling unit.

In a state where the first coupling unit 310 is coupled with the second coupling unit 254, the second coupling unit 254 presses the supporting body 320 and the third elastic member 324 is contracted to accumulate elastic force.

In this state, so as to separate the water tank 200, when the operating unit 300 is pressed downward, the downward movement force of the operating unit 300 is transmitted to the first coupling unit 310 so that the first coupling unit 310 is moved in the horizontal direction.

At this time, the first coupling unit 310 is moved in a direction away from the second coupling unit 254 so that the hook 312 of the first coupling unit 310 is missed from the groove 256 of the second coupling unit 254 and thus the coupling of the first coupling unit 310 and the second coupling unit 254 is released.

The force pressing the third elastic member 324 is removed and the elastic restoring force of the third elastic member 324 is transmitted to the supporting body 320 so that the support body 320 lifts the second coupling unit 254 placed on the supporting body 320.

Then, the portion of the second coupling unit 254 in the water tank 200 is lifted above the nozzle cover 130. Therefore, there is a gap between the water tank 200 and the nozzle cover 130, so that the user can easily grasp the water tank 200.

When the force for pressing the operating unit 300 is removed in a state where the second coupling unit 254 is lifted to a predetermined height, the first coupling unit 310 is returned to the original position thereof by the second elastic member 314.

The hook of the first coupling unit 310 protrudes into the coupling unit receiving portion 136*a* and is positioned on the upper side of the supporting body 320. The lower end of the second coupling unit 254 is positioned on the hook 312 of the first coupling unit 310.

Figure 20:
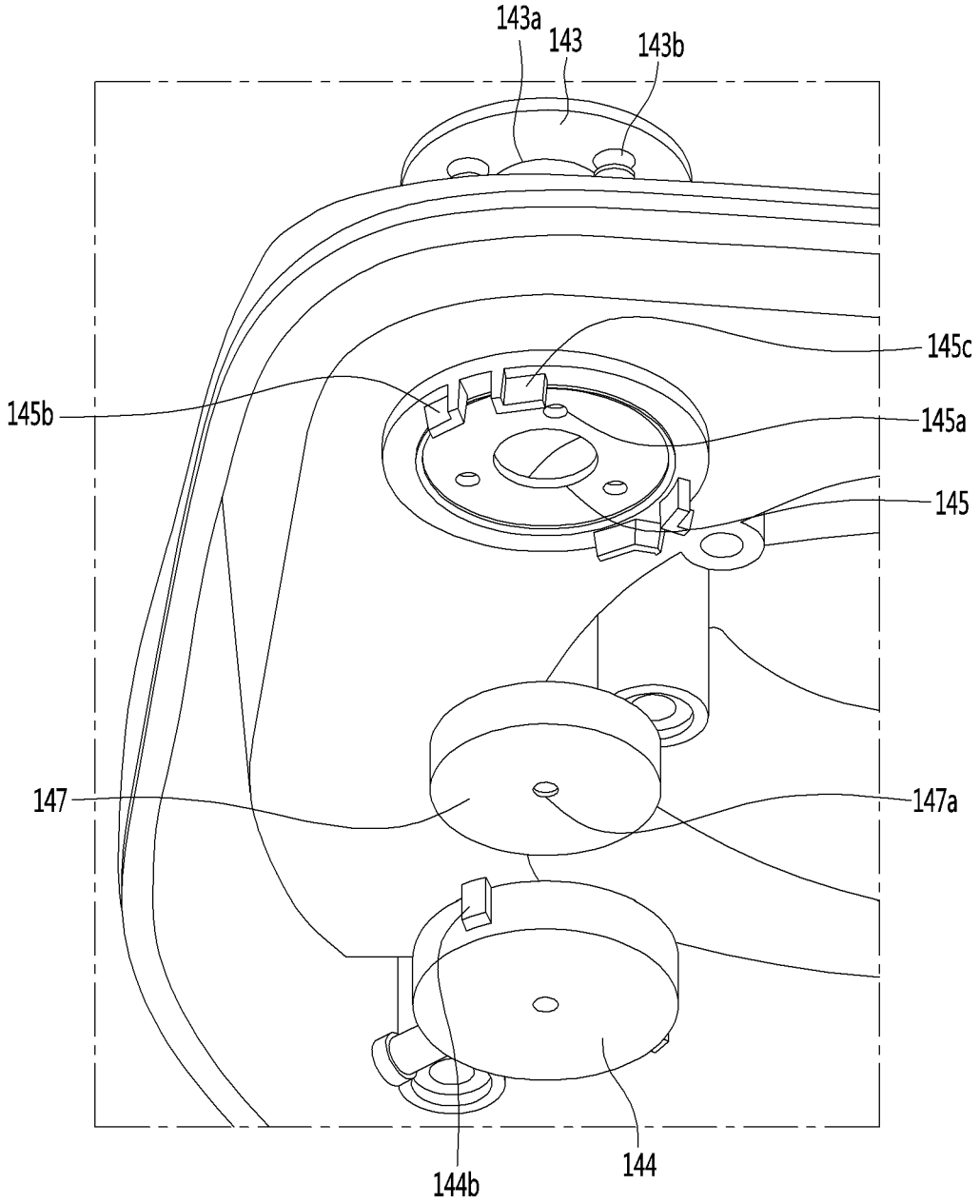
FIG. 20 is a view illustrating a state where a valve operating unit and a sealer are separated from each other in a nozzle cover according to an embodiment of the present invention.

FIG. 20 is a view illustrating a state where a valve operating unit and a sealer are separated from each other in a nozzle cover according to an embodiment of the present invention.

Referring to FIG. 20, the nozzle cover 130 may include a water passage opening 145 formed at a position corresponding to the discharge port 216 of the water tank 200.

A sealer 143 is coupled to the bottom wall 131*a* at an upper side of the bottom wall 131*a* of the nozzle cover 130 and the valve operating unit 144 is coupled to the bottom wall 131*a* at a lower side of the bottom wall 131*a*.

The sealer 143 may include a hole 143*a* formed at a position corresponding to the water passage opening 145. The water can pass through the water passage opening 145 after passing through the hole 143*a*.

The sealer 143 may further include a coupling protrusion 143*b* formed around the hole 143*a* and coupled to the bottom wall 131*a* of the nozzle cover 130. The bottom wall 131*a* of the nozzle cover 130 may have a protrusion hole 145*a* for coupling with the coupling protrusion 143*b*.

A guide protrusion 144*b* for guiding the coupling position of the valve operating unit 144 may be provided around the valve operating unit 144. A pair of guide ribs 145*b* and 145*c* spaced apart from each other in the horizontal direction may be provided on the bottom surface of the bottom wall 131*a* of the nozzle cover 130 so that the guide protrusion 144*b* may be positioned.

An absorption member 147 capable of absorbing water discharged from the water tank 200 may be coupled to the valve operating unit 144. When water is discharged from the water tank 200, the absorption member 147 primarily absorbs water and when the amount of water discharged from the water tank 200 increases, the water absorbed by the absorption member 147 can be supplied to the mops 402 and 404 through the water supply flow path, as will be described later.

The absorption member 147 may be formed in a cylindrical shape, for example, and may include a pressing portion hole 147*a* through which the pressing portion 144*a*, which will be described later, penetrates.

The valve operating unit 144 may be coupled to the nozzle cover 130 in a state where the absorbing member 147 is coupled to the valve operating unit 144.

The valve operating unit 144 may be coupled to the nozzle cover 130 by a fusion bonding method or may be coupled to the nozzle cover 130 by an adhesive, although not limited thereto.

The absorption member 147 may also act to filter foreign matters contained in the water discharged from the water tank 200.

<Nozzle Base>

Figure 21:
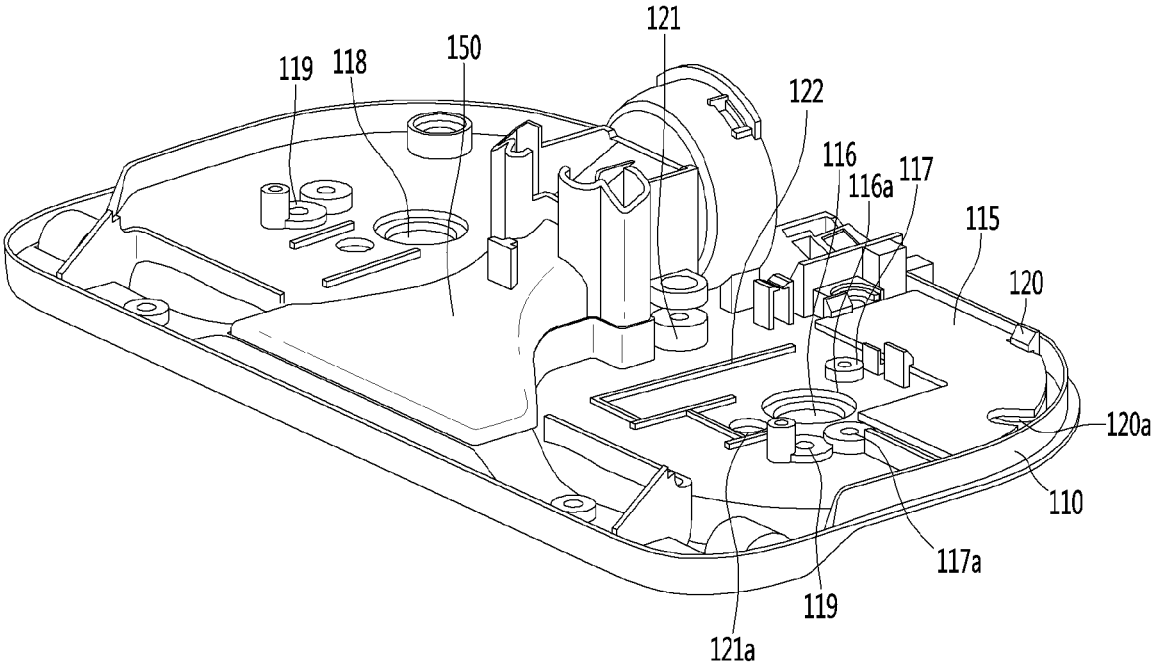
FIG. 21 is a view illustrating a state where a flow path forming portion is coupled to a nozzle base according to an embodiment of the present invention.
Figure 22:
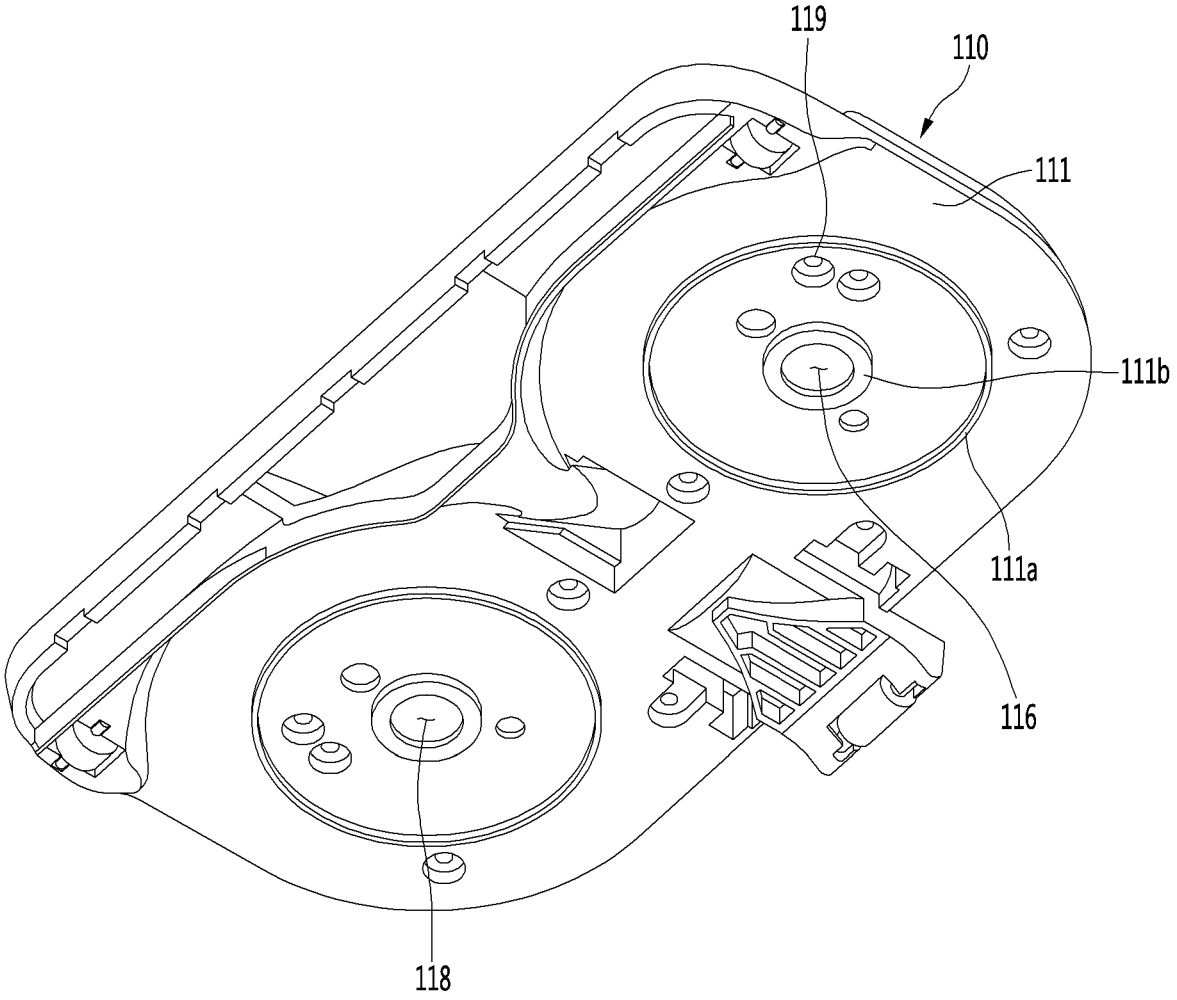
FIG. 22 is a view illustrating a nozzle base according to an embodiment of the present invention as viewed from below.

FIG. 21 is a view illustrating a state where a flow path forming portion is coupled to a nozzle base according to an embodiment of the present invention, and FIG. 22 is a view illustrating a nozzle base according to an embodiment of the present invention as viewed from below.

Referring to FIG. 6, FIG. 21, and FIG. 22, the nozzle base 110 may include a pair of shaft through-holes 116 and 118 through which a transmission shaft (to be described later) that is connected to each of the rotation plates 420 and 440 in each of the driving devices 170 and 171 passes.

The nozzle base 110 is provided with a seating groove 116*a* for seating a sleeve (see 174 in FIG. 24) provided in each of the driving devices 170 and 171, and the shaft through-holes 116 and 118 may be formed in the seating groove 116*a*.

The seating groove 116*a* may be formed in a circular shape, as an example and may be recessed downward from the nozzle base 110. The shaft through-holes 116 and 118 may be formed in the bottom of the seating groove 116*a*.

In the process of moving the nozzle 1 or the operation of the driving devices 170 and 171 as the sleeves (see 174 in FIG. 24) provided in the driving devices 170 and 171 are seated in the seating groove 116*a*, the horizontal movement of the driving devices 170 and 171 can be restricted.

A protruding sleeve 111*b* protruding downward is provided on a lower surface of the nozzle base 110 at a position corresponding to the seating groove 116*a*. The protruding sleeve 111*b* is a portion which is formed as the lower surface of the nozzle base 110 protrudes downward substantially as the seating groove 116*a* is recessed downward.

Each of the shaft through-holes 116 and 118 may be disposed on both sides of the flow path forming portion 150 in a state where the flow path forming portion 150 is coupled to the nozzle base 110.

The nozzle base 110 may be provided with a board installation portion 120 for installing a control board 115 (or first board) for controlling each of the driving devices 170 and 171. For example, the board installation portion 120 may be formed as a hook shape extending upward from the nozzle base 110.

The hooks of the board installation portion 120 are hooked on the upper surface of the control board 115 to restrict upward movement of the control board 115.

The control board 115 may be installed in a horizontal state. The control board 115 may be installed so as to be spaced apart from the bottom of the nozzle base 110.

Therefore, even if water falls to the bottom of the nozzle base 110, water can be prevented from contacting the control board 115.

The nozzle base 110 may be provided with a support protrusion 120*a* for supporting the control board 115 away from the bottom.

The board installation portion 120 may be positioned at one side of the flow path forming portion 150 in the nozzle base 110, although not limited thereto. For example, the control board 115 may be disposed at a position adjacent to the adjusting unit 180.

Therefore, a switch (to be described later) installed on the control board 115 can sense the operation of the adjusting unit 180.

In the present embodiment, the control board 115 may be positioned on the opposite side of the valve operating unit 144 with respect to the second flow path 114. Therefore, even if leakage occurs in the valve operating unit 144, water can be prevented from flowing to a side of the control board 115.

The nozzle base 110 may further include supporting ribs 122 for supporting the lower sides of each of the driving devices 170 and 171 and fastening bosses 117 and 117*a* for fastening each of the driving devices 170 and 171.

The supporting ribs 122 protrude from the nozzle base 110 and are bent at least once to separate each of the driving devices 170 and 171 from the bottom of the nozzle base 110. Alternatively, a plurality of spaced apart supporting ribs 122 may protrude from the nozzle base 110 to separate each of the driving devices 170 and 171 from the bottom of the nozzle base 110.

Even if water falls to the bottom of the nozzle base 110, the driving devices 170 and 171 are spaced apart from the bottom of the nozzle base 110 by the supporting ribs 122 so that it is possible to minimize the flow of water to the side of the driving devices 170, 171.

Figure 24:
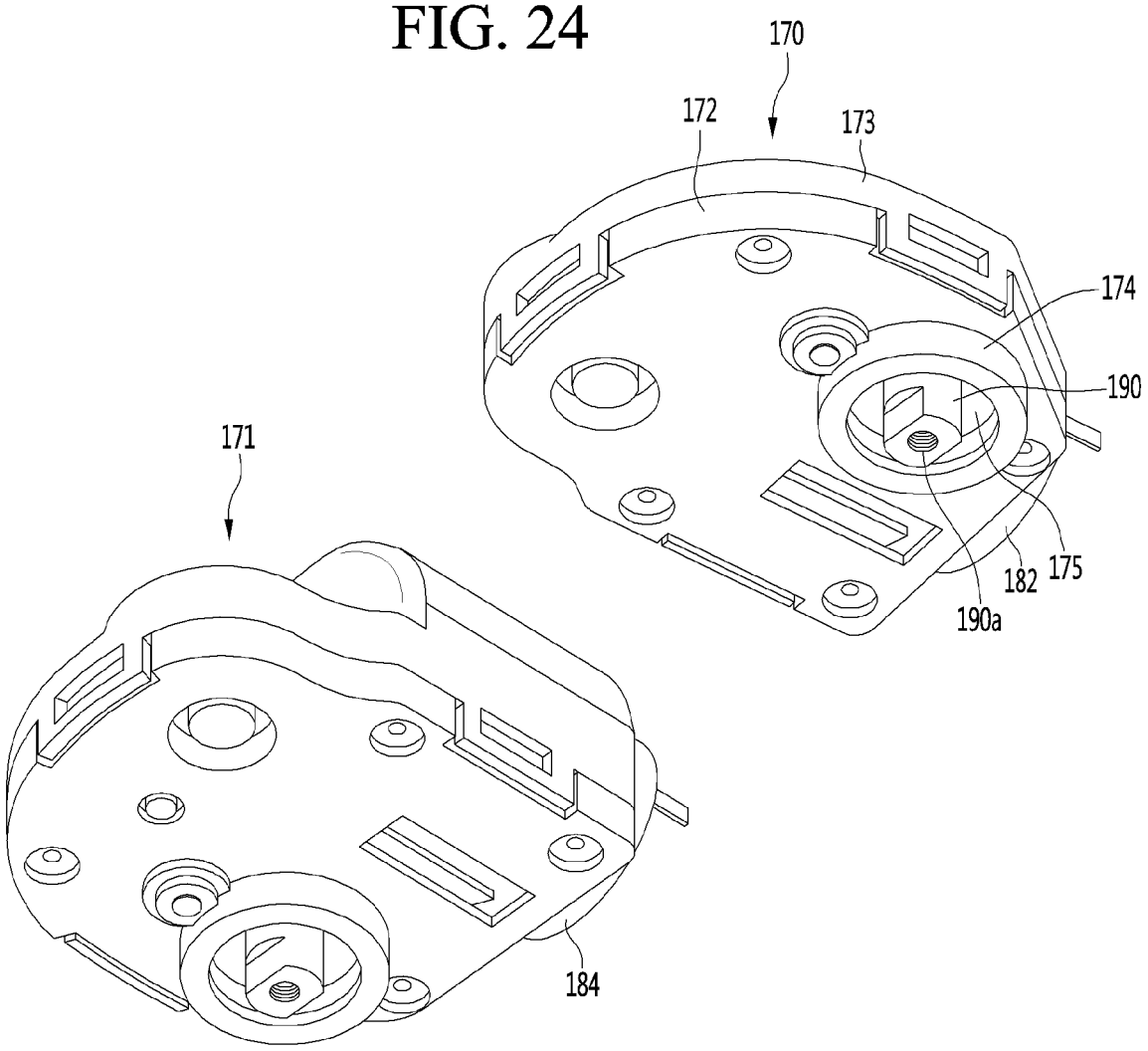
FIG. 24 is a view illustrating the first and second driving devices according to one embodiment of the present invention as viewed from below.

In addition, since the sleeves (see 174 in FIG. 24) of the driving devices 170 and 171 are seated in the seating grooves 116*a*, even if water falls to the bottom of the nozzle base 110, it can prevent water from being drawn into the driving devices 170, 171 by the sleeve (see 174 in FIG. 24).

In addition, the nozzle base 110 may further include a nozzle hole 119 through which each of the spray nozzles 149 passes.

A portion of the spray nozzle 149 coupled to the nozzle cover 130 may pass through the nozzle hole 119 when the nozzle cover 130 is coupled to the nozzle base 110.

In addition, the nozzle base 110 may further include an avoidance hole 121*a* for preventing interference with the structures of each of the driving devices 170 and 171, and a fastening boss 121 for fastening the flow path forming portion 150.

At this time, a fastening member passing through the flow path forming portion 150 can be fastened to a fastening boss 121 after passing through a portion of the driving devices 170 and 171.

A portion of each of the driving devices 170 and 171 may be positioned in the avoidance hole 121*a* so that the supporting rib 122 may be positioned at the periphery of the avoidance hole 121*a* so as to minimize the flow of water to the avoidance hole 121*a*.

For example, the supporting rib 122 may be positioned in the avoidance hole 121*a* in the formed region.

A plate receiving portion 111 which is recessed upward can be provided on the lower surface of the nozzle base 110 so that the first flow path 112 is as close as possible to the floor on which the nozzle 1 is placed in a state where the rotation cleaning units 40 and 41 are coupled to the lower side of the nozzle base 110.

The increase in the height of the nozzle 1 can be minimized in a state where the rotation cleaning units 40 and 41 are coupled by the plate receiving portion 111.

The rotation cleaning units 40 and 41 may be coupled with the driving devices 170 and 171 in a state where the rotation cleaning units 40 and 41 are positioned in the plate receiving portion 111.

The nozzle base 110 may be provided with a bottom rib 111*a* disposed to surround the shaft through holes 116 and 118. The bottom rib 111*a* may protrude downward from the lower surface of the plate receiving portion 111 and may be formed in a circular ring shape, as an example.

The shaft through holes 116 and 118, the nozzle holes 119, and an avoidance holes 121*a* can be positioned in the region formed by the bottom rib 111*a*.

<Installation Position of a Plurality of Switches>

Figure 23:
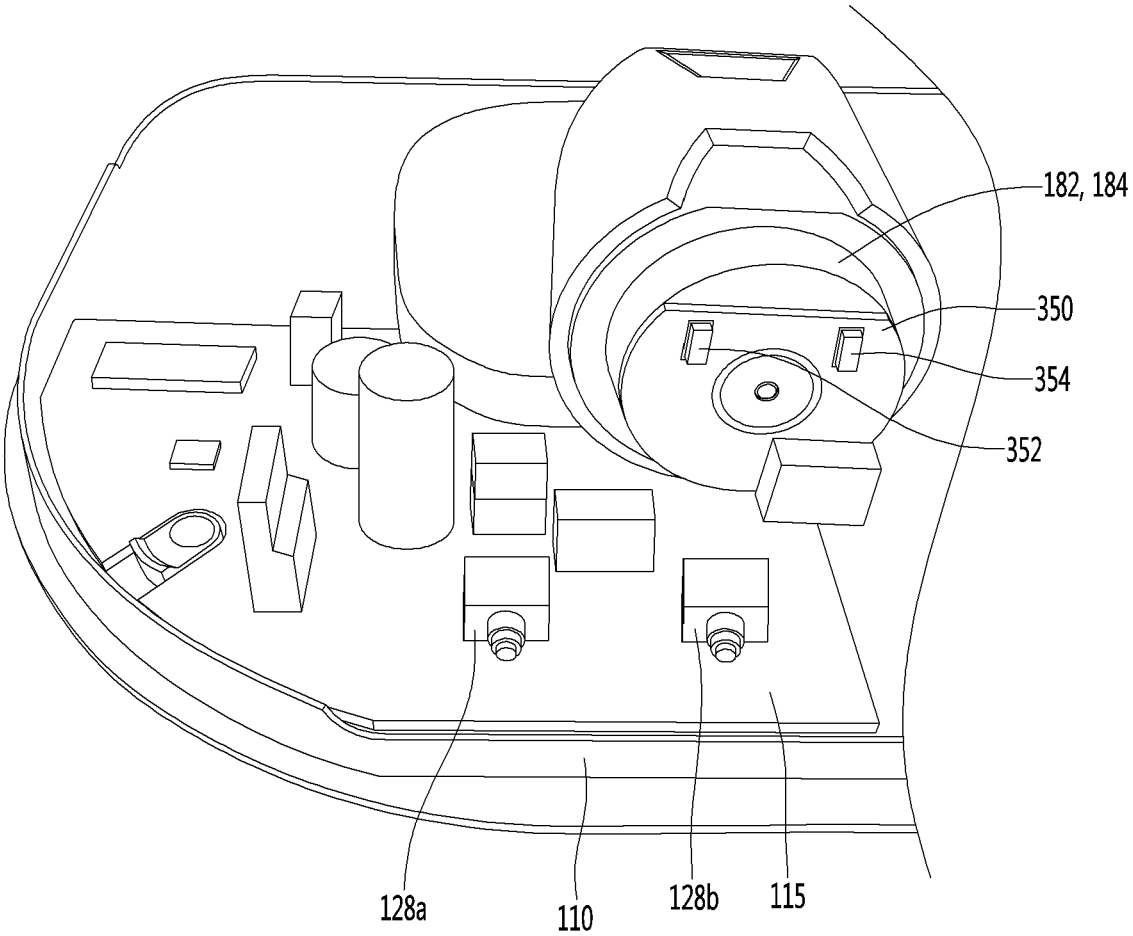
FIG. 23 is a view illustrating a plurality of switches provided on a control board according to an embodiment of the present invention.

FIG. 23 is a view illustrating a plurality of switches provided on a control board according to an embodiment of the present invention.

Referring to FIG. 4 and FIG. 23, the nozzle base 110 is provided with a control board 115 as described above. A plurality of switches 128*a* and 128*b* may be provided on the upper surface of the control board 115 to sense the operation of the adjusting unit 180.

The plurality of switches 128*a* and 128*b* may be installed in a state of being spaced apart in the lateral direction.

The plurality of switches 128*a* and 128*b* may include a first switch 128*a* for sensing a first position of the adjusting unit 180 and a second switch 128*b* for sensing a second position of the adjusting unit 180.

For example, when the adjusting unit 180 is pivoted to the left and moves to the first position, the adjusting unit 180 presses the contact of the first switch 128*a* to turn on the first switch 128*a*. In this case, the pump motor 280 operates as a first output, and water can be discharged by the first amount per unit time in the water tank 200.

When the adjusting unit 180 pivots to the right and moves to the second position, the adjusting unit 180 presses the contact of the second switch 128*b* so that the second switch 128*b* is turned on.

In this case, the pump motor 280 operates as a second output, which is larger than the first output, so that the water can be discharged by the second amount per unit time in the water tank 200.

The pump motor 280 may be controlled by a controller installed on the control board 115. The controller can control the duty of the pump motor 280.

For example, the controller may control the pump motor 280 to be off for M seconds after N seconds of on. The pump motor 280 may be repeatedly turned on and off for discharging water from the water tank 200.

At this time, the off time may be varied in a state where the on time of the pump motor 280 is maintained by the operation of the controller 180 so that the amount of water discharged from the water tank 200 may vary.

For example, so as to increase the water discharge amount in the water tank 200, the controller can control so as to turn on the pump motor 280 for N seconds and then turn off the pump motor 280 for P seconds smaller than M. In either case, the off time of the pump motor 280 may be controlled to be longer than the on time thereof.

When the adjusting unit 180 is positioned at a neutral position between the first position and the second position, the adjusting unit 180 does not press the contacts of the first switch 128*a* and the second switch 128*b*, and the pump motor 280 is stopped.

<Driving Device>

Figure 25:
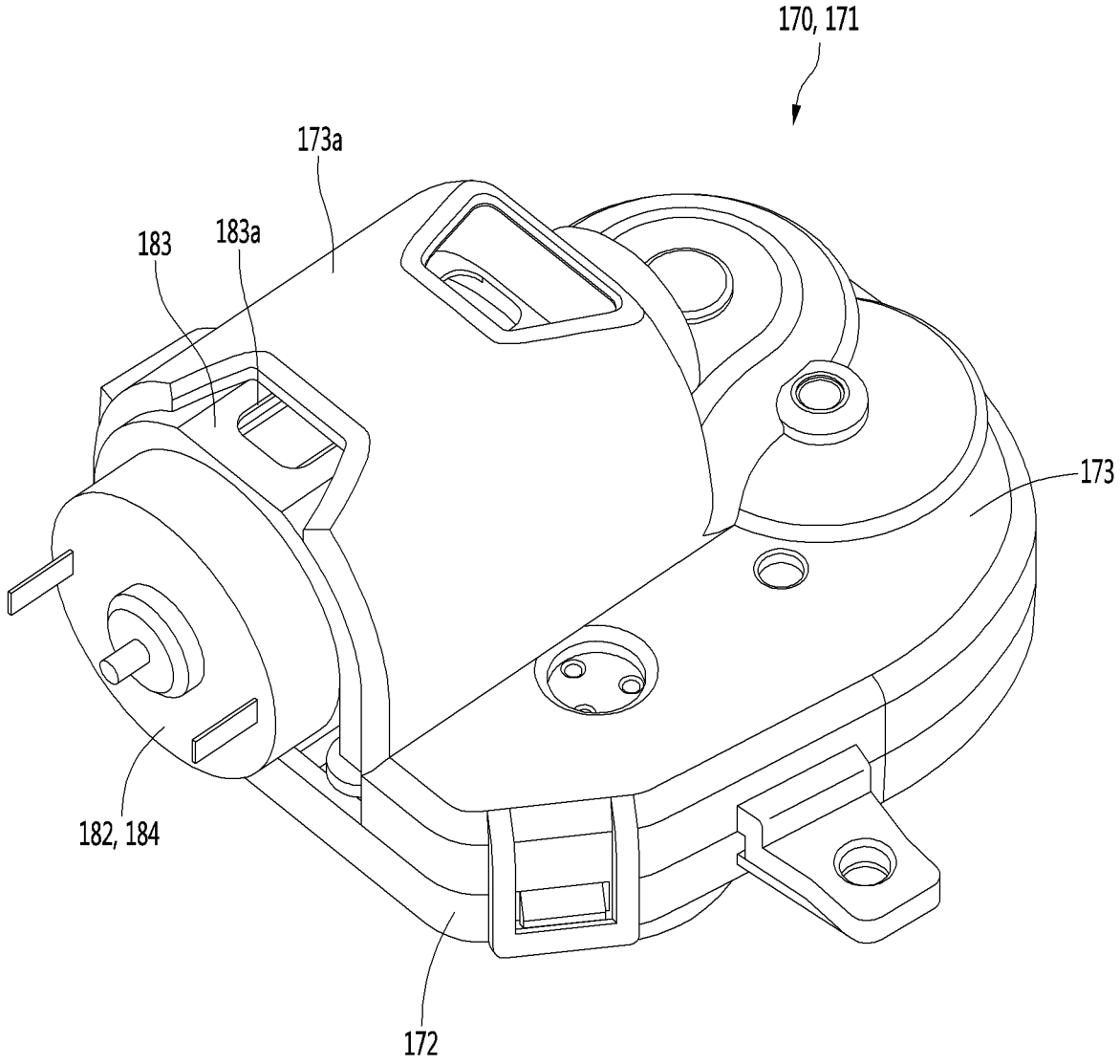
FIG. 25 is a view illustrating the first and second driving devices according to the embodiment of the present invention as viewed from above.
Figure 26:
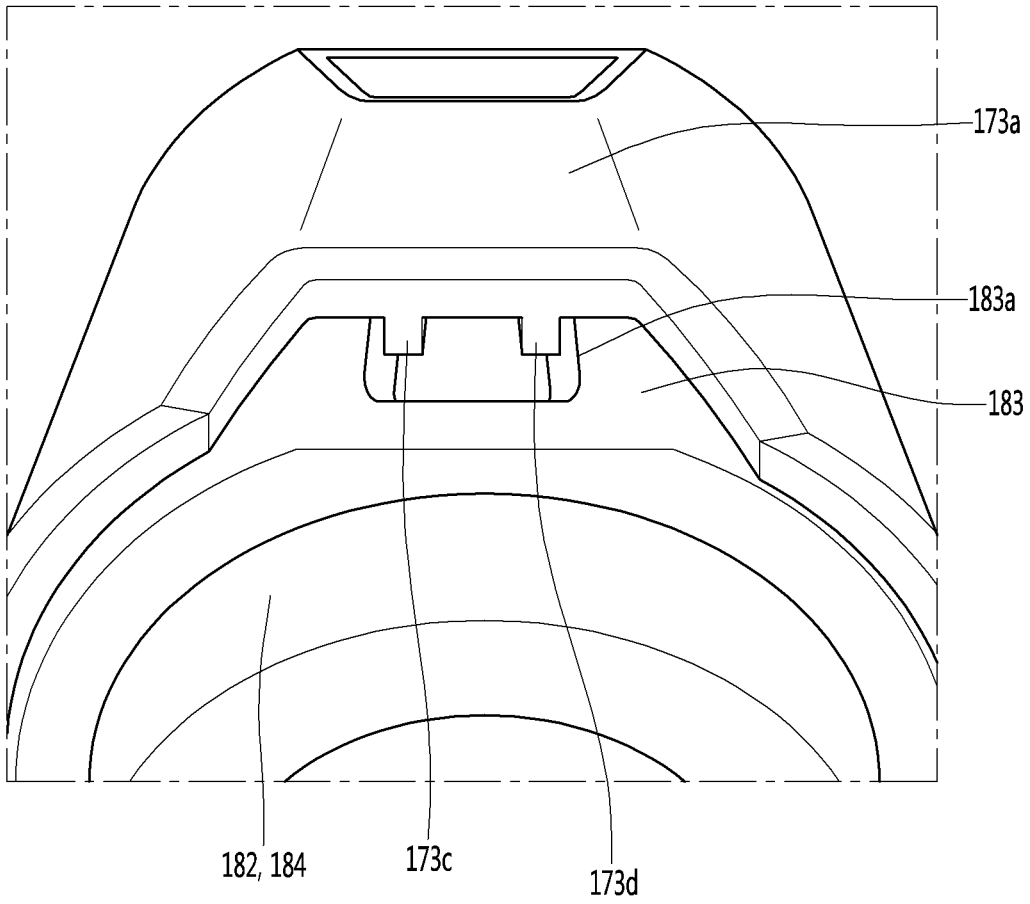
FIG. 26 is a view illustrating a structure for preventing rotation of the motor housing and the driving motor.
Figure 27:
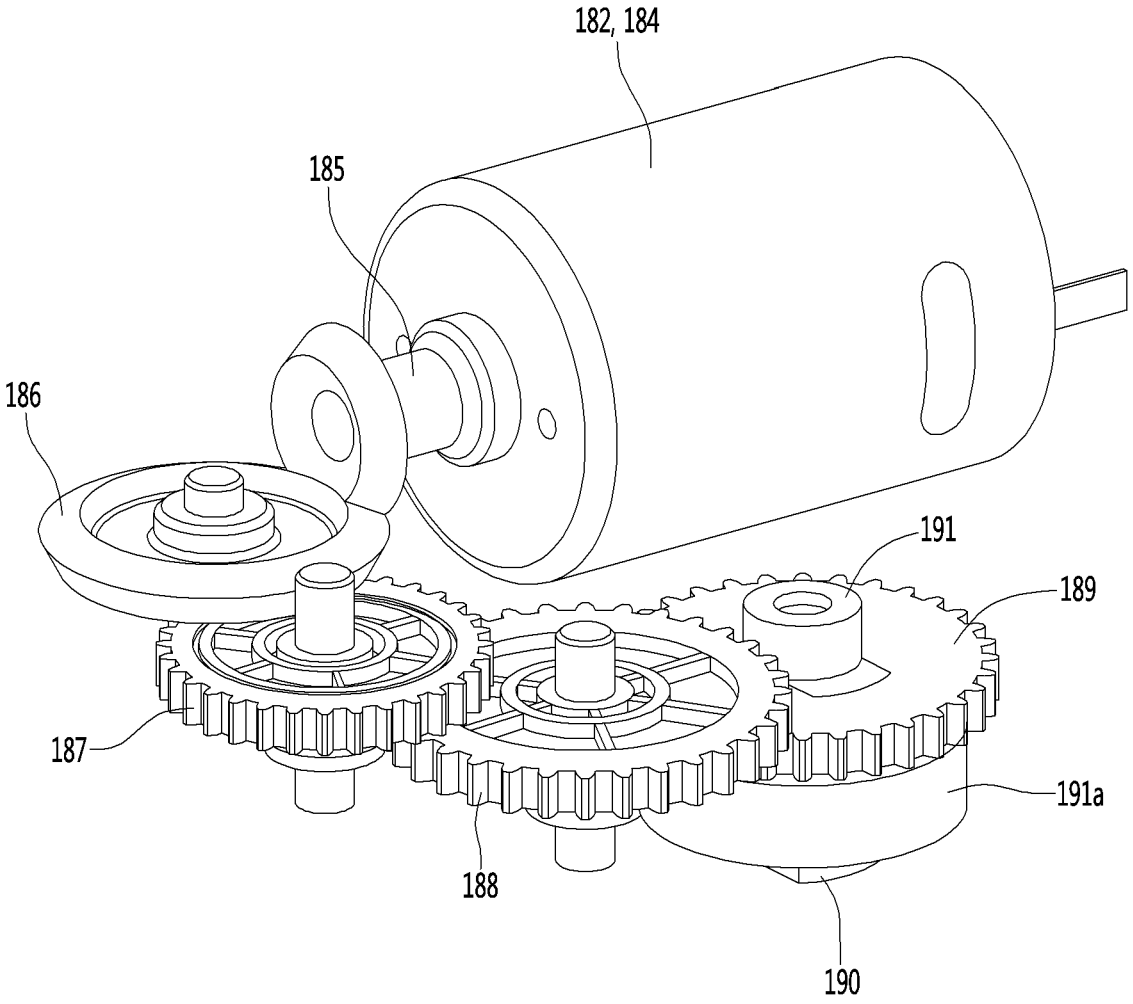
FIG. 27 is a view illustrating a state where a power transmission unit is coupled to a driving motor according to an embodiment of the present invention.

FIG. 24 is a view illustrating the first and second driving devices according to one embodiment of the present invention as viewed from below, FIG. 25 is a view illustrating the first and second driving devices according to the embodiment of the present invention as viewed from above, FIG. 26 is a view illustrating a structure for preventing rotation of the motor housing and the driving motor, and FIG. 27 is a view illustrating a state where a power transmission unit is coupled to a driving motor according to an embodiment of the present invention.

Referring to FIG. 23 to FIG. 27, the first driving device 170 and the second driving device 171 may be formed and disposed symmetrically in the lateral direction.

The first driving device 170 may include a first driving motor 182 and the second driving device 171 may include a second driving motor 184.

A motor PCB 350 (or second board) for driving each of the driving motors may be connected to the driving motors 182 and 184. The motor PCB 350 may be connected to the control board 115 to receive a control signal. The motor PCB 350 may be connected to the driving motors 182 and 184 in a standing state and may be spaced apart from the nozzle base 110.

The controller can sense the current of each of the driving motors 182 and 184. Since the frictional force between the mop 402 and the floor acts as a load on the driving motors 182 and 184 in a state where the nozzle 1 is placed on the floor, the current of the driving motors 182 and 184 may be equal to or greater than the first reference value.

Meanwhile, when the nozzle 1 is lifted from the floor since there is no frictional force between the mops 402 and 404 and the floor, the current of each of the driving motors 182 and 184 may be less than the first reference value.

Accordingly, when the current of each of the driving motors 182 and 184 sensed is less than the first reference value and the time sensed as being less than the first reference value is equal to or longer than the reference time, the controller can stop the operation of the pump motor 280. Alternatively, the controller may stop the operation of the pump motor 280 when the current of each of the driving motors 182 and 184 sensed is less than the first reference value.

In addition, when the current of each of the driving motors 182 and 184 sensed is less than the first reference value and the time sensed as being less than the first reference value is equal to or longer than the reference time, the controller can stop the operation of each of the driving motors 182 and 184. Alternatively, the controller may stop the operation of each of the driving motors 182 and 184 if the current of each of the driving motors 182 and 184 sensed is less than the first reference value.

The controller can simultaneously or sequentially operate the pump motor 280 and each of the driving motors 182 and 184 when the currents of the driving motors 184 and 184 sensed become equal to or greater than the first reference value.

A terminal for supplying power to the nozzle 1 of the present embodiment may be positioned in the connection tube 50.

The nozzle 1 may include the rotation cleaning units 40 and 41 and driving devices 170 and 171 and a pump motor 280 for driving the rotation cleaning units 40 and 41, as described above. Therefore, only when the power is supplied to the connection tube 50, the driving devices 170 and 171 and the pump motor 280 operate to rotate the rotation cleaning units 40 and 41 to clean the floor, and water may be supplied from the water tank 200 to the rotation cleaning units 40 and 41.

Therefore, when the nozzle 1 of the present embodiment is connected to the cleaner used by the existing user, the floor can be cleaned using the nozzle 1, so that the nozzle 1 can be used with an additional accessory of the existing cleaner.

The motor PCB 350 may include a plurality of resistors 352 and 354 for improving Electro Magnetic Interference (EMI) performance of the driving motor.

For example, a pair of resistors 352 and 354 may be provided in the motor PCB 350.

One resistor of the pair of resistors 352 and 354 may be connected to the (+) terminal of the driving motor and the other resistor may be connected to the (−) terminal of the driving motor. Such a pair of resistors 352 and 354 can reduce the fluctuation of the output of the driving motor.

The pair of resistors 352 and 354 may be spaced laterally from the motor PCB 350, for example.

Each of the driving devices 170 and 171 may further include a motor housing.

The driving motors 182 and 184 and a power transmission unit for transmitting power can be received in the motor housing.

The motor housing may include, for example, a first housing 172, and a second housing 173 coupled to the upper side of the first housing 172.

The axis of each of the driving motors 182 and 184 may substantially extend in the horizontal direction in a state where each of the driving motors 182 and 184 is installed in the motor housing.

If the driving devices are installed in the motor housing so that the axis of each of the driving motors 182 and 184 extends in the horizontal direction, the driving devices 170 and 171 can be compact. In other words, the heights of the driving devices 170 and 171 can be reduced.

The first housing 172 may have a shaft hole 175 through which the transmission shaft 190 for coupling with the rotation plates 420 and 440 of the power transmission unit passes. For example, a portion of the transmission shaft 190 may protrude downward through the lower side of the motor housing.

The horizontal section of the transmission shaft 190 may be formed in a non-circular shape such that relative rotation of the transmission shaft 190 is prevented in a state where the transmission shaft 190 is coupled with the rotation plates 420 and 440.

A sleeve 174 may be provided around the shaft hole 175 in the first housing 172. The sleeve 174 may protrude from the lower surfaces of the first housing 172.

The sleeve 174 may be formed in a ring shape, for example. Therefore, the sleeve 174 can be seated in the seating groove 116*a* in a circular shape.

The driving motors 182 and 184 may be seated on the first housing 172 and fixed to the first housing 172 by the motor fixing unit 183 in this state.

The driving motors 182 and 184 may be formed in an approximately cylindrical shape and the driving motors 182 and 184 may be seated in the first housing 172 in a state where the axes of the driving motors 182 and 184 are substantially horizontal (in a state where driving motors 182 and 184 are lying down).

The motor fixing unit 183 may be formed in an approximately semicircular shape in cross section and may cover the upper portion of the driving motors 182 and 184 seated on the first housing 172. The motor fixing unit 183 may be fixed to the first housing 172 by a fastening member such as a screw, as an example.

The second housing 173 may include a motor cover 173*a* covering a portion of the driving motors 182 and 184.

The motor cover 173*a* may be rounded so as to surround the motor fixing unit 183 from the outside of the motor fixing unit 183, for example.

For example, the motor cover 173*a* may be formed in a round shape such that a portion of the second housing 173 protrudes upward.

Rotation preventing ribs 173*c* and 173*d* are formed on the surface facing the motor fixing unit 183 from the motor cover 173*a* so as to prevent relative rotation between the motor cover 173*a* and the motor fixing unit 183 during the operation of the driving motors 182 and 184, and a rib receiving slot 183*a* in which the rotation preventing ribs 173*c* and 173*d* are received can be formed in the motor fixing unit 183.

Though not limited, the widths of the rotation preventing ribs 173*c* and 173*d* and the width of the rib receiving slot 183*a* may be the same.

Alternatively, a plurality of rotation preventing ribs 173*c* and 173*d* may be spaced apart from the motor cover 173*a* in the circumferential direction of the driving motors 182 and 184, and a plurality of rotation preventing ribs 173*c* and 173*d* can be received in the rib receiving slot 183*a*.

At this time, the maximum width of the plurality of rotation preventing ribs 173*c* and 173*d* in the circumferential direction of the driving motors 182 and 184 may be equal to or slightly smaller than the width of the rib receiving slot 183*a*.

The power transmission unit may include a driving gear 185 connected to the shaft of each of the driving motors 182 and 184 and a plurality of transmission gears 186, 187, 188, and 189 for transmitting the rotational force of the driving gear 185.

The axis of each of the driving motors 182 and 184 (see A3 and A4 in FIG. 20) substantially extends in the horizontal direction while the centerlines of the rotation plates 420 and 440 extend in the vertical direction. Therefore, the driving gear 185 may be a spiral bevel gear, for example.

The plurality of transmission gears 186, 187, 188, and 189 may include a first transmission gear 186 that engages with the driving gear 185. The first transmission gear 186 may have a rotation center extending in a vertical direction.

The first transmission gear 186 may include a spiral bevel gear so that the first transmission gear 186 can engage with the driving gear 185.

The first transmission gear 186 may further include a helical gear disposed at a lower side of the spiral bevel gear as a second gear.

The plurality of transmission gears 186, 187, 188 and 189 may further include a second transmission gear 187 engaged with the first transmission gear 186.

The second transmission gear 187 may be a two-stage helical gear. In other words, the second transmission gear 187 includes two helical gears arranged vertically, and the upper helical gear can be connected to the helical gear of the first transmission gear 186.

The second transmission gear 187 may be a two-stage helical gear. In other words, the second transmission gear 187 includes two helical gears arranged vertically, and the upper helical gear can be connected to the helical gear of the first transmission gear 186.

The plurality of transmission gears 186, 187, 188 and 189 may further include a third transmission gear 188 engaged with the second transmission gear 187.

The third transmission gear 188 may also be a two-stage helical gear. In other words, the third transmission gear 188 includes two helical gears arranged vertically, and the upper helical gear may be connected to the lower helical gear of the second transmission gear 187.

The plurality of transmission gears 186, 187, 188 and 189 may further include a fourth transmission gear 189 engaged with the lower helical gear of the third transmission gear 188. The fourth transmission gear 189 may be a helical gear.

The transmission shaft 190 may be coupled to the fourth transmission gear 189. In other words, the fourth transmission gear 189 is an output end of the power transmitting portion. The transmission shaft 190 may be coupled to penetrate the fourth transmission gear 189. The transmission shaft 190 may be rotated together with the fourth transmission gear 189.

Accordingly, an upper bearing 191 is coupled to the upper end of the transmission shaft 190 passing through the fourth transmission gear 189 and a lower bearing 191*a* is coupled to the transmission shaft 190 at the lower side of the fourth transmission gear 189.

Figure 28:
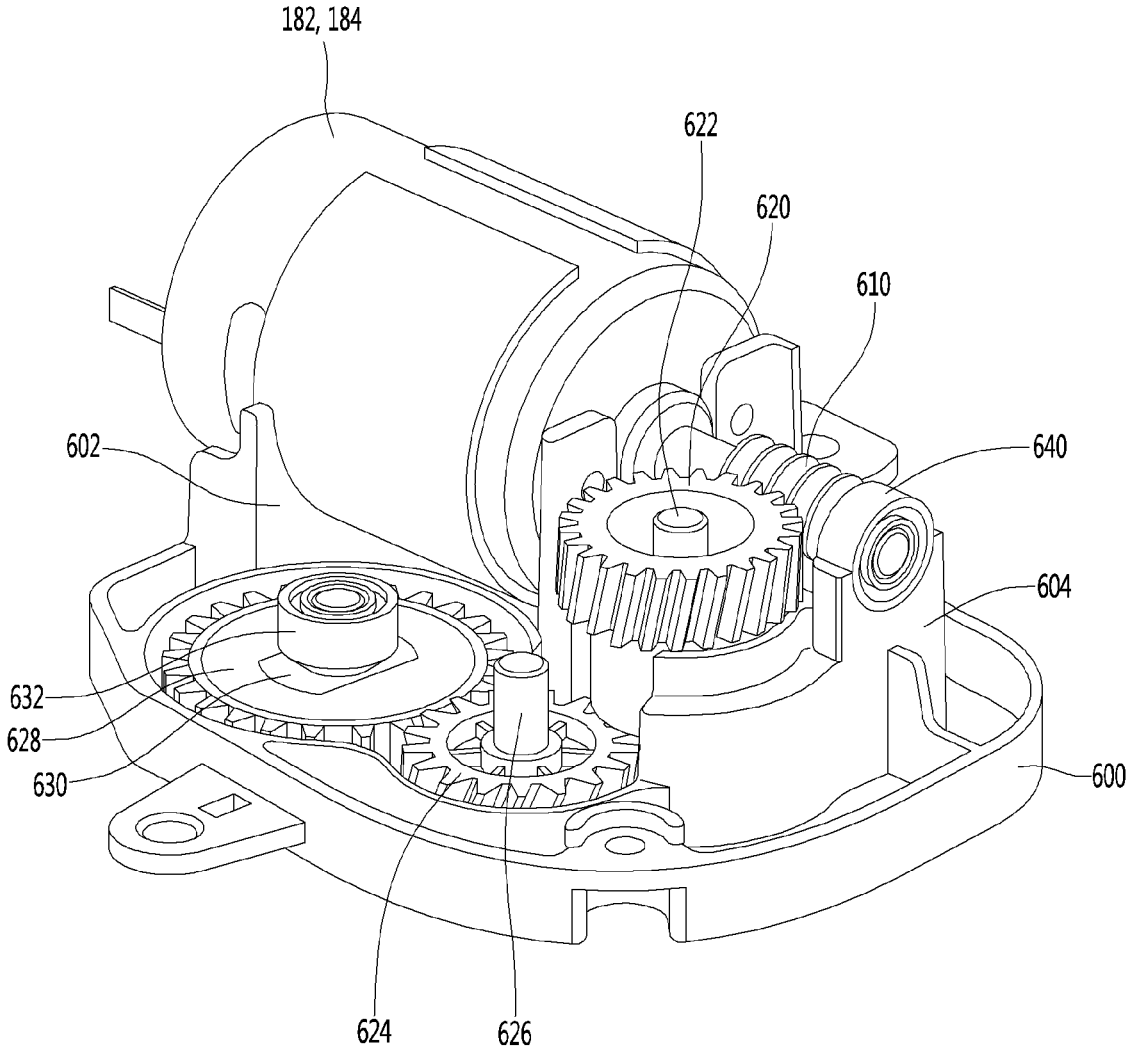
FIG. 28 is a view illustrating a state where a power transmitting unit is coupled to a driving motor according to another embodiment of the present invention.

FIG. 28 is a view illustrating a state where a power transmitting unit is coupled to a driving motor according to another embodiment of the present invention.

The present embodiment is the same as the previous embodiment in other portions but differs in the configuration of the power transmitting portion. Therefore, only the characteristic parts of the present embodiment will be described below.

Referring to FIG. 28, the power transmitting unit of the present embodiment may include a driving gear 610 connected to the shafts of the driving motors 182 and 184.

The driving gear 610 may be a worm gear. The rotational shaft of the driving gear 610 may extend in the horizontal direction. Since the driving gear 610 is rotated together with the rotating shaft of the driving gear 610, a bearing 640 may be connected to the driving gear 610 for smooth rotation.

The first housing 600 may include a motor support portion 602 for supporting the driving motors 182 and 184 and a bearing support portion 604 for supporting the bearings 640.

The power transmission unit may further include a plurality of transmission gears 620, 624 and 628 for transmitting the rotational force of the driving gear 610 to the rotation plates 420 and 440.

The plurality of transmission gears 620, 624 and 628 may include a first transmission gear 620 engaged with the driving gear 610. The first transmission gear 620 may include an upper worm gear to engage with the driving gear 610.

Since the driving gear 610 and the second transmission gear 620 mesh with each other in the form of a worm gear, there is an advantage that noise is reduced by friction in a process in which the rotational force of the driving gear 610 is transmitted to the second transmission gear 620.

The first transmission gear 620 may include a helical gear disposed at the lower side of the upper worm gear as a second gear.

The first transmission gear 620 may be rotatably connected to a first shaft 622 extending in the vertical direction. The first shaft 622 may be fixed to the first housing 600.

Accordingly, the first transmission gear 620 can be rotated with respect to the fixed first shaft 622. According to the present embodiment, since the first transmission gear 620 is configured to rotate with respect to the first shaft 622, there is an advantage that a bearing is unnecessary.

The plurality of transmission gears 620, 624, and 628 may further include a second transmission gear 624 engaged with the first transmission gear 620. The second transmission gear 624 is, for example, a helical gear.

The second transmission gear 624 may be rotatably connected to a second shaft 626 extending in the vertical direction. The second shaft 626 may be fixed to the first housing 600.

Accordingly, the second transmission gear 624 can be rotated with respect to the fixed second shaft 626. According to the present embodiment, since the second transmission gear 624 is configured to rotate with respect to the second shaft 626, there is an advantage that no bearing is required.

The plurality of transmission gears 620, 624, and 628 may further include a third transmission gear 628 engaged with the second transmission gear 624. The third transmission gear 628 is, for example, a helical gear.

The third transmission gear 628 may be connected to a transmission shaft 630 connected to the rotation plates 420 and 440. The transmission shaft 630 may be connected to the third transmission gear 628 and rotated together with the third transmission gear 628.

A bearing 632 may be coupled to the transmission shaft 630 for smooth rotation of the transmission shaft 630.

<Disposition of Driving Device in Nozzle Base>

Figure 29:
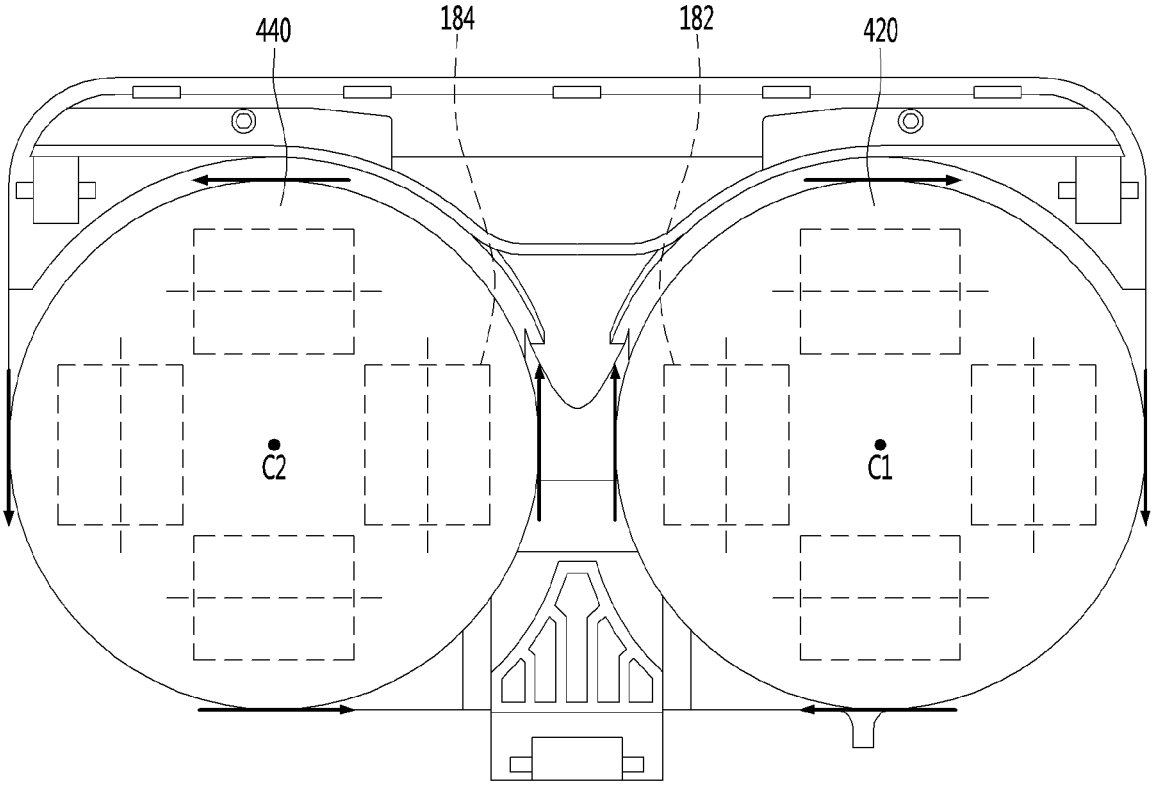
FIG. 29 is a view illustrating a relationship between a rotating direction of a rotation plate and an extending direction of an axis of the driving motor according to an embodiment of the present invention.
Figure 30:
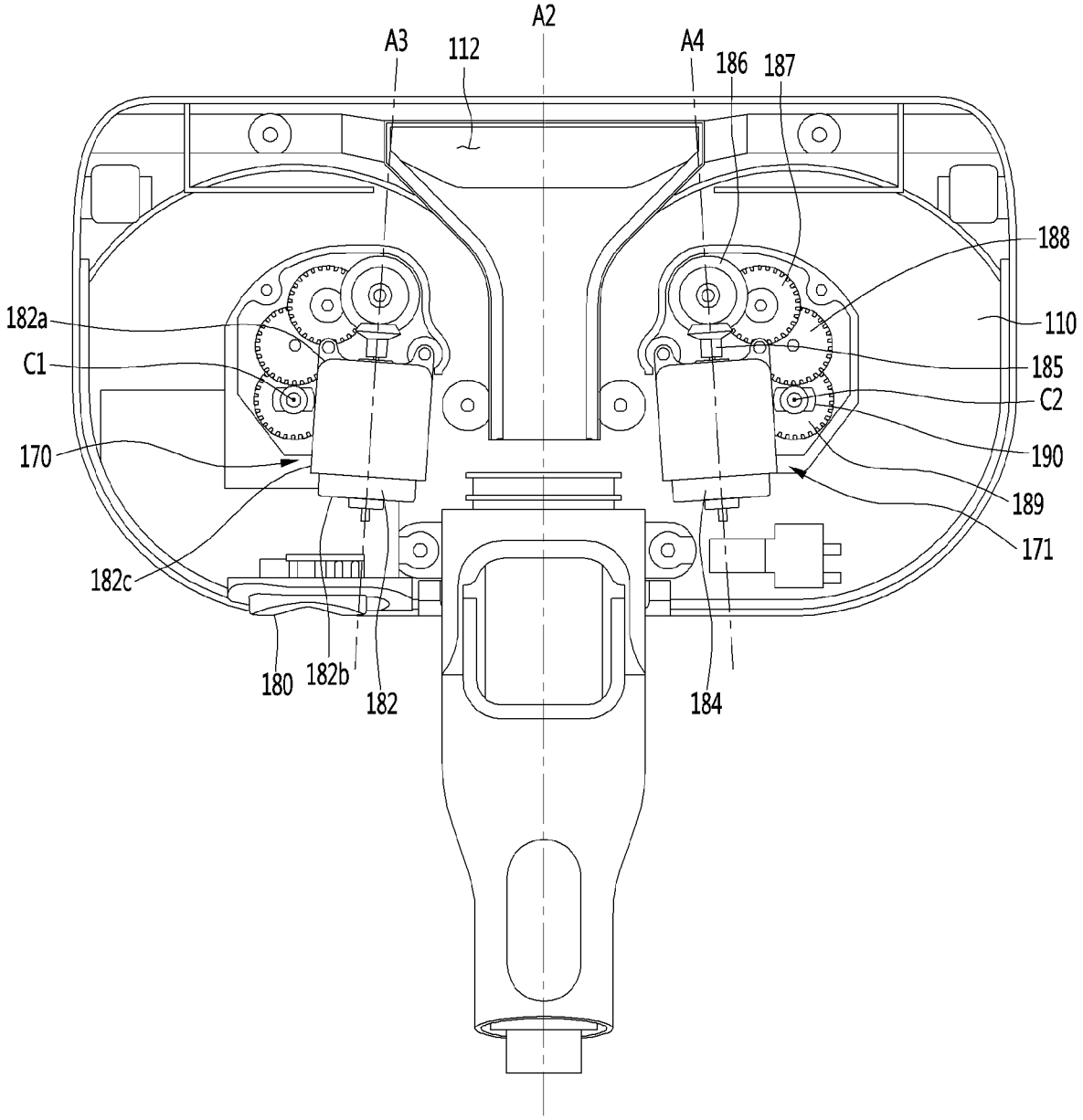
FIG. 30 is a plan view illustrating a state where a driving device is installed on a nozzle base according to an embodiment of the present invention.
Figure 31:
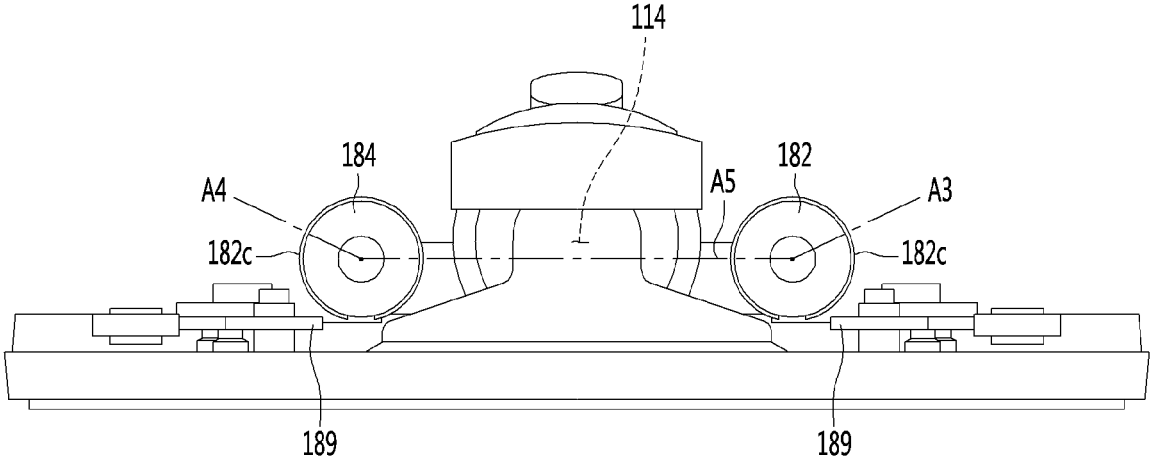
FIG. 31 is a front view illustrating a state where a driving device is installed on a nozzle base according to an embodiment of the present invention.

FIG. 29 is a view illustrating a relationship between a rotating direction of a rotation plate and an extending direction of an axis of the driving motor according to an embodiment of the present invention, and FIG. 30 is a plan view illustrating a state where a driving device is installed on a nozzle base according to an embodiment of the present invention, and FIG. 31 is a front view illustrating a state where a driving device is installed on a nozzle base according to an embodiment of the present invention.

Particularly, FIG. 30 illustrates a state where the second housing of the motor housing is removed.

Referring to FIG. 29 to FIG. 31, the first rotation plate 420 and the second rotation plate 440 arranged in the nozzle 1 in the lateral direction may be rotated in opposite directions to each other.

For example, a portion closest to the centerline A2 of the second flow path 114 in each of the rotation plates 420 and 440 may be rotated away from the first flow path 112 toward a side of the first flow path 112.

The axes A3 and A4 of the driving motors 182 and 184 may be disposed substantially parallel to the tangents of the rotation plates 420 and 440.

In the present embodiment, the term "substantially parallel" means that the angle formed between the two lines is within 5 degrees even if they are not parallel.

When considering the vibration due to the driving force generated in each of the driving motors 182 and 184 and the vibration due to friction with the floor generated by the rotation of the rotation cleaning units 40 and 41, the driving motors 182 and 184 may be disposed to be symmetrical with respect to the centerline A2 of the second flow path 114.

Each of the driving motors 182 and 184 may be disposed so as to be vertically overlapped with the rotation plates 420 and 440.

At least a portion of each of the driving motors 182 and 184 may be positioned in a region between the rotation centers C1 and C2 of the rotation plates 420 and 440 and the outer peripheral surfaces of the rotation plates 420 and 440. For example, all of the driving motors 182 and 184 may be disposed so as to overlap with the rotation plates 420 and 440 in the vertical direction.

Preferably, each of the driving motors 182 and 184 may be positioned as close as possible to the centerline A2 of the second flow path 114 from the nozzle 1 such that the vibration balance is maximized in the entire nozzle 1.

For example, as illustrated in FIG. 30, the axes A3 and A4 of the driving motors 182 and 184 may be disposed to extend in the front and rear direction. At this time, the axes A3 and A4 of the driving motors 182 and 184 may be substantially parallel to the centerline A2 of the second flow path 114.

The driving motors 182 and 184 may include a front end portion 182*a* and a rear end portion 182*b* spaced apart from each other in the extending direction of the axes A3 and A4.

The front end portion 182*a* may be positioned closer to the first flow path 112 than the rear end portion 182*b*.

The rotation center of the fourth transmission gear 189 (which is substantially rotation center of rotation cleaning unit) may be positioned in a region corresponding to a region between the front end portion 182*a* and the rear end portion 182*b*.

At least a portion of the fourth transmission gear 189 may be disposed so as to overlap with the driving motors 182 and 184 in the vertical direction.

The driving motors 182 and 184 include a connection surface for connecting between the front end portion 182*a* and the rear end portion 182*b* and an outermost line 182*c* of the connection surface can overlap with the fourth transmission gear 189 in the vertical direction.

The axes A3 and A4 of each of the driving motors 182 and 184 may be positioned higher than the locus of rotation of the transmission gears.

By this disposition of the driving devices 170 and 171, the weight of each of the driving devices 170 and 171 can be evenly distributed to the right and left of the nozzle 1.

In addition, as the axis A3 of the first driving motor 182 and the axis A4 of the second driving motor 184 extend in the front and rear direction, by each of the driving motors 182 and 184, the height of the nozzle 1 can be prevented from being increased.

The imaginary line A5 connecting the axis A3 of the first driving motor 182 and the axis A4 of the second driving motor 184 passes through the second flow path 114. This is because each of the driving motors 182 and 184 is positioned close to the rear side of the nozzle 1 so that the increase in the height of the nozzle 1 by the driving motors 182 and 184 can be prevented.

In addition, in a state where the driving gears 185 and 185 are connected to the shaft of each of the driving motors 182 and 184, so that the increase in the height of the nozzle 1 is minimized by each of the driving devices 170 and 171, the driving gear 185 may be positioned between the driving motors 182 and 184 and the first flow path 112.

In this case, since the driving motors 182 and 184 having the longest vertical length of the driving devices 170 and 171 are positioned as close as possible to the rear side in the nozzle main body 10, the increase in height of a side of the front end portion of the nozzle 1 can be minimized.

Since the driving devices 170 and 171 are positioned close to the rear side of the nozzle 1 and the water tank 200 is positioned above the driving devices 170 and 171, the center of gravity of the nozzle 1 may be pulled toward the rear side of the nozzle 1 due to the weight of the water in the water tank 200 and the driving devices 170 and 171.

Accordingly, in the present embodiment, the connection chamber (see 226 of FIG. 6) of the water tank 200 is positioned between the first flow path 112 and the driving devices 170 and 171 with respect to the front and rear direction of the nozzle 1.

In the present embodiment, the rotation centers C1 and C2 of the rotation plates 420 and 440 coincide with the rotation center of the transmission shaft 190.

The axes A3 and A4 of the driving motors 182 and 184 can be positioned in the region between the rotation centers C1 and C2 of the rotation plates 420 and 440.

In addition, the driving motors 182 and 184 may be positioned in a region between the rotation centers C1 and C2 of the rotation plates 420 and 440.

In addition, each of the driving motors 182 and 184 may be disposed so as to overlap with the imaginary line connecting the first rotation center C1 and the second rotation center C2 in the vertical direction.

<Driving Unit Cover of Nozzle Cover, and Disposition Relationship between Rotation Center of Rotation Plate and Motor>

Figure 32:
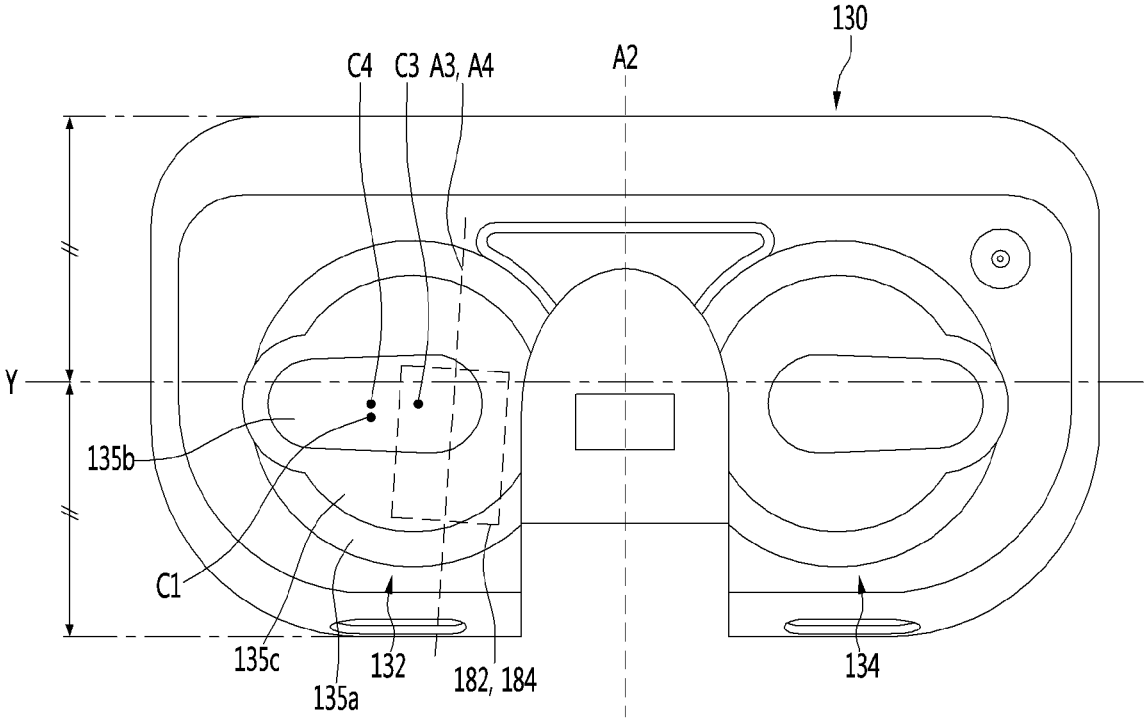
FIG. 32 is a view illustrating a structure of a driving unit cover of a nozzle cover and a disposition relationship between a rotation center of a rotation plate and a driving motor according to an embodiment of the present invention.

FIG. 32 is a view illustrating a structure of a driving unit cover of a nozzle cover and a disposition relationship between a rotation center of a rotation plate and a driving motor according to an embodiment of the present invention.

Referring to FIG. 14 and FIG. 32, a pair of the driving unit covers 132 and 134 of the nozzle cover 130 is disposed to be symmetrical in the lateral direction and have a convex shape upward.

Each of the driving unit covers 132 and 134 may include a first protruding surface 135*a* extending upward from the bottom wall 130*a* of the nozzle cover 130 and a second protruding surface 135*b* positioned higher than the first protruding surface 135*a* and having a different curvature from the first protruding surface 135*a*.

The first protruding surface 135*a* and the second protruding surface 135*b* may be directly connected or may be connected by a third protruding surface 135*c*.

At this time, the third protruding surface 135*c* is formed to have a curvature different from that of each of the first protruding surface 135*a* and the second protruding surface 135*b*. The third protruding surface 135*c* is positioned higher than the first protruding surface 135*a* and lower than the second protruding surface 135*b*.

In the present embodiment, the second protruding surface 135*b* may overlap with the second bottom wall 213*b* of the water tank 200 in the vertical direction. In addition, the second protruding surface 135*b* may be formed in a shape corresponding to the second bottom wall 213*b* of the water tank 200.

The second protruding surface 135*b* may be the surface that is positioned at the highest position in the driving unit covers 132 and 134.

The second protruding surface 135*b* may be formed to have a longer left and right length (width) than a front and rear length (width), for example. In the present embodiment, the length direction of the second protruding surface 135*b* is long in the lateral direction.

The length direction of the second protruding surface 135*b* intersects with the extending direction of the axes A3 and A4 of the driving motors 182 and 184.

The center C3 of the driving unit covers 132 and 134 (for example, center of curvature) may be positioned on the second protruding surface 135*b*.

The center C4 of the second protruding surface 135*b* is eccentric with the center C3 of the driving unit cover 132.

For example, the center C4 of the second protruding surface 135*b* is eccentric in a direction away from the centerline A2 of the second flow path 114 at the center C3 of the driving unit cover 132.

Therefore, the centers C3 of the driving unit covers 132, 134 are positioned between the center C4 of the second protruding surface 135*b* and the centerline A2 of the second flow path 114.

In addition, the rotation centers C1 and C2 of the rotation plates 420 and 440 may be positioned so as to overlap with the second protruding surface 135*b* in the vertical direction.

The rotation centers C1 and C2 of the rotation plates 420 and 440 are eccentric with the centers C3 of the driving unit covers 132 and 134.

For example, the rotation centers C1 and C2 of the rotation plates 420 and 440 may be eccentric in a direction away from the centerline A2 of the second flow path 114 at the centers C3 of the driving unit covers 132 and 134.

Accordingly, the centers C3 of the driving unit covers 132 and 134 are positioned between the rotation centers C1 and C2 of the rotation plates 420 and 440 and the centerline A2 of the second flow path 114.

At this time, the rotation centers C1 and C2 of the rotation plates 420 and 440 are aligned with the center C4 of the second protruding surface 135*b* or are spaced apart from the center C4 of the second protruding surface 135*b* in the front and rear direction.

The centers C3 of the driving unit covers 132 and 134 may be positioned between the axes A3 and A4 of the driving motors 182 and 184 and the center C4 of the second protruding surface 135*b*.

The centers C3 of the driving unit covers 132 and 134 can be positioned between the axes A3 and A4 of the driving motors 182 and 184 and the rotation centers C1 and C2 of the rotation plates 420 and 440.

The central axis Y bisecting the length of the nozzle cover 130 (or nozzle main body or nozzle housing) in the front and rear direction may be disposed to overlap with the second protruding surface 135*b* in the vertical direction.

The central axis Y bisecting the length of the nozzle cover 130 in the front and rear direction may be positioned closer to the front end of the nozzle cover 130 than the center C4 of the second protruding surface 135*b*.

<Rotation Plate>

Figure 33:
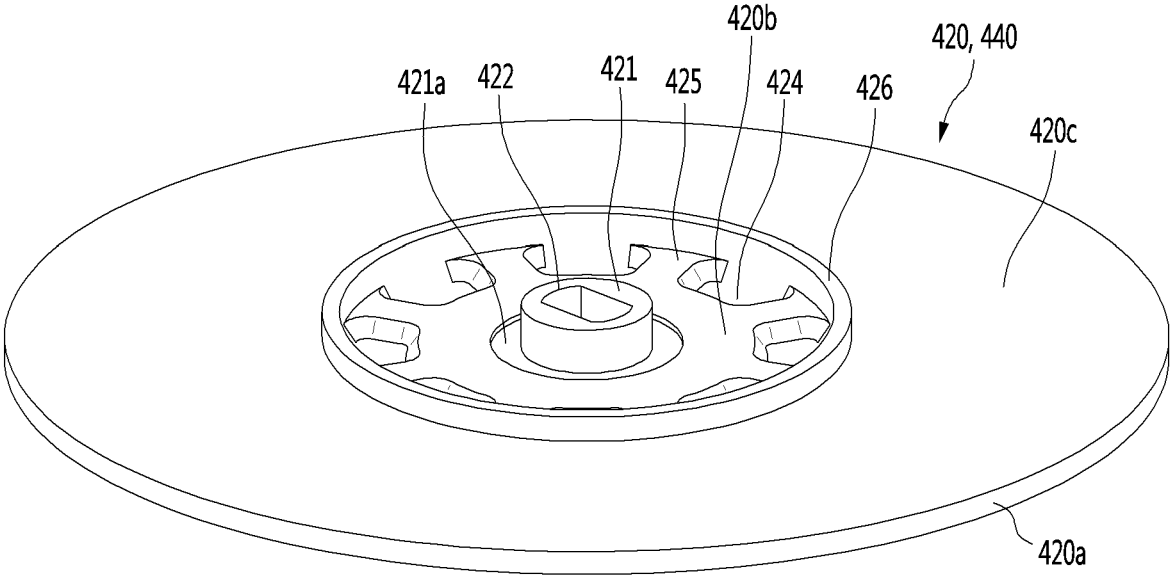
FIG. 33 is a view illustrating a rotation plate according to an embodiment of the present invention as viewed from above.
Figure 34:
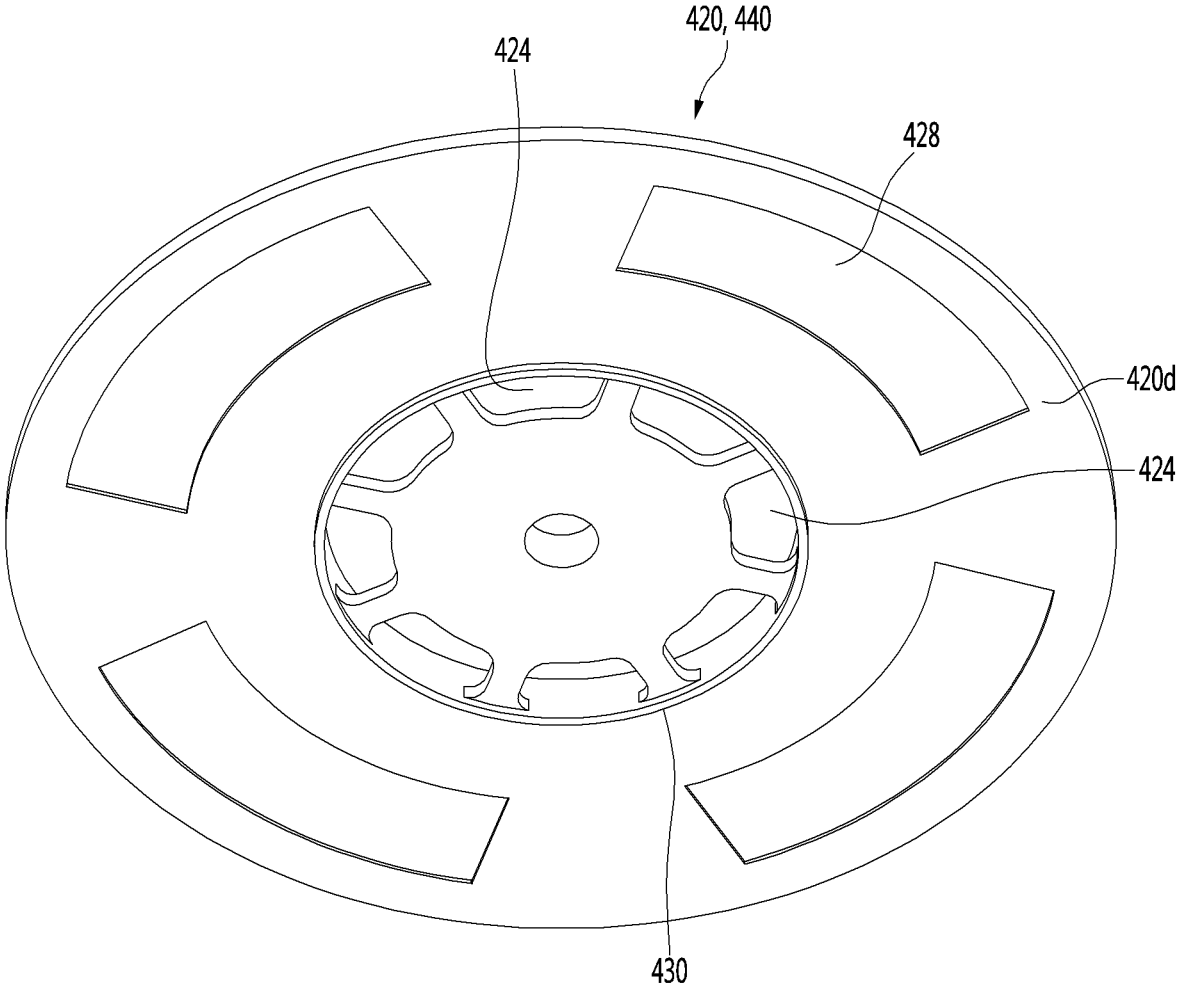
FIG. 34 is a view illustrating a rotation plate according to an embodiment of the present invention as viewed from below.

FIG. 33 is a view illustrating a rotation plate according to an embodiment of the present invention as viewed from above, and FIG. 34 is a view illustrating a rotation plate according to an embodiment of the present invention as viewed from below.

Referring to FIG. 33 and FIG. 34, each of the rotation plates 420 and 440 may be formed in a disc shape so as to prevent mutual interference during the rotation process.

Each of the rotation plates 420 and 440 includes an outer body 420*a* in the form of a circular ring, an inner body 420*b* positioned in a central region of the outer body 420*a* and spaced apart from the inner peripheral surface of the outer body 420*a*, and a plurality of connection ribs 425 connecting the outer circumferential surface of the inner body 420*b* and the inner circumferential surface of the outer body 420*a*.

The height of the inner body 420*b* may be lower than the height of the outer body 420*a*. The upper surface of the inner body 420*b* may be positioned lower than the upper surface 420*c* of the outer body 420*a*.

A shaft coupling unit 421 for coupling the transmission shaft 190 may be provided at a central portion of each of the rotation plates 420 and 440.

For example, the shaft coupling unit 421 may be provided at the central portion of the inner body 420*b*. The shaft coupling unit 421 may protrude upward from the upper surface of the inner body 420*b* and the upper surface may be positioned higher than the upper surface 420*c* of the outer body 420*a*.

For example, the transmission shaft 190 may be inserted into the shaft coupling unit 421. For this purpose, a shaft receiving groove 422 for inserting the transmission shaft 190 may be formed in the shaft coupling unit 421.

A fastening member may be drawn into the shaft coupling unit 421 from below the rotation plates 420 and 440 and be fastened to the transmission shaft 190 in a state where the transmission shaft 190 is coupled to the shaft coupling unit 421.

The rotation plates 420 and 440 may include a plurality of water passage holes 424 disposed outwardly of the shaft coupling unit 421 in the radial direction.

In the present embodiment, since the rotation plates 420 and 440 are rotated in a state where the mops 402 and 404 are attached to the lower sides of the rotation plates 420 and 440, so as to smoothly supply water to the mops 402 and 404 through the rotation plates 420 and 440, the plurality of water passage holes 424 may be spaced circumferentially around the shaft coupling unit 421.

The plurality of water passage holes 424 may be defined by a plurality of connection ribs 425. At this time, each of the connection ribs 425 may be positioned lower than the upper surface 420*c* of the rotation plates 420 and 440. In other words, each of the connection ribs 425 may be positioned lower than the upper surface 420*c* of the outer body 420*a*.

Both sides of the connection ribs 425 may include inclined surfaces that are inclined downward so that the water can flow smoothly into the adjacent water through holes 424 in a case where the water falls into the connection ribs 425. The inclined surface may be planar or rounded.

Therefore, the width of the connection rib 425 is increased from the upper side to the lower side with respect to the vertical section of the connection rib 425.

A portion of the connection rib 425 connected to the inner circumferential surface of the outer body 420*a* and a portion of the connection rib 425 connected to the outer circumferential surface of the inner body 420*b* are rounded in the horizontal direction and have the maximum width of the entire length (length of rotation plate in radial direction).

The inner body 420*b* is provided with a groove portion 421*a* for providing a space for positioning the protruding sleeve 111*b* of the nozzle base 110. The protruding sleeve 111*b* may be seated in the groove portion 421*a*. Alternatively, the lower surface of the protruding sleeve 111*b* is spaced apart from the bottom of the groove portion 421*a* but is lower than the upper surface of the inner body 420*b*.

The protruding sleeve 111*b* surrounds the shaft coupling unit 421. Therefore, the water dropped onto the rotation plates 420 and 440 can be prevented from flowing toward a side of the shaft coupling unit 421 by the protruding sleeve 111*b*.

Since the rotation plates 420 and 440 rotate, centrifugal force acts on the rotation plates 420 and 440. It is necessary to prevent the water sprayed to the rotation plates 420 and 440 from flowing radially outward in a state where the water cannot pass through the water passage holes 424 in the rotation plates 420 and 440 due to the centrifugal force.

Therefore, a water blocking rib 426 may be formed on the upper surface of the rotation plates 420 and 440 radially outside of the water passage hole 424.

For example, the water blocking ribs 426 may protrude upward from the upper surface 420*c* of the outer body 420*a*. The water blocking ribs 426 may be formed continuously in the circumferential direction.

The plurality of water passage holes 424 may be positioned in the inner region of the water blocking ribs 426. The water blocking ribs 426 may be formed in the form of a circular ring, for example.

The center of the water blocking ribs 426 may coincide with the center of the bottom rib 111*a* formed in the nozzle base 110.

Figure 39:
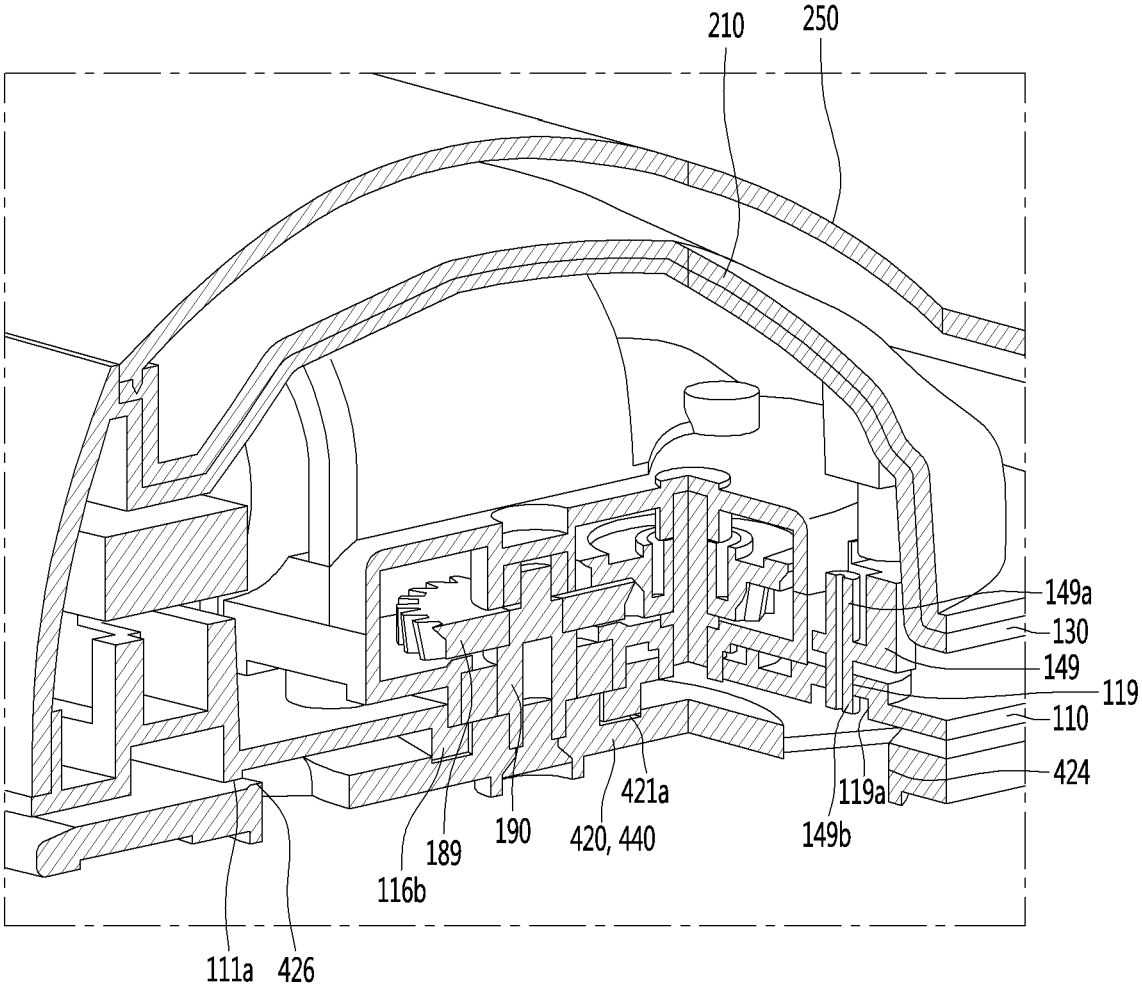
FIG. 39 is a view illustrating a disposition of a water discharge port of a spray nozzle in a nozzle main body according to an embodiment of the present invention.

The diameter of the bottom rib 111*a* of the nozzle base 110 may be larger than the diameter of the water blocking ribs 426 (see FIG. 39). Therefore, since the two ribs are arranged sequentially outward in the radial direction, the water blocking effect can be improved.

An installation groove 428 may be formed on the lower surface 420*d* of the rotation plates 420 and 440 to provide attachment means (see 428*a* of FIG. 38) for attaching the mops 402 and 404. For example, the installation groove 428 may be formed on a lower surface of the outer body 420*a*.

The attachment means (see 428*a* of FIG. 38) can be, for example, a hook-and-look fastener such as Velcro®.

A plurality of installation grooves 428 may be spaced apart in the circumferential direction with respect to the rotation centers C1 and C2 of the rotation plates 420 and 440. Therefore, a plurality of attachment means (see 428*a* of FIG. 38) may be provided on the lower surface 420*b* of the rotation plates 420 and 440.

In the present embodiment, the installation groove 428 may be disposed radially outward of the water passage hole 424 with respect to the rotation centers C1 and C2 of the rotation plates 420 and 440.

For example, the water passage hole 424 and the installation groove 428 may be sequentially arranged radially outward from the rotation centers C1 and C2 of the rotation plates 420 and 440.

The plurality of installation grooves 428 may be formed in an arc shape, for example, and the length of the arcs of the plurality of installation grooves 428 may be formed to be larger than a distance between two adjacent installation grooves.

A through hole among a plurality of water through holes may be positioned in an area between two adjacent installation grooves.

The lower surface 420*d* of the rotation plates 420 and 440 may be provided with a contact rib 430 which contacts the mop 402 or 404 in a state where the mop 402 or 404 is attached to the attachment means.

The contact ribs 430 may protrude downward from a lower surface 420*b* of the rotation plates 420 and 440. For example, the contact rib 430 may protrude downward from a lower surface of the outer body 420*a*.

The contact ribs 430 are disposed radially outward of the water passage holes 424 and may be formed continuously in the circumferential direction. For example, the contact rib 430 may be formed in a circular ring shape.

Since the mops 402 and 404 can be deformed by themselves, for example, as a fiber material, gaps can exist between the mops 402 and 404 and the lower surfaces 420*d* of the rotation plates 420 and 440 in a state where the mops 402 and 404 are attached to the rotation plates 420 and 440 by the attaching means.

When the gap existing between the mops 402 and 404 and the lower surfaces 420*d* of the rotation plates 420 and 440 is large, there is a fear that water is not absorbed to the mops 402 and 404 in a state of passing through the water passage hole 424 and flows to the outside through the gap between the lower surfaces 420*d* of the rotation plates 420 and 440 and the upper surface of the mops 402 and 404.

However, according to the present embodiment, when the mops 402 and 404 are coupled to the rotation plates 420 and 440, the contact ribs 430 can be brought into contact with the mops 402 and 404. When the nozzle 1 is placed on the floor, the contact ribs 430 press the mops 402, 404 by the load of the nozzle 1.

Accordingly, the contact ribs 430 prevent the formation of the gap between the lower surfaces 420*d* of the rotation plates 420 and 440 and the upper surfaces of the mops 402 and 404 and thus water passing through the water passage holes 424 can be smoothly supplied to the mops 402 and 404.

<Water Supply Flow Path>

Figure 35:
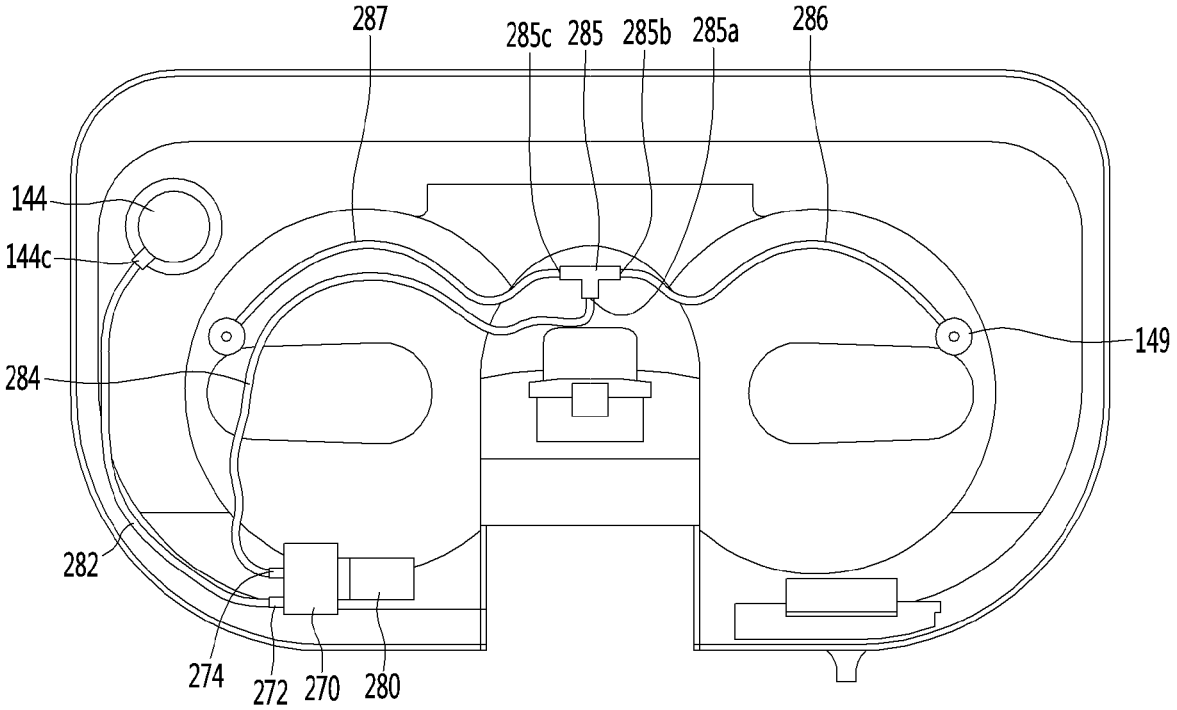
FIG. 35 is a view illustrating a water supply flow path for supplying water of a water tank to the rotation cleaning unit according to an embodiment of the present invention.
Figure 36:
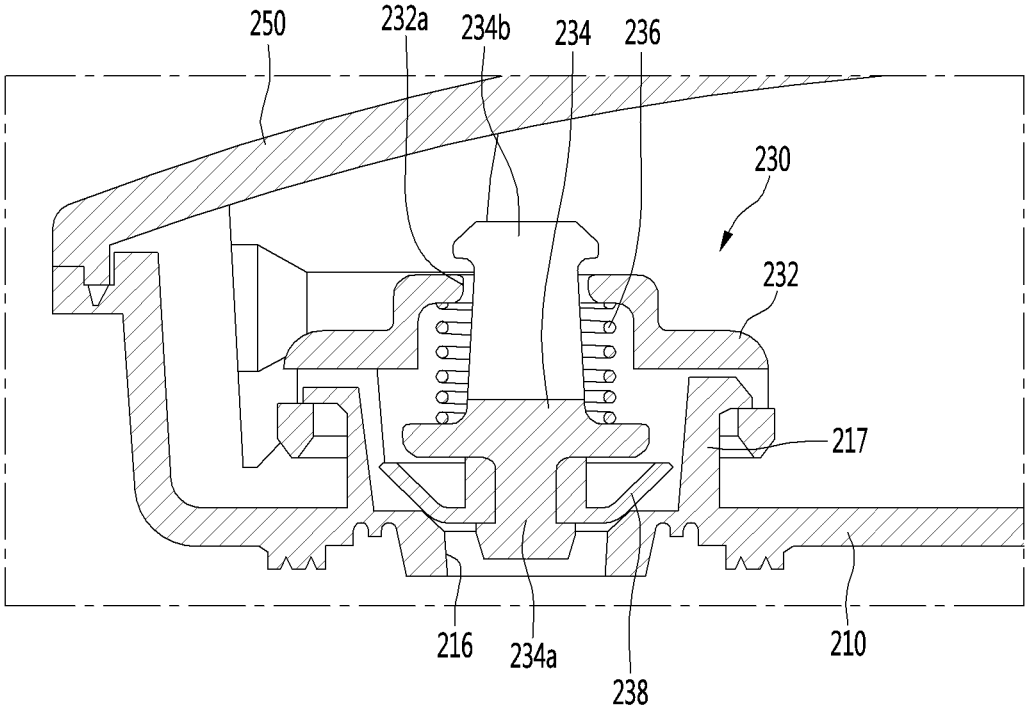
FIG. 36 is a view illustrating a valve in a water tank according to an embodiment of the present invention.
Figure 37:
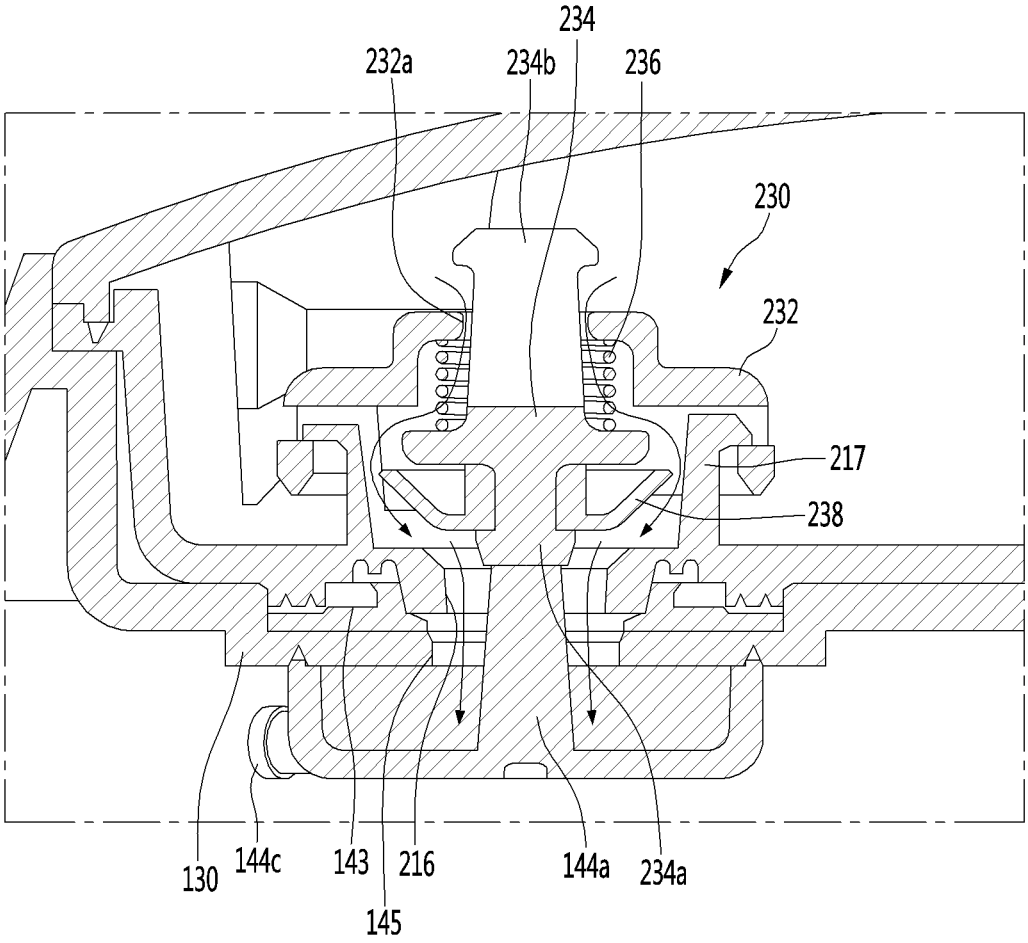
FIG. 37 is a view illustrating a state where the valve opens the discharge port in a state where the water tank is mounted on the nozzle housing.

FIG. 35 is a view illustrating a water supply flow path for supplying water of a water tank to the rotation cleaning unit according to an embodiment of the present invention, FIG. 36 is a view illustrating a valve in a water tank according to an embodiment of the present invention, and FIG. 37 is a view illustrating a state where the valve opens the discharge port in a state where the water tank is mounted on the nozzle housing.

Figure 38:
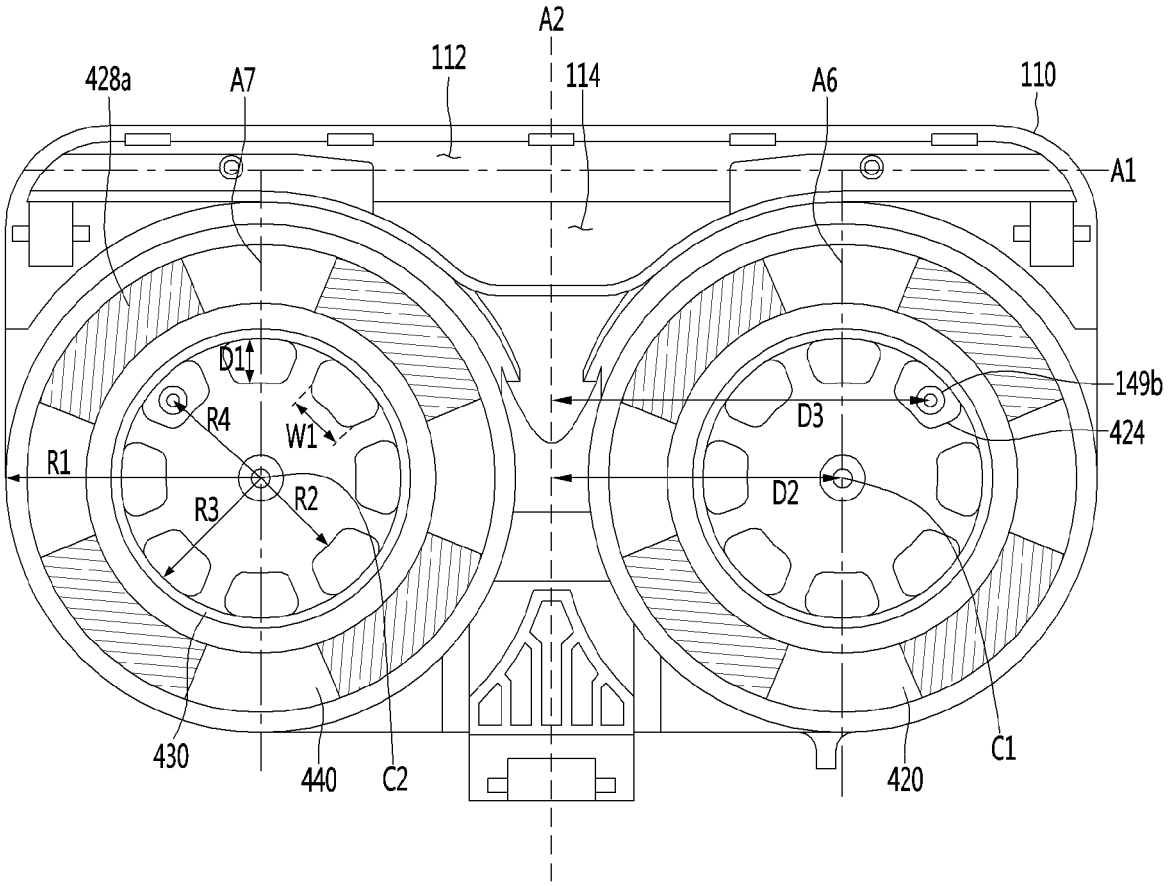
FIG. 38 is a view illustrating a disposition of a rotation plate and a spray nozzle according to an embodiment of the present invention.

FIG. 38 is a view illustrating a disposition of a rotation plate and a spray nozzle according to an embodiment of the present invention and FIG. 39 is a view illustrating a disposition of a water discharge port of a spray nozzle in a nozzle main body according to an embodiment of the present invention.

Figure 40:
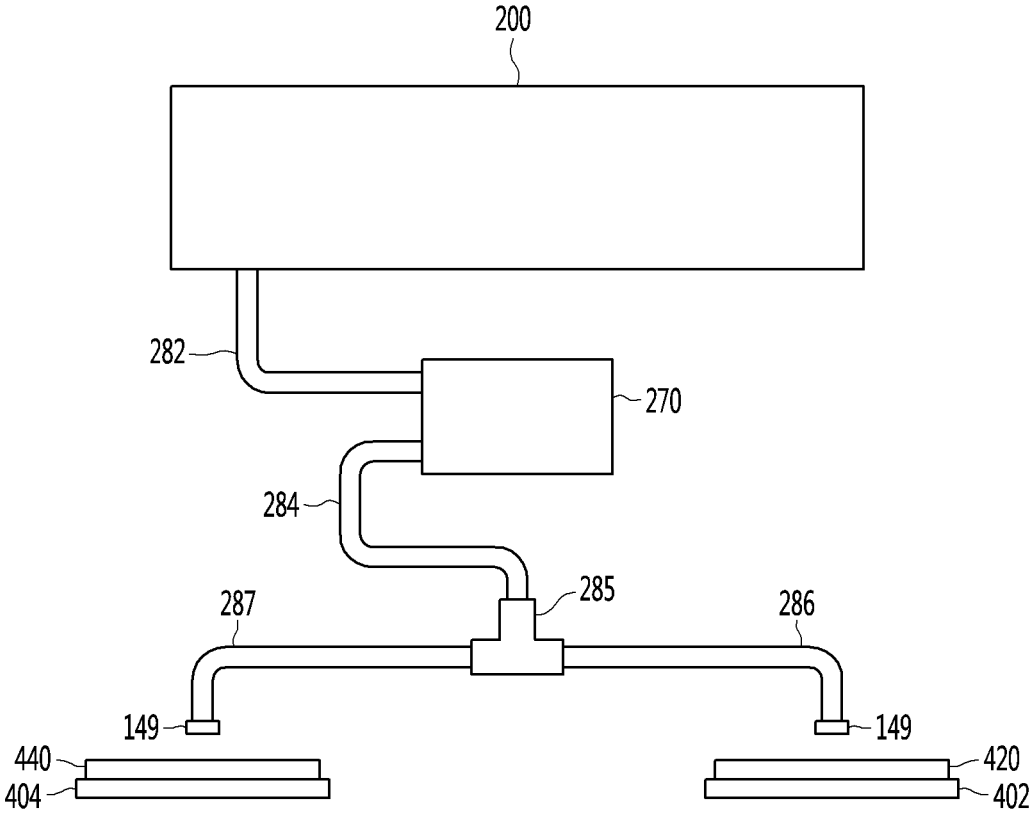
FIG. 40 is a conceptual diagram illustrating a process of supplying water to a rotation cleaning unit in a water tank according to an embodiment of the present invention.

FIG. 40 is a conceptual diagram illustrating a process of supplying water to a rotation cleaning unit in a water tank according to an embodiment of the present invention.

Referring to FIG. 35 to FIG. 40, the water supply flow path of the present embodiment includes a first supply tube 282 connected to the valve operating unit 144, a water pump 270 connected to the first supply tube 282, and a second supply tube 284 connected to the water pump 270.

The water pump 270 may include a first connection port 272 to which the first supply tube 282 is connected and a second connection port 274 to which the second supply tube 284 is connected. On the basis of the water pump 270, the first connection port 272 is an inlet, and the second connection port 274 is a discharge port.

In addition, the water supply flow path may further include a connector 285 to which the second supply tube 284 is connected.

The connector 285 may be formed such that the first connection unit 285*a*, the second connection unit 285*b*, and the third connection unit 285*c* are arranged in a T-shape. The second connection tube 284 may be connected to the first connection unit 285*a*.

The water supply flow path may further include a first branch tube 286 connected to the second connection unit 285*b* and a second branch tube 287 connected to the third connection unit 285*c*.

Accordingly, the water flowing through the first branch tube 286 may be supplied to the first rotation cleaning unit 40 and may be supplied to the second rotation cleaning unit 41 flowing through the second branch tube 287.

The connector 285 may be positioned at the central portion of the nozzle main body 10 such that each of the branch tubes 286 and 287 has the same length.

For example, the connector 285 may be positioned below the flow path cover 136 and above the flow path forming portion 150. In other words, the connector 285 may be positioned directly above the second flow path 114. Thus, substantially the same amount of water can be dispensed from the connector 285 to each of the branch tubes 286 and 287.

In the present embodiment, the water pump 270 may be positioned at one point on the water supply flow path.

At this time, the water pump 270 may be positioned between the valve operating unit 144 and the first connection unit 285*a* of the connector 285 so that water can be discharged from the water tank 200 using a minimum number of the water pumps 270.

In the present embodiment, the water pump 270 may be installed in the nozzle cover 130 in a state where the water pump 270 is positioned close to the portion where the valve operating unit 144 is installed.

As an example, the valve operating unit 144 and the water pump 270 may be provided on one side of both sides of the nozzle main body 10 with respect to the centerline A2 of the second flow path 114.

Therefore, the length of the first supply tube 282 can be reduced, and accordingly, the length of the water supply flow path can be reduced.

Each of the branch tubes 286 and 287 may be connected to the spray nozzle 149. The spray nozzle 149 can also form the water supply flow path of the present invention.

The spray nozzle 149 may include a connection unit 149*a* to be connected to each of the branch tubes 286 and 287 as described above.

The spray nozzle 149 may further include a water discharge port 149*b*. The water discharge port 149*b* extends downward through the nozzle hole 119. In other words, the water discharge port 149*b* may be disposed on the outside of the nozzle housing 100.

When the water discharge port 149*b* is positioned outside the nozzle housing 100, water sprayed through the water discharge port 149*b* can be prevented from being drawn into the nozzle housing 100.

At this time, so as to prevent the water discharge port 149*b* exposed to the outside of the nozzle housing 100 from being damaged, groove 119*a* recessed upward is formed in the bottom of the nozzle base 110. The water discharge port 149*b* may be positioned in the groove 119*a* in a state of passing through the nozzle hole 119. In other words, the nozzle hole 119 may be formed in the groove 119*a*.

The water discharge port 149*b* may be disposed to face the rotation plates 420 and 440 in the groove 119*a*. The lower surface of the water discharge port 149*b* may be positioned at the same height as the lower surface of the nozzle base 110 or may be positioned higher. The lower surface of the water discharge port 149*b* may be positioned higher than the upper surface 420*c* of the outer body 420*a*.

The water sprayed from the water discharge port 149*b* can pass through the water passage hole 424 of the rotation plates 420 and 440.

The minimum radius of the water passage hole 424 at the center of the rotation plates 420 and 440 is R2 and the maximum radius of the water passage hole 424 at the center of the rotation plates 420 and 440 is R3.

The radius from the center of the rotation plates 420 and 440 to the center of the water discharge port 149*b* is R4. At this time, R4 is larger than R2 and smaller than R3.

D1, which is a difference between R3 and R2, is larger than the diameter of the water discharge port 149*b*.

In addition, D1, which is a difference between R3 and R2, is formed to be smaller than a minimum width W1 of the water passage hole 424.

When the outer diameters of the rotation plates 420 and 440 are R1, R3 may be larger than half of R1.

A line perpendicularly connecting the first rotation center C1 and the centerline A1 of the first flow path 112 may be referred to as a first connection line A6, and a line perpendicularly connecting the second rotation center C2 and an axis A1 of the first flow path 112 may be referred to as a second connecting line A7.

At this time, the first connection line A6 and the second connection line A7 may be positioned in a region between a pair of water discharge port 149*b* for supplying water to each of the rotation cleaning units 40 and 41.

In other words, the horizontal distance D3 from the water discharge port 149*b* to the centerline A2 of the second flow path 114 is longer than the horizontal distance D2 to the rotation center C1 and C2 of each of the rotation plates 420 and 440 and centerline A2 of the second flow path 114.

This is because the second flow path 114 extends in the front and rear direction at the central portion of the nozzle 1 so that water is prevented from being suctioned into the nozzle 1 through the second flow path 114 during the rotation of the rotating plates 420.

The horizontal distance between water discharge port 149*b* and the centerline A1 of the first flow path 112 is shorter than the horizontal distance between each of the rotation centers C1 and C2 and the centerline A1 of the first flow path 112.

The water discharge port 149*b* is positioned opposite to the axes A3 and A4 of the driving motors 182 and 184 with respect to the connection lines A6 and A7.

Meanwhile, the valve 230 may include a movable unit 234, an opening and closing unit 238, and a fixing unit 232.

The fixing unit 232 may be fixed to a fixing rib 217 protruding upward from the first body 210 of the water tank 200.

The fixing unit 232 may have an opening 232*a* through which the movable unit 234 passes.

The fixing unit 232 restricts the movable unit 234 from moving upward at a predetermined height from the fixing unit 232 in a state where the fixing unit 232 is coupled with the fixing rib 217.

The movable unit 234 can be moved in the vertical direction in a state where a portion of the movable unit 234 passes through the opening 232*a*. In a state where the movable unit 234 is moved upward, water can pass through the opening 232*a*.

The movable unit 234 may include a first extension portion 234*a* extending downward and coupled with the opening and closing unit 238 and a second extension portion 234*b* extending upwardly and passing through the opening 232*a*.

The movable unit 234 may be elastically supported by an elastic member 236. One end of the elastic member 236, as a coil spring, for example, may be supported by the fixed portion 232 and the other end may be supported by the movable unit 234.

The elastic member 236 provides a force to the movable unit 234 to move the movable unit 234 downward.

The opening/closing unit 238 can selectively open the discharge port 216 by moving the movable unit 234 up and down.

At least a portion of the opening/closing unit 238 may have a diameter larger than the diameter of the discharge port 216 so that the opening/closing unit 238 may block the discharge port 216.

The opening/closing unit 238 may be formed of, for example, a rubber material so that the leakage of water is prevented in a state where the opening/closing unit 238 blocks the discharge port 216.

The elastic force of the elastic member 236 is applied to the movable unit 234 so that a state where the opening and closing unit 238 blocks the discharge port 216 can be maintained unless an external force is applied to the movable unit 234.

The movable unit 234 can be moved by the valve operating unit 144 in the process of mounting the water tank 200 to the nozzle main body 10.

The valve operating unit 144 is coupled to the nozzle cover 130 from below the nozzle cover 130 as described above.

The valve operating unit 144 may include a pressing portion 144*a* passing through the water passage opening 145. The pressing portion 144*a* may protrude upward from the bottom of the nozzle cover 130 in a state of passing through the water passage opening 145 of the nozzle cover 130.

The valve operating unit 144 may form a water supply flow path together with the bottom of the nozzle cover 130. A connection tube 144*c* for connecting the first supply tube 282 may be provided at one side of the valve operating unit 144.

The diameter of the water passage opening 145 may be larger than the outer diameter of the pressing portion 144*a* so that water flows smoothly in a state where the pressing portion 144*a* passes through the water passage opening 145.

When the water tank 200 is mounted on the nozzle main body 10, the pressing portion 144*a* is drawn into the discharge port 216 of the water tank 200. The pressing portion 144*a* presses the movable unit 234 in a process in which the pressing portion 144*a* is being drawn into the discharge port 216 of the water tank 200.

The movable unit 234 is lifted and the opening and closing unit 238 coupled to the movable unit 234 moves upward together with the movable unit 234 to be separated from the discharge port 216 to open the discharge port 216.

The water in the water tank 200 is discharged through the discharge port 216 and absorbed into the absorption member 147 in the valve operating unit 144 through the water passage opening 145. The water absorbed by the absorption member 147 is supplied to the first supply tube 282 connected to the connection tube 144*c*.

The water supplied to the first supply tube 282 flows into the second supply tube 284 after being drawn into the water pump 270. The water flowing into the second supply tube 284 flows to the first branch tube 286 and the second branch tube 287 by the connector 285. The water flowing into each of the branch tubes 286 and 287 is sprayed from the spray nozzle 149 toward the rotation cleaning units 40 and 41.

The water sprayed from the spray nozzle 149 is supplied to the mops 402 and 404 after passing through the water passage holes 424 of the rotation plates 420 and 440. The mops 402 and 404 are rotated while absorbing the supplied water to wipe the floor.

In the present embodiment, since the water discharged from the water tank 200 passes through the first supply tube 282 after passing through the absorption member 147 and the absorption member 147 absorbs the pressure generated by the pumping force of the water pump 270, it prevents the water from suddenly flowing into the connector 285.

In this case, the water pressure is concentrated on one of the first branch tube 286 and the second branch tube 287, and concentration of water into a branch tube can be prevented.

Figure 41:
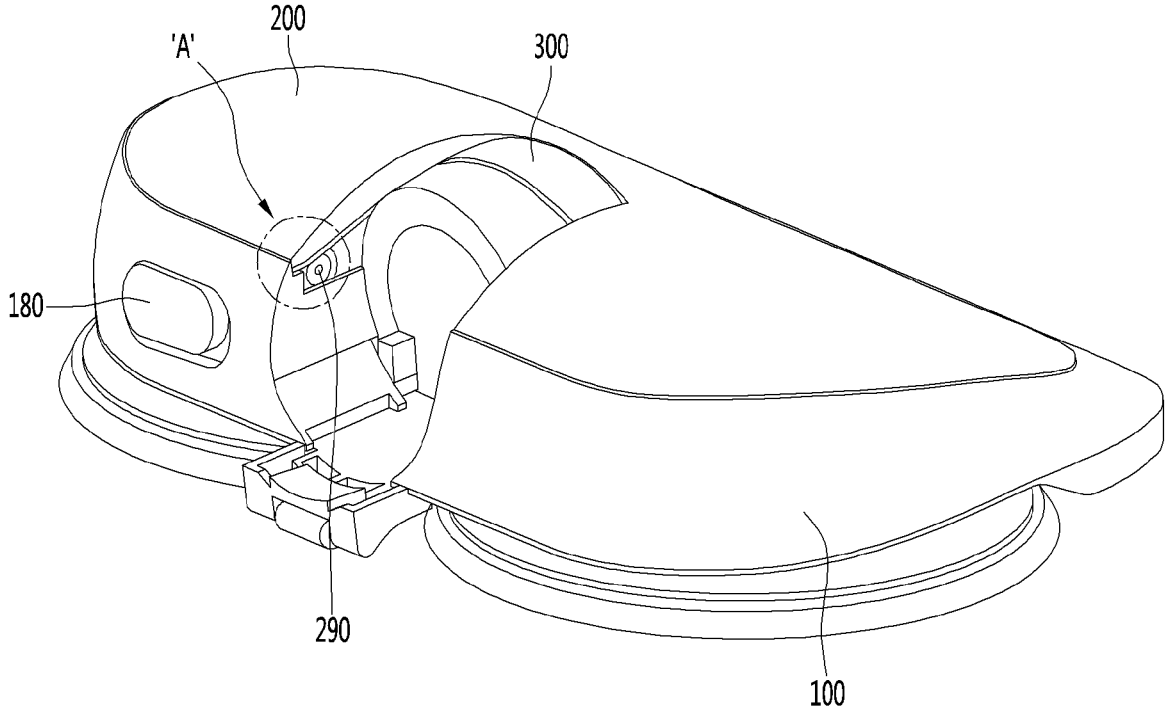
FIG. 41 is a perspective view illustrating the nozzle for the cleaner from which a connection tube is separated according to an embodiment of the present invention as viewed from the rear side.
Figure 42:
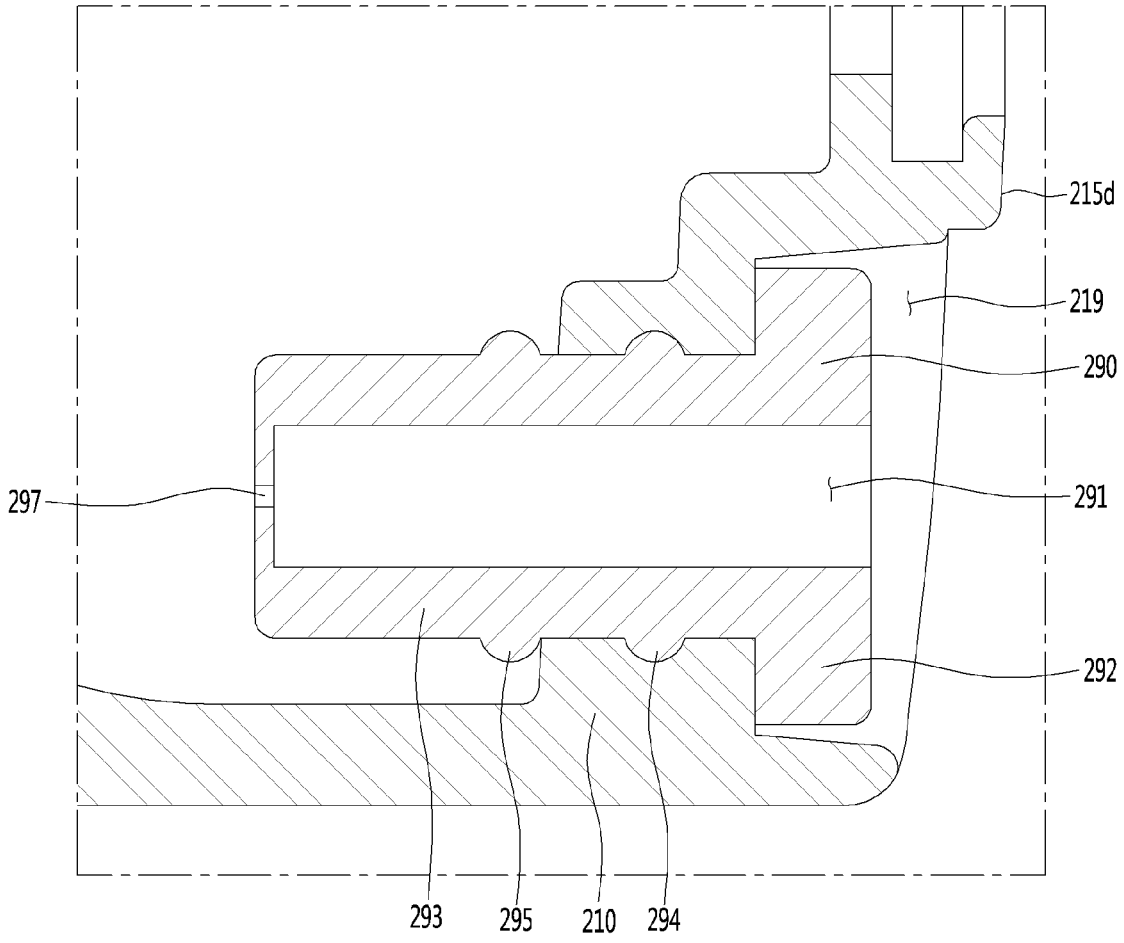
FIG. 42 is a sectional view illustrating area 'A' in FIG. 41.
Figure 43:
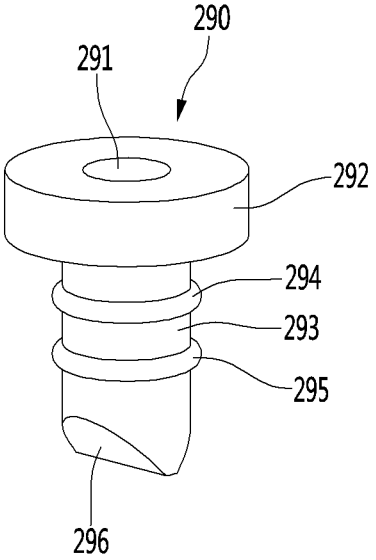
FIG. 43 is a perspective view illustrating the gasket of FIG. 42.

FIG. 41 is a perspective view illustrating the nozzle for the cleaner from which a connection tube is separated according to an embodiment of the present invention as viewed from the rear side, FIG. 42 is a sectional view illustrating area 'A' in FIG. 41, and FIG. 43 is a perspective view illustrating the gasket of FIG. 42.

Referring to FIG. 41 to FIG. 43, at least one air hole 219 for introducing outside air may be formed in the water tank 200. Hereinafter, as an example, one air hole 219 is formed in the water tank 200, but a plurality of the air holes 219 may be provided.

The air holes 219 may be formed on one side of the water tank 200. For example, the air holes 219 may be formed in any one of a pair of the front and rear extending walls 215*b* facing each other in the water tank 200.

Although the pair of the front and rear extending walls 215*b* is spaced apart from each other to define a space and the connection tube 50 is positioned in the space, a portion of the front and rear extending walls 215*b* formed with the air holes 219 is spaced apart so that the air can be smoothly supplied to the air holes 219.

In detail, the gasket 290 may be press-fitted into the air hole 219.

The gasket 290 can guide the outside air into the interior space of the water tank 200.

The gasket 290 may be referred to as a check valve in that the outside air flows into the water tank 200 while the water in the water tank 200 is interrupted so as not to be discharged to the outside.

The gasket 290 may be formed of a material deformed in shape by an external force. For example, the gasket 290 may be formed of polyethylene material but is not limited thereto.

The gasket 290 may include a cylindrical body 293, for example.

An end portion of one side of the body 293 may be received inside the water tank 200 through the air hole 219. The other end portion of the body 293 may be exposed to the outside of the water tank 200.

At least one sealing protrusion 294 and 295 may be formed on the outside of the body 293. The outer diameter of the sealing protrusions 294 and 295 may be larger than the inner diameter of the air hole 219. When the sealing protrusions 294 and 295 are formed as described above, leakage between the body 293 and the air holes 219 can be prevented.

In a case where a plurality of the sealing protrusions 294 and 295 are formed, a portion of the sealing protrusions 294 and 295 may be positioned inside the water tank 200.

A flange 292 having an outer diameter larger than that of the body 293 and the sealing protrusions 294 and 295 may be formed at the other end portion of the body 293. The flange 292 has a larger diameter than the air hole 219. The entirety of the gasket 290 is prevented from entering the inside of the water tank 200 by the flange 292.

In addition, the gasket 290 may be formed with an air flow path 291 through which air flows in the central portion thereof and a slit 297 may be formed at the other end portion thereof. At this time, the other end portion of the gasket 290 may contact water in the water tank 200.

In addition, so that the slit 297 formed at the other end portion of the gasket 290 is blocked by the pressure of water, the gasket 290 is formed such that the sectional area of the gasket 290 decreases from one point to the other end portion, and thus inclined surfaces 296 can be formed on the outer side.

In detail, the inclined surfaces 296 may be formed on both sides of the slit 297.

According to an embodiment, the water pressure is applied to the inclined surface 296 formed at the other end portion of the gasket 290 and thus the other end portion of the gasket 290 inwardly shrinks, and in this process, the slit 297 is blocked in a state where the inner pressure of the water tank 200 is not lowered (a state where water is not discharged).

Therefore, water in the water tank 200 is prevented from leaking to the outside through the slit 297.

In addition, the slit 297 is blocked by the water pressure of the water tank 200 so that the air is not supplied to the inner portion of the water tank 200 through the slit 297 in a state where no external force is applied to the gasket 290.

Meanwhile, outside air can be supplied to the water tank 200 through the gasket 290 in a state where the internal pressure of the water tank 200 is lowered (a state where water is discharged).

Specifically, when the pump motor 280 operates, the water in the water tank 200 is discharged through the discharge port 216 by the water pump 270. The internal pressure of the water tank 200 is instantaneously lowered.

While the pressure applied to the inclined surface 296 of the gasket 290 is also lowered, the other end portion of the gasket 290 is restored to an original state thereof, and the slit 297 can be opened.

As described above, when the slit 297 is opened, the outside air can be supplied to the water tank 200 through the slit 297.

In a state where the slit 297 is opened, the surface tension of the water around the slit 297 and the force with which the external air flows are greater than the water pressure in the water tank 200, and water is not discharged to the outside of the water tank 200 through the slit 297.

According to the present embodiment, water in the water tank 200 can be prevented from being discharged to the outside through the gasket 290 when the water pump 270 is not operated.

In addition, in a state where the water pump 270 is operated, since air can be introduced into the water tank 200 through the slits 297 of the gasket 290, the water in the water tank 200 can be stably supplied to the mops 402 and 404.

According to the proposed embodiment, since foreign matters on the floor can be suctioned, the floor can be wiped by rotating the mop, and water can be supplied to the mop, there is an advantage that cleaning performance is improved.

In this embodiment, since the upper wall of the water tank forms the outer appearance of the upper surface of the nozzle, and the bottom wall of the water tank is disposed so as to surround the driving unit, the water tank itself is reduced in thickness so that the water tank does not interfere, and thus there is an advantage that storage capacity of water tank can be increased.

In the case of the present embodiment, since the water tank surrounds a pair of driving devices disposed laterally spaced apart and formed symmetrically with respect to the centerline of the suction flow path in the front and rear direction, there is provided a nozzle for a cleaner in which the center of gravity of the nozzle can be uniformly distributed to the left and right of the nozzle in a state where the water tank is mounted.

In addition, in a case of the present embodiment, since the bottom wall of the water tank is constituted by a plurality of bottom walls having a height difference and the discharge port is formed in the bottom wall having the lowest height, even when the nozzle is inclined, there is an advantage that the water can easily flow toward the bottom wall having a low height from the bottom wall having a high height.

In a case of the present embodiment, since the inlets are formed on both side walls of the water tank, respectively, there is an advantage that the user can easily inject water into the water tank through one of the inlets.

In the present embodiment, since the supporting body supported by the elastic member raises the water tank in the process of separating the water tank from the nozzle, there is an advantage that the user can easily grasp the water tank.

What is claims is:

1. A nozzle for water cleaning, the nozzle comprising:

a nozzle housing;

a first rotation cleaning unit and a second rotation cleaning unit disposed below a lower surface of the nozzle housing, the first rotation cleaning unit and the second rotation cleaning unit being spaced apart from each other in a left-right direction of the nozzle housing, each of the first rotation cleaning unit and the second rotation cleaning unit having a rotation plate;

a driving device disposed in the nozzle housing, the driving device having a driving motor configured to rotate the rotation plate of the rotation cleaning unit; and a water tank disposed on a upper surface of the nozzle housing and configured to store water to be supplied to an upper portion of the rotation plate, the water tank being disposed on at least one side of an imaginary center line drawn in a front-rear direction of the nozzle housing, wherein the water tank includes a discharge port for discharging water at a front portion of a bottom of the water tank, and wherein, when the water tank is coupled to the upper surface of the nozzle housing, the bottom of the water tank is disposed to be lowered in height toward a direction where the discharge port is positioned.

2. The nozzle for water cleaning of claim 1, wherein the upper surface of the nozzle housing is formed to be lower in height toward a front direction of the nozzle housing.

3. The nozzle for water cleaning of claim 2, wherein the bottom of the water tank has a shape corresponding to a shape of the upper surface of the nozzle housing.

4. The nozzle for water cleaning of claim 3, wherein, when the water tank is coupled to the upper surface of the nozzle housing, a front end of the water tank is arranged to be lower in height than the rear end of the water tank.

5. The nozzle for water cleaning of claim 1, wherein at least a portion of the bottom of the water tank and at least a portion of the upper surface of the nozzle housing are formed to slope downward toward a front direction of the nozzle.

6. The nozzle for water cleaning of claim 1, wherein the upper surface of the nozzle housing forms a plurality of surface portions with different heights in a vertical direction of the nozzle housing, and wherein a vertical width of the water tank is formed to be inversely proportional to a height of the upper surface of the nozzle housing.

7. The nozzle for water cleaning of claim 6, wherein a vertical width of the water tank at a position corresponding a high-height portion of the upper surface of the nozzle housing is narrower than a vertical width of the water tank at a position corresponding a low-height portion of the upper surface of the nozzle housing.

8. The nozzle for water cleaning of claim 1, wherein an upper surface of the water tank extends to have a downward slope toward a front of the nozzle housing.

9. The nozzle for water cleaning of claim 8, wherein the upper surface of the water tank has a curved surface.

10. The nozzle for water cleaning of claim 8, wherein the upper surface of the water tank has a semi-elliptical structure so that a slope of a front portion is gentler than a slope of the rear portion.

11. The nozzle for water cleaning of claim 8, wherein a vertical width between the bottom of the water tank and the upper surface of the water tank is formed to vary along the front-to-back direction of the nozzle housing.

12. The nozzle for water cleaning of claim 11, wherein the vertical width of the water tank is narrowest at a front end of the water tank.

13. The nozzle for water cleaning of claim 1, wherein the bottom of the water tank is formed so that a central portion has the highest height.

14. The nozzle for water cleaning of claim 13, wherein an upper surface of the water tank is formed so that a front portion has a lower height than a rear portion.

15. The nozzle for water cleaning of claim 14, wherein the upper surface of the water tank is formed so that the front portion has the lowest height.

16. The nozzle for water cleaning of claim 15, wherein the upper surface of the water tank is formed so that an area between the front portion and the rear portion has the highest height.

* * * * *